US008929759B2

(12) United States Patent
Iwata et al.

(10) Patent No.: US 8,929,759 B2
(45) Date of Patent: Jan. 6, 2015

(54) IMAGE FORMING APPARATUS AND DENSITY CHANGE SUPPRESSING METHOD

(71) Applicants: Muneaki Iwata, Kanagawa (JP); Kazuhiro Akatsu, Kanagawa (JP); Masaaki Ishida, Kanagawa (JP); Atsufumi Omori, Kanagawa (JP); Hayato Fujita, Kanagawa (JP)

(72) Inventors: Muneaki Iwata, Kanagawa (JP); Kazuhiro Akatsu, Kanagawa (JP); Masaaki Ishida, Kanagawa (JP); Atsufumi Omori, Kanagawa (JP); Hayato Fujita, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 42 days.

(21) Appl. No.: 13/889,781

(22) Filed: May 8, 2013

(65) Prior Publication Data

US 2013/0302052 A1 Nov. 14, 2013

(30) Foreign Application Priority Data

May 10, 2012 (JP) ..... 2012-108138
May 10, 2012 (JP) ..... 2012-108171

(51) Int. Cl.
*G03G 15/00* (2006.01)
*G03G 13/04* (2006.01)
*G03G 15/043* (2006.01)

(52) U.S. Cl.
CPC ..... *G03G 13/04* (2013.01); *G03G 15/5041* (2013.01); *G03G 15/55* (2013.01); *G03G 15/043* (2013.01); *G03G 15/5054* (2013.01)
USPC ..... 399/49; 399/58; 399/128; 399/222; 399/32; 399/51

(58) Field of Classification Search
USPC ..... 399/49, 58, 128, 222, 53, 51
See application file for complete search history.

(56) References Cited

U.S. PATENT DOCUMENTS 5,722,006 A * 2/1998 Watanabe ..... 399/49
6,498,617 B1 12/2002 Ishida et al.
2003/0025785 A1 2/2003 Nihei et al.

(Continued)

FOREIGN PATENT DOCUMENTS

JP 2005-007697 1/2005
JP 2005-017514 1/2005

(Continued)

OTHER PUBLICATIONS

U.S. Appl. No. 13/843,147, filed Mar. 15, 2013, Omori, et al.

(Continued)

*Primary Examiner* — Walter L Lindsay, Jr.
*Assistant Examiner* — Roy Y Yi
(74) *Attorney, Agent, or Firm* — Oblon, Spivak, McClelland, Maier & Neustadt, L.L.P.

(57) ABSTRACT

An image forming apparatus includes: a density detection unit that detects densities of an image developed by a developing unit at a plurality of positions in a main-scanning direction; a processing unit that obtains at least one of an amplitude and a phase of a first periodical density change of the image, of which cycle is a rotation cycle of a photosensitive drum, at the plurality of positions in the main-scanning direction on the basis of an output signal of the density detection unit, and corrects a drive signal for the light source so as to suppress the first periodical density change of the image at each position in the main-scanning direction on the basis of the rotation cycle of the photosensitive drum and at least one of the amplitude and the phase.

20 Claims, 46 Drawing Sheets

(56) References Cited

U.S. PATENT DOCUMENTS

| | | | | |
|---|---|---|---|---|
| 2003/0067533 | A1 | 4/2003 | Omori et al. | |
| 2003/0156184 | A1 | 8/2003 | Suzuki et al. | |
| 2004/0125199 | A1 | 7/2004 | Omori et al. | |
| 2005/0243163 | A1 | 11/2005 | Ozasa et al. | |
| 2006/0285186 | A1 | 12/2006 | Ishida et al. | |
| 2007/0030548 | A1 | 2/2007 | Nihei et al. | |
| 2007/0091163 | A1 | 4/2007 | Omori et al. | |
| 2007/0132828 | A1 | 6/2007 | Ishida et al. | |
| 2007/0242127 | A1 | 10/2007 | Omori et al. | |
| 2008/0062399 | A1 | 3/2008 | Yoshida | |
| 2008/0088893 | A1 | 4/2008 | Ishida et al. | |
| 2008/0123160 | A1 | 5/2008 | Omori et al. | |
| 2008/0218813 | A1 | 9/2008 | Tanabe et al. | |
| 2008/0225106 | A1 | 9/2008 | Omori et al. | |
| 2008/0239336 | A1 | 10/2008 | Tanabe et al. | |
| 2008/0267663 | A1 | 10/2008 | Ichii et al. | |
| 2008/0285991 | A1* | 11/2008 | Oki | 399/51 |
| 2008/0291259 | A1 | 11/2008 | Nihei et al. | |
| 2008/0298842 | A1 | 12/2008 | Ishida et al. | |
| 2009/0091805 | A1 | 4/2009 | Tanabe et al. | |
| 2009/0167837 | A1 | 7/2009 | Ishida et al. | |
| 2009/0174915 | A1 | 7/2009 | Nihei et al. | |
| 2009/0195635 | A1 | 8/2009 | Ishida et al. | |
| 2009/0231656 | A1 | 9/2009 | Suzuki et al. | |
| 2009/0303451 | A1 | 12/2009 | Miyake et al. | |
| 2010/0045767 | A1 | 2/2010 | Nihei et al. | |
| 2010/0119262 | A1 | 5/2010 | Omori et al. | |
| 2010/0214637 | A1 | 8/2010 | Nihei et al. | |
| 2011/0199657 | A1 | 8/2011 | Ishida et al. | |
| 2011/0228037 | A1 | 9/2011 | Omori et al. | |
| 2012/0099165 | A1 | 4/2012 | Omori et al. | |
| 2012/0189328 | A1 | 7/2012 | Suzuki et al. | |
| 2012/0293783 | A1 | 11/2012 | Ishida et al. | |

FOREIGN PATENT DOCUMENTS

| | | |
|---|---|---|
| JP | 2005-070068 | 3/2005 |
| JP | 2008-065270 | 3/2008 |
| JP | 2012-088522 | 5/2012 |

OTHER PUBLICATIONS

U.S. Appl. No. 13/843,147, filed Mar. 15, 2013.

* cited by examiner

IMAGE FORMING APPARATUS AND DENSITY CHANGE SUPPRESSING METHOD

CROSS-REFERENCE TO RELATED APPLICATIONS

The present application claims priority to and incorporates by reference the entire contents of Japanese Patent Application No. 2012-108138 filed in Japan on May 10, 2012 and Japanese Patent Application No. 2012-108171 filed in Japan on May 10, 2012.

BACKGROUND OF THE INVENTION

1. Field of the Invention

The present invention relates to an image forming apparatus and a density change suppressing method.

2. Description of the Related Art

In general, an image forming apparatus such as a printer, a copier, and a facsimile machine emits light onto a surface, which is to be scanned, and scans the surface using the light, thus forming latent image.

Such image forming apparatus includes a photosensitive drum having photosensitivity on the surface thereof serving as the surface which is to be scanned, and also includes a light source. Further, such image forming apparatus includes an optical scanning device for forming a latent image on the photosensitive drum surface by scanning the photosensitive drum surface in a main-scanning direction using light emitted from the light source, and also includes a developing unit including a developing roller that develops the latent image (see Japanese Patent Application Laid-open No. 2005-007697).

By the way, for example, when at least one of the photosensitive drum and the developing roller is eccentric, or when the cross section of at least one of the photosensitive drum and the developing roller is not a true circle, then, a gap between the photosensitive drum and the developing roller is changed when the photosensitive drum and developing roller are rotated. This change of the gap results in change of development, and also results in undesired density change in an image which is output from the image forming apparatus (also referred to as "output image").

In recent years, demand for higher quality image is increasing, but it is difficult for the image forming apparatus disclosed in Japanese Patent Application Laid-open No. 2005-007697 to suppress the density change to the required level in the entire output image.

Therefore, it is desirable to provide an image forming apparatus capable of suppressing the density change to the required level in the entire output image.

SUMMARY OF THE INVENTION

It is an object of the present invention to at least partially solve the problems in the conventional technology.

According to an aspect of the present invention, there is provided an image forming apparatus including: a photosensitive drum; an optical scanning device that includes a light source, the optical scanning device scanning a surface of the photosensitive drum in a main-scanning direction using light from the light source, and forms a latent image on the surface of the photosensitive drum; a developing unit that develops the latent image; a drum cycle detection sensor that detects a rotation cycle of the photosensitive drum; a density detection unit that detects densities of an image developed by the developing unit at a plurality of positions in the main-scanning direction; a processing unit that obtains at least one of an amplitude and a phase of a first periodical density change of the image, of which cycle is a rotation cycle of the photosensitive drum, at the plurality of positions in the main-scanning direction on the basis of an output signal of the density detection unit, and corrects a drive signal for the light source so as to suppress the first periodical density change of the image at each position in the main-scanning direction on the basis of the rotation cycle of the photosensitive drum and at least one of the amplitude and the phase.

According to another aspect of the present invention, there is provided a density change suppressing method for suppressing density change of an image formed on the basis of image information, the method including: scanning a photosensitive drum surface using light from a light source in a main-scanning direction, and forming a latent image on the photosensitive drum surface; developing the latent image; detecting density change in a sub-scanning direction which is perpendicular to the main-scanning direction at a plurality of positions in the main-scanning direction of the developed image; obtaining at least one of an amplitude and a phase of a first periodical density change of which cycle is a rotation cycle of the photosensitive drum at the plurality of positions of the image on the basis of the detected density change; and generating a first correction pattern for a drive signal of the light source so as to suppress the first periodical density change of the image at each position in the main-scanning direction on the basis of the rotation cycle of the photosensitive drum and at least one of the amplitude and the phase.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 5, FIG. 5A, and FIG. 5B are figures for explaining the optical scanning device of FIG. 1 (part two and part three, respectively);

DETAILED DESCRIPTION OF THE PREFERRED EMBODIMENTS

Hereinafter, an embodiment for carrying out the present invention will be explained

First Embodiment

Figure 1:
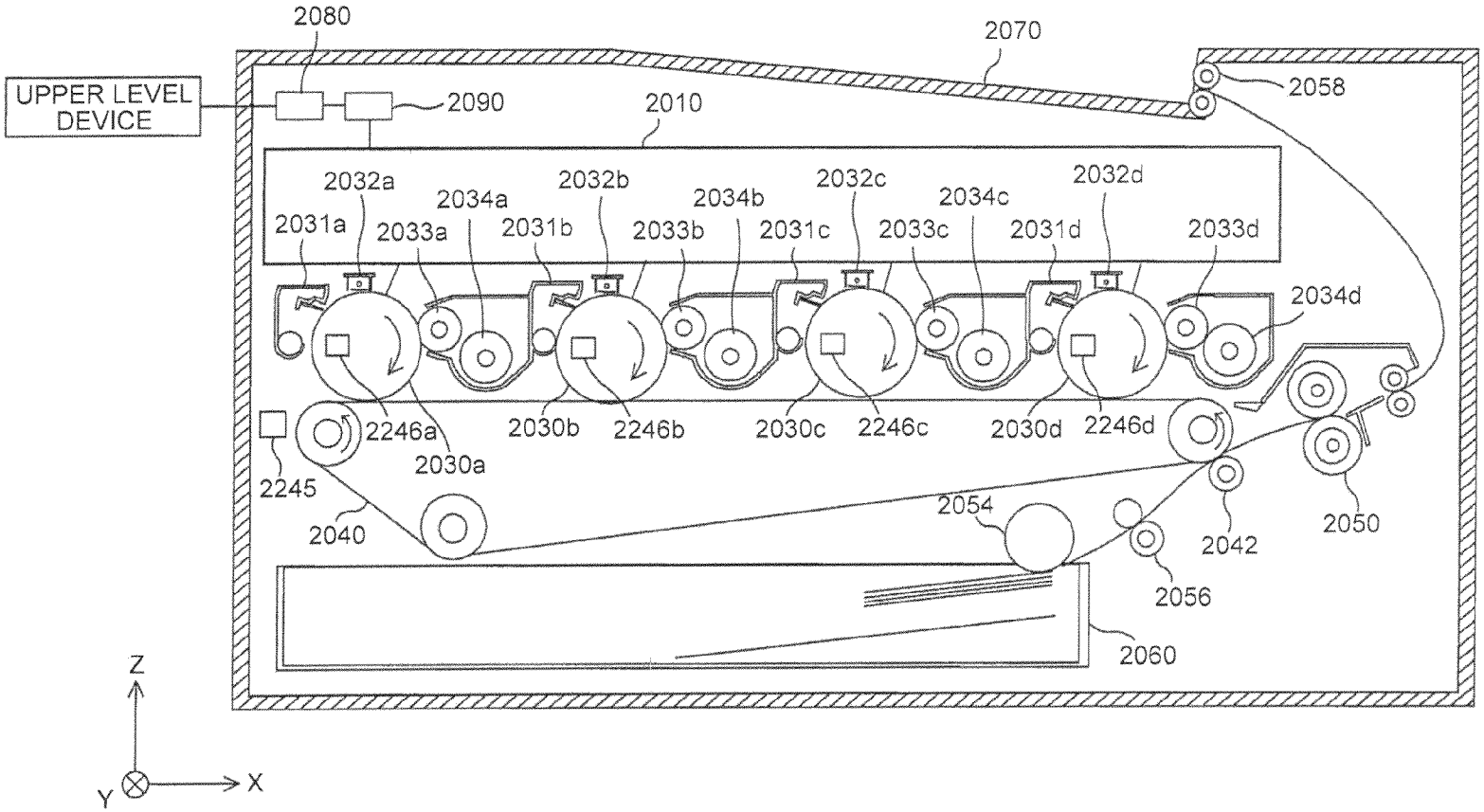
FIG. 1 is a figure illustrating a schematic configuration of a color printer according to a first embodiment.

Hereinafter, a first embodiment of the present invention will be explained with reference to FIGS. 1 to 24. FIG. 1 illustrates a schematic configuration of a color printer 2000 which is an image forming apparatus according to the first embodiment.

This color printer 2000 is a tandem multi-color printer for forming a full color image by overlaying four colors (black, cyan, magenta, yellow), and includes an optical scanning device 2010, four photosensitive drums (2030*a*, 2030*b*, 2030*c*, 2030*d*), four cleaning units (2031*a*, 2031*b*, 2031*c*, 2031*d*), four charging devices (2032*a*, 2032*b*, 2032*c*, 2032*d*), four developing rollers (2033*a*, 2033*b*, 2033*c*, 2033*d*), four toner cartridges (2034*a*, 2034*b*, 2034*c*, 2034*d*), a transfer belt 2040, a transfer roller 2042, a fixing roller 2050, a sheet feeding roller 2054, a pre-transfer roller pair 2056, a discharging roller 2058, a paper feed tray 2060, a discharge tray 2070, a communication control device 2080, a density detecting device 2245, four home position sensors (2246*a*, 2246*b*, 2246*c*, 2246*d*), a printer control device 2090 for centrally controlling each of the above units, and the like.

The communication control device 2080 controls bidirectional communication to/from a host apparatus (for example, personal computer) via a network.

The printer control device 2090 includes a CPU, ROM storing programs written as codes decodable by the CPU and various kinds of data used for execution of the programs, RAM which is work memory, an AD conversion circuit for converting analog data into digital data, and the like. In response to requests given by the host apparatus, the printer control device 2090 controls each unit, and sends image information from the host apparatus to the optical scanning device 2010.

The photosensitive drum 2030*a*, the charging device 2032*a*, the developing roller 2033*a*, the toner cartridge 2034*a*, and the cleaning unit 2031*a* are used as a set, and constitute an image forming station (which may be hereinafter referred to as "K station" for the sake of convenience) for forming an image in black.

The photosensitive drum 2030*b*, the charging device 2032*b*, the developing roller 2033*b*, the toner cartridge 2034*b*, and the cleaning unit 2031*b* are used as a set, and constitute an image forming station (which may be hereinafter referred to as "C station" for the sake of convenience) for forming an image in cyan.

The photosensitive drum 2030*c*, the charging device 2032*c*, the developing roller 2033*c*, the toner cartridge 2034*c*, and the cleaning unit 2031*c* are used as a set, and constitute an image forming station (which may be hereinafter referred to as "M station" for the sake of convenience) for forming an image in magenta.

The photosensitive drum 2030*d*, the charging device 2032*d*, the developing roller 2033*d*, the toner cartridge 2034*d*, and cleaning unit 2031*d* are used as a set, and constitute an image forming station (which may be hereinafter referred to as "Y station" for the sake of convenience) for forming an image in yellow.

Each photosensitive drum is formed with a photosensitive layer on a surface thereof. More specifically, the surface of each of the photosensitive drums is a surface to be scanned. It should be noted that each photosensitive drum is rotated by a rotation mechanism, not illustrated, in an arrow direction within a plane in FIG. 1.

In this case, in an XYZ three-dimensional orthogonal coordinate system, a direction along the longitudinal direction of each photosensitive drum is defined as a Y axis direction, and a direction along which the four photosensitive drums are arranged is defined as an X axis direction in the explanation.

Each charging device uniformly charges the surface of each corresponding photosensitive drum.

The optical scanning device 2010 emits light beam, which is modulated for each color, onto the surface of the corresponding photosensitive drum which has been charged, on the basis of multi-color image information (black image information, cyan image information, magenta image information, yellow image information) given by the host apparatus. Accordingly, on the surface of each photosensitive drum, the charge is lost only in the portion where the light is emitted, and the latent image corresponding to the image information is formed on the surface of each photosensitive drum. The latent image formed here moves in the direction of the corresponding developing roller in accordance with the rotation of the photosensitive drum. The configuration of this optical scanning device 2010 will be explained later.

By the way, an area where image information is written on each photosensitive drum is called "effective scanning area", "image formed area", "effective image area", and the like.

The toner cartridge 2034*a* stores black toner, and the toner is provided to the developing roller 2033*a*. The toner cartridge 2034*b* stores cyan toner, and the toner is provided to the developing roller 2033*b*. The toner cartridge 2034*c* stores magenta toner, and the toner is provided to the developing roller 2033*c*. The toner cartridge 2034*d* stores yellow toner, and the toner is provided to the developing roller 2033*d*.

Toner given from the corresponding toner cartridge is uniformly applied onto the surface of each developing roller in a thin manner in accordance with the rotation. Then, when the toner applied to the surface of each developing roller comes into contact with the surface of the corresponding photosensitive drum, the toner moves to and attaches to only the portion of the surface on which the light is emitted. More specifically, each developing roller performs development by attaching toner to the latent image formed on the surface of the corresponding photosensitive drum. The image attached with the toner (toner image) moves in a direction of the transfer belt 2040 in accordance with the rotation of the photosensitive drum.

Each toner image of yellow, magenta, cyan, black is successively transferred onto the transfer belt 2040 with predetermined operational timing, and the toner images are overlaid, so that the color image is formed.

The paper feed tray 2060 stores recording sheets. In proximity to the paper feed tray 2060, the sheet feeding roller 2054 is provided. The sheet feeding roller 2054 retrieves each recording sheet from the paper feed tray 2060, and conveying the recording sheet to the pre-transfer roller pair 2056. The pre-transfer roller pair 2056 feeds, with predetermined timing, the recording sheet to a gap between the transfer belt 2040 and the transfer roller 2042. As a result, the color image on the transfer belt 2040 is transferred onto the recording sheet. The recording sheet transferred here is conveyed to the fixing roller 2050.

The fixing roller 2050 applies heat and pressure to the recording sheet, and this fixes the toner onto the recording sheet. The recording sheet on which the toner is fixed is conveyed via the discharging roller 2058 to the discharge tray 2070, and is successively stacked on the discharge tray 2070.

Each cleaning unit removes the toner remaining on the surface of the corresponding photosensitive drum (residual toner). The surface of the photosensitive drum from which the residual toner is removed returns back to the position facing the corresponding charging device again.

Figure 2:
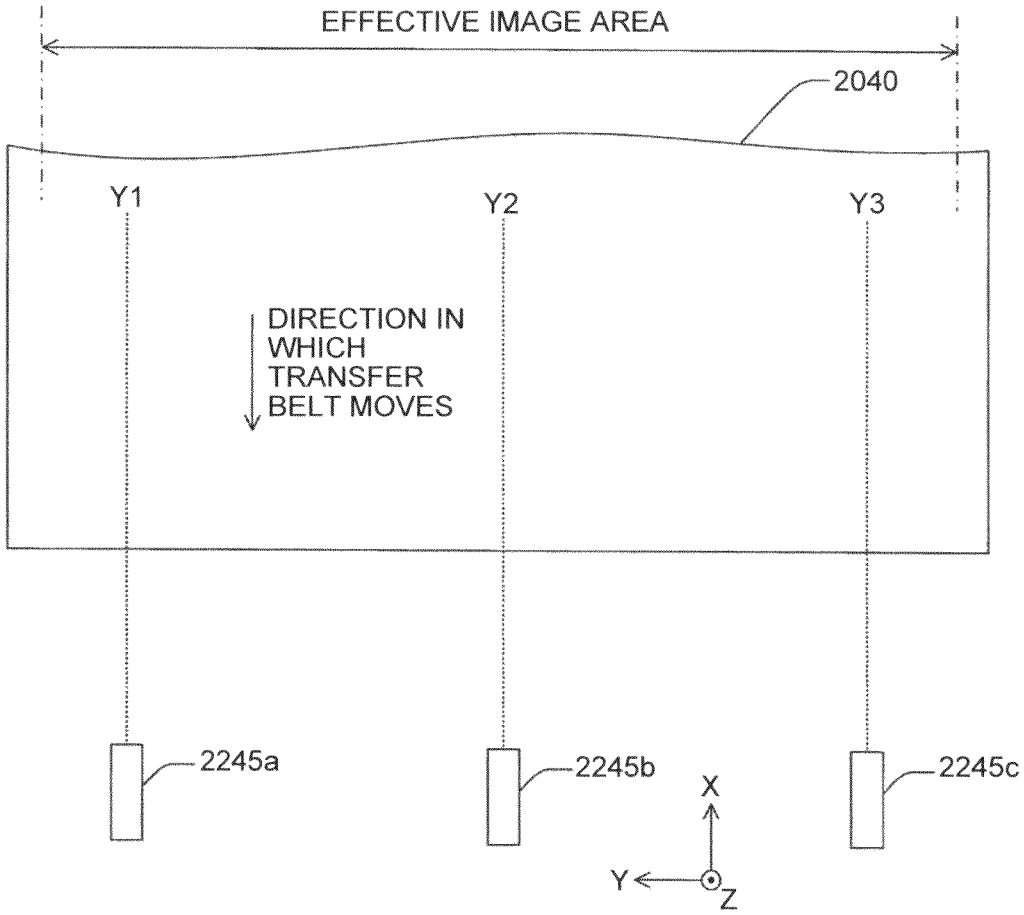
FIG. 2 is a figure for explaining the position of each optical sensor of a density detecting device of FIG. 1.

The density detecting device 2245 is arranged at the −X side of the transfer belt 2040. For example, as illustrated in FIG. 2, the density detecting device 2245 includes three optical sensors (2245*a*, 2245*b*, 2245*c*).

The optical sensor 2245*a* is provided at a position facing a position in proximity to +Y side end portion within the effective image area of the transfer belt 2040. The optical sensor 2245*c* is provided at a position facing a position in proximity to −Y side end portion within the effective image area of the transfer belt 2040. The optical sensor 2245*b* is provided substantially at the central position of the optical sensor 2245*a* and the optical sensor 2245*c* in the main-scanning direction. In this case, in the main-scanning direction (Y axis direction), the central position of the optical sensor 2245*a* is defined as Y1, the central position of the optical sensor 2245*b* is defined as Y2, and the central position of the optical sensor 2245*c* is defined as Y3.

Figure 3:
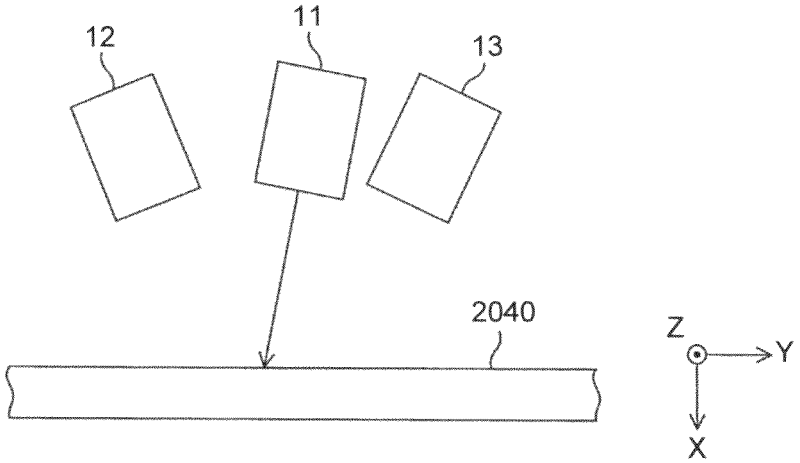
FIG. 3 is a figure for explaining a configuration of each optical sensor.

For example, as illustrated in FIG. 3, each optical sensor includes an LED 11 for emitting light (hereinafter referred to as "detection light") onto the transfer belt 2040, a regular reflection light receiving element 12 for receiving regular reflection light from a toner pad on the transfer belt 2040 or the transfer belt 2040, and a diffuse reflection light receiving element 13 for receiving diffuse reflection light from the toner pad on the transfer belt 2040 or the transfer belt 2040. Each receiving element outputs a signal in accordance with the quantity of received light (photoelectrically converted signal).

The home position sensor 2246*a* detects a home position of rotation of the photosensitive drum 2030*a*.

The home position sensor 2246*b* detects a home position of rotation of the photosensitive drum 2030*b*.

The home position sensor 2246*c* detects a home position of rotation of the photosensitive drum 2030*c*.

The home position sensor 2246*d* detects a home position of rotation of the photosensitive drum 2030*d*.

Subsequently, the configuration of the optical scanning device 2010 will be explained.

Figure 4:
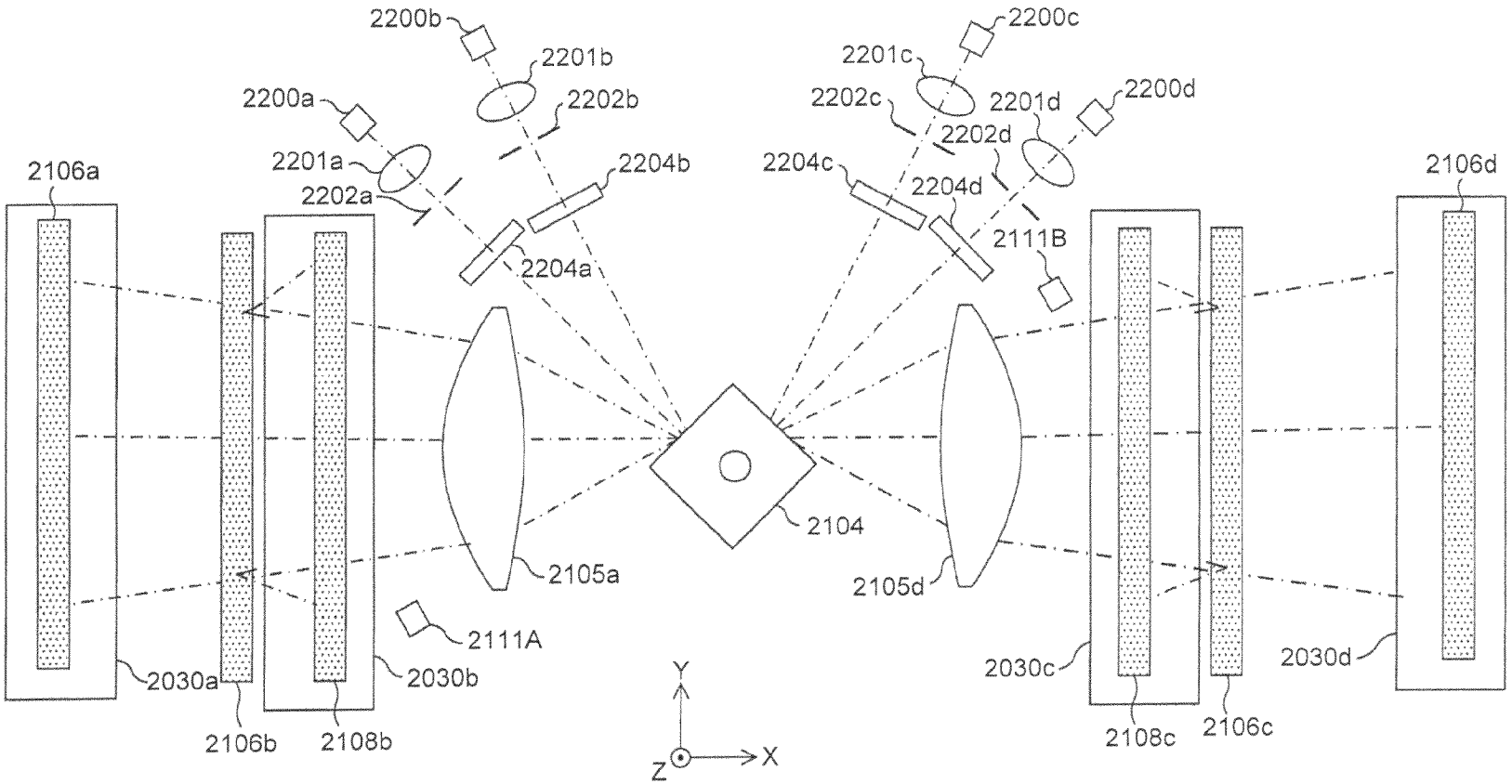
FIG. 4 is a figure for explaining the optical scanning device of FIG. 1 (part one)
Figure 5A:
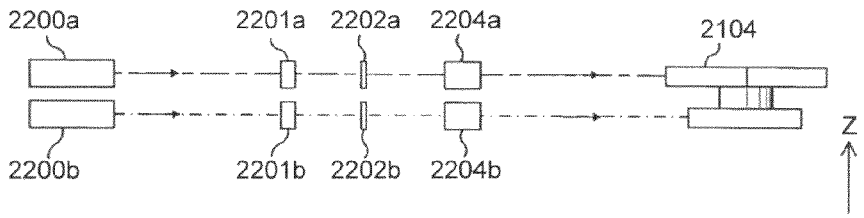
Figure 5B:
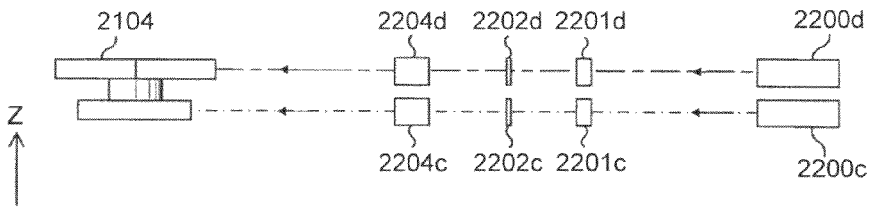
Figure 6:
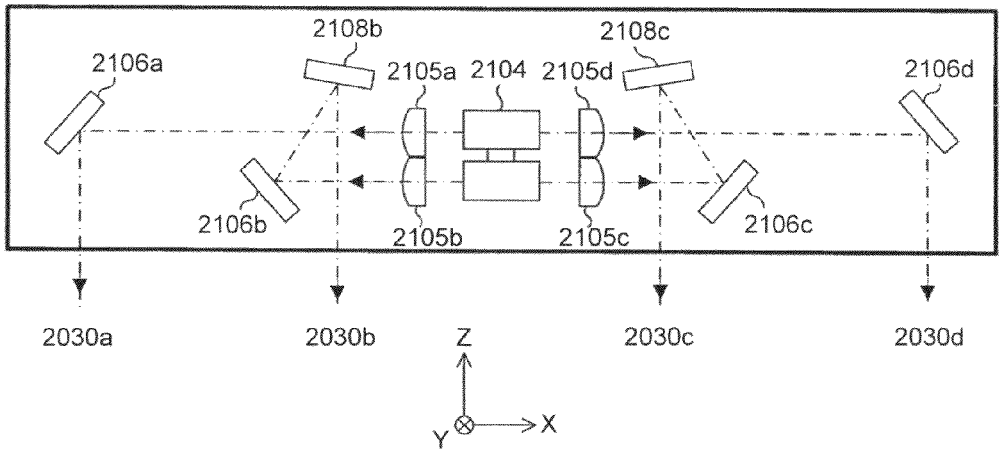
FIG. 6 is a figure for explaining the optical scanning device of FIG. 1 (part four)

For example, as illustrated in FIGS. 4 to 6, the optical scanning device 2010 includes four light sources (2200*a*, 2200*b*, 2200*c*, 2200*d*), four coupling lenses (2201*a*, 2201*b*, 2201*c*, 2201*d*), four aperture plates (2202*a*, 2202*b*, 2202*c*, 2202*d*), four cylindrical lenses (2204*a*, 2204*b*, 2204*c*, 2204*d*), a polygon mirror 2104, four scanning lenses (2105*a*, 2105*b*, 2105*c*, 2105*d*), six reflection mirrors (2106*a*, 2106*b*, 2106*c*, 2106*d*, 2108*b*, 2108*c*), a scanning control device 3022 (which is not illustrated in FIGS. 4 to 6, see FIG. 7), and the like. These are fixed to predetermined positions of an optical housing (not illustrated).

Each light source includes a surface-emitting laser array in which multiple light emitting units are arranged in a two-dimensional manner. Multiple light emitting units of the surface-emitting laser array are arranged such that, when all the light emitting units are caused to project light as orthographic projection onto a virtual line extending in the sub-scanning corresponding direction, the intervals of the light emitting units are the same interval. In this specification, "the interval of the light emitting units" means a distance between the centers of the two light emitting units.

The coupling lens 2201*a* is arranged on an optical path of light beam emitted from the light source 2200*a*, so that the light beam is made into substantially parallel light beam.

The coupling lens 2201*b* is arranged on an optical path of light beam emitted from the light source 2200*b*, so that the light beam is made into substantially parallel light beam.

The coupling lens 2201*c* is arranged on an optical path of light beam emitted from the light source 2200*c*, so that the light beam is made into substantially parallel light beam.

The coupling lens 2201*d* is arranged on an optical path of light beam emitted from the light source 2200*d*, so that the light beam is made into substantially parallel light beam.

The aperture plate 2202*a* has an aperture portion and shapes the light beam provided from the coupling lens 2201*a*.

The aperture plate 2202*b* has an aperture portion and shapes the light beam provided from the coupling lens 2201*b*.

The aperture plate 2202*c* has an aperture portion and shapes the light beam provided from the coupling lens 2201*c*.

The aperture plate 2202*d* has an aperture portion and shapes the light beam provided from the coupling lens 2201*d*.

The cylindrical lens 2204*a* causes the light beam having passed through the aperture portion of the aperture plate 2202*a* to form an image in the Z axis direction in proximity to the deflecting reflective surface of the polygon mirror 2104.

The cylindrical lens 2204*b* causes the light beam having passed through the aperture portion of the aperture plate 2202*b* to form an image in the Z axis direction in proximity to the deflecting reflective surface of the polygon mirror 2104.

The cylindrical lens 2204*c* causes the light beam having passed through the aperture portion of the aperture plate 2202*c* to form an image in the Z axis direction in proximity to the deflecting reflective surface of the polygon mirror 2104.

The cylindrical lens 2204*d* causes the light beam having passed through the aperture portion of the aperture plate 2202*d* to form an image in the Z axis direction in proximity to the deflecting reflective surface of the polygon mirror 2104.

An optical system including a coupling lens 2201*a*, an aperture plate 2202*a*, and a cylindrical lens 2204*a* is a pre-deflecting device optical system of the K station.

An optical system including a coupling lens 2201*b*, an aperture plate 2202*b*, and a cylindrical lens 2204*b* is a pre-deflecting device optical system of the C station.

An optical system including a coupling lens 2201*c*, an aperture plate 2202*c*, and a cylindrical lens 2204*c* is a pre-deflecting device optical system of the M station.

An optical system including a coupling lens 2201*d*, an aperture plate 2202*d*, and a cylindrical lens 2204*d* is a pre-deflecting device optical system of the Y station.

The polygon mirror 2104 has four-surface mirrors having two stage structure rotating about an axis in parallel to the Z axis, and each mirror serves as a deflecting reflective surface. The arrangement is such that in the four-surface mirrors of the first stage (lower stage), each of the light beam from the cylindrical lens 2204*b* and the light beam from the cylindrical lens 2204*c* is deflected, and in the four-surface mirrors of the second stage (upper stage), each of the light beam from the cylindrical lens 2204*a* and the light beam from the cylindrical lens 2204*d* is deflected.

Each light beam from the cylindrical lens 2204*a* and the cylindrical lens 2204*b* is deflected in −X side of the polygon mirror 2104, and each light beam from the cylindrical lens 2204*c* and the cylindrical lens 2204*d* is deflected to +X side of the polygon mirror 2104.

Each scanning lens has optical power for condensing the light beam to the proximity of the corresponding photosensitive drum and optical power for moving the light spot on the surface of the corresponding photosensitive drum in the main-scanning direction with a constant speed in accordance with the rotation of the polygon mirror 2104.

The scanning lens 2105*a* and the scanning lens 2105*b* are provided at −X side of the polygon mirror 2104, and the scanning lens 2105*c* and the scanning lens 2105*d* are provided at +X side of the polygon mirror 2104.

Then, the scanning lens 2105*a* and the scanning lens 2105*b* are stacked in the Z axis direction, and the scanning lens 2105*b* faces the four-surface mirror of the first stage, and the scanning lens 2105*a* faces the four-surface mirror in the second stage. The scanning lens 2105*c* and the scanning lens 2105*d* are stacked in the Z axis direction, and the scanning lens 2105*c* faces the four-surface mirror of the first stage, and the scanning lens 2105*d* faces the four-surface mirror in the second stage.

The light beam from the cylindrical lens 2204*a* deflected by the polygon mirror 2104 is transmitted to the photosensitive drum 2030*a* via the scanning lens 2105*a* and reflection mirror 2106*a*, so that the light spot is formed. The light spot formed moves in the longitudinal direction of the photosensitive drum 2030*a* along with the rotation of the polygon mirror 2104. More specifically, it scans the photosensitive drum 2030*a*. At this occasion, the direction in which the light spot moves is the "main-scanning direction" of the photosensitive drum 2030*a*, and the direction in which the photosensitive drum 2030*a* rotates is the "sub-scanning direction" of the photosensitive drum 2030*a*.

The light beam from the cylindrical lens 2204*b* deflected by the polygon mirror 2104 is transmitted to the photosensitive drum 2030*b* via the scanning lens 2105*b*, the reflection mirror 2106*b*, and the reflection mirror 2108*b*, so that the light spot is formed. The light spot moves in the longitudinal direction of the photosensitive drum 2030*b* along with the rotation of the polygon mirror 2104. More specifically, it scans the photosensitive drum 2030*b*. At this occasion, the direction in which the light spot moves is the "main-scanning direction" of the photosensitive drum 2030*b*, and the direction in which the photosensitive drum 2030*b* rotates is the "sub-scanning direction" of the photosensitive drum 2030*b*.

The light beam from the cylindrical lens 2204*c* deflected by the polygon mirror 2104 is transmitted to the photosensitive drum 2030*c* via the scanning lens 2105*c*, the reflection mirror 2106*c*, and the reflection mirror 2108*c*, so that the light spot is formed. The light spot moves in the longitudinal direction of the photosensitive drum 2030*c* along with the rotation of the polygon mirror 2104. More specifically, it scans the photosensitive drum 2030*c*. At this occasion, the direction in which the light spot moves is the "main-scanning direction" of the photosensitive drum 2030*c*, and the direction in which the photosensitive drum 2030*c* rotates is the "sub-scanning direction" of the photosensitive drum 2030*c*.

The light beam from the cylindrical lens 2204*d* deflected by the polygon mirror 2104 is transmitted to the photosensitive drum 2030*d* via the scanning lens 2105*d* and the reflection mirror 2106*d*, so that the light spot is formed. The light spot moves in the longitudinal direction of the photosensitive drum 2030*d* along with the rotation of the polygon mirror 2104. More specifically, it scans the photosensitive drum 2030*d*. At this occasion, the direction in which the light spot moves is the "main-scanning direction" of the photosensitive drum 2030*d*, and the direction in which the photosensitive drum 2030*d* rotates is the "sub-scanning direction" of the photosensitive drum 2030*d*.

Each reflection mirror has the same optical path length from the polygon mirror 2104 to the photosensitive drum, and is arranged such that the incidence position and the incidence angle of the light beam at each photosensitive drum becomes the same.

The optical system arranged on the optical path between the polygon mirror 2104 and each photosensitive drum is also called a scanning optical system. In this case, the scanning optical system of the K station is constituted by the scanning lens 2105*a* and the reflection mirror 2106*a*. The scanning optical system of the C station is constituted by the scanning lens 2105*b* and two reflection mirrors (2106*b*, 2108*b*). The scanning optical system of the M station is constituted by the scanning lens 2105*c* and two reflection mirrors (2106*c*, 2108*c*). Further, the scanning optical system of the Y station is constituted by the scanning lens 2105*d* and the reflection mirror 2106*d*. In each scanning optical system, the scanning lens may include multiple lenses.

Since the polygon mirror 2104 rotates in the same direction, the light spots move in the direction opposite to each other in the photosensitive drum at −X side of the polygon mirror 2104 and the photosensitive drum at +X side of the polygon mirror 2104, and the latent image is formed such that, in the Y axis direction, the write start position of the photosensitive drum at one side is the same as the write end position of the photosensitive drum at the other side.

Some of the light beam via the scanning lens 2105*a* of the K station before the writing is started is received by a leading end synchronization detection sensor 2111A (see FIG. 4).

Some of the light beam via the scanning lens 2105*d* of the Y station before the writing is started is received by a leading end synchronization detection sensor 2111B (see FIG. 4).

Each leading end synchronization detection sensor outputs a signal according to the quantity of received light to the scanning control device 3022. It should be noted that the output signal of each leading end synchronization detection sensor is also referred to as "leading end synchronization signal".

Figure 7:
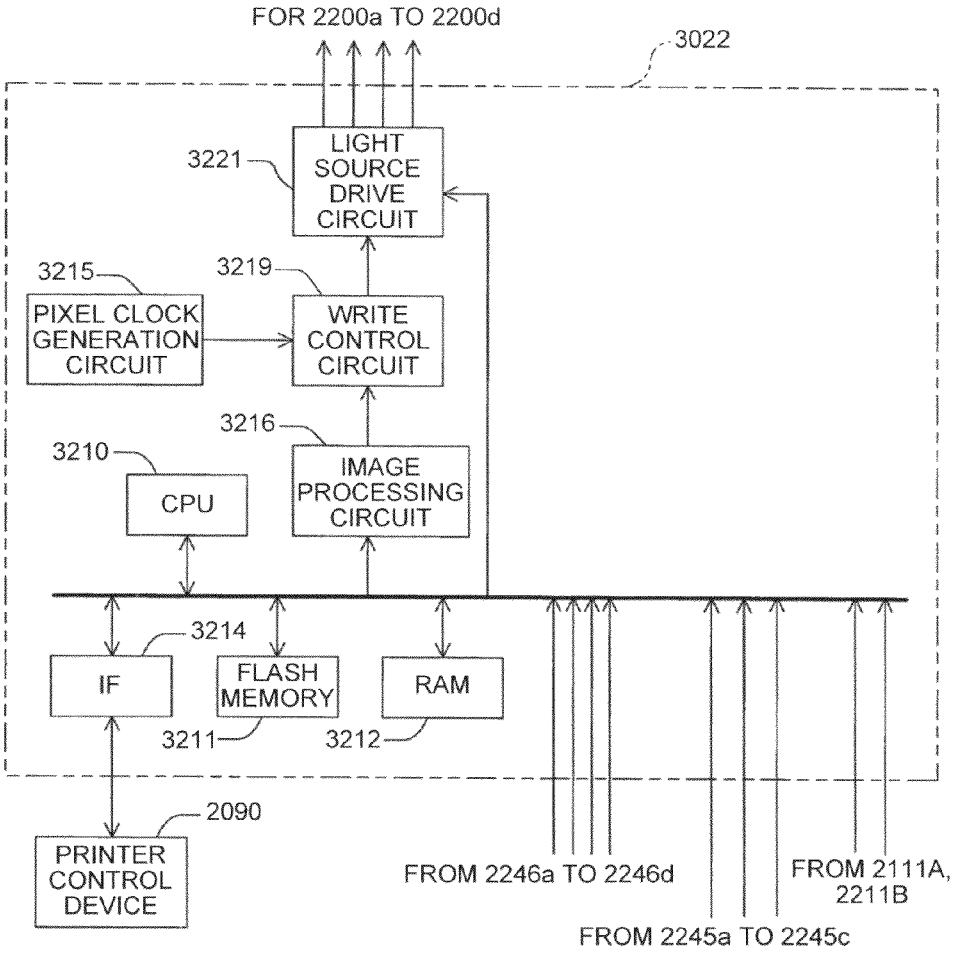
FIG. 7 is a block diagram illustrating a configuration of a scanning control device according to the first embodiment.

For example, as illustrated in FIG. 7, the scanning control device 3022 includes a CPU 3210, a flash memory 3211, a RAM 3212, an IF (interface) 3214, a pixel clock generation circuit 3215, an image processing circuit 3216, a write control circuit 3219, a light source drive circuit 3221, and the like. An arrow in FIG. 7 represents a flow of information or a typical signal. The arrows do not represent all the connection relationships of the blocks.

The pixel clock generation circuit 3215 generates a pixel clock signal. The pixel clock signal can be phase-modulated with a resolution of ⅛ clock.

After the CPU 3210 performs predetermined halftone processing on image data extracted into raster format for each color, the image processing circuit 3216 generates dot data for the light emitting unit of each light source.

For each station, the write control circuit 3219 obtains operational timing at which writing is started on the basis of the leading end synchronization signal. Then, in accordance with the operational timing at which writing is started, the dot data of each light emitting unit are overlaid on the pixel clock signals given by the pixel clock generation circuit 3215, and modulated data which are independent for each light emitting unit are generated. The write control circuit 3219 carries out APC (Auto Power Control) for each of predetermined operational timing.

The light source drive circuit 3221 outputs a drive signal of each light emitting unit to each light source in accordance with each piece of modulated data given by the write control circuit 3219.

The IF (interface) 3214 is a communication interface for controlling bidirectional communication with the printer control device 2090.

The flash memory 3211 stores various kinds of programs written as codes decodable by the CPU 3210 and various kinds of data used for execution of the programs.

The RAM 3212 is work memory.

The CPU 3210 operates in accordance with programs stored in the flash memory 3211, and controls the entire optical scanning device 2010.

By the way, undesired density change occurs in the output image in the sub-scanning direction due to eccentricity, error in the shape, and the like of the photosensitive drum and developing roller (see FIGS. 8A to 10). This density change includes density change component due to the photosensitive drum and density change component due to the developing roller (see FIG. 9 and FIG. 10).

Accordingly, the CPU 3210 performs "light quantity correction information obtaining processing" for suppressing undesired density change with predetermined operational timing.

The predetermined operational timing is as follows. When the power is turned on, the light quantity correction information obtaining processing is performed in the following cases: (1) the time for which the photosensitive drum is at a stop time is six hours or more; (2) the temperature in the apparatus changes by 10 degrees Celsius or more; and (3) when the relatively humidity in the apparatus changes by 50% or more. During printing, the light quantity correction information obtaining processing is performed in the following cases: (4) the number of sheets printed reaches a predetermined number; (5) the number of times the developing roller rotates reaches a predetermined number of times, and (6) the distance the transfer belt has moved reaches a predetermined distance.

Hereinafter, the light quantity correction information obtaining processing will be explained with reference to FIG. 11. The flowchart of FIG. 11 corresponds to a series of processing algorithm executed by the CPU 3210 during the light quantity correction information obtaining processing. The light quantity correction information obtaining processing is executed by every station, and each station executes it in the same manner. Therefore, the light quantity correction information obtaining processing executed in the K station will be explained as an example.

Figure 12:
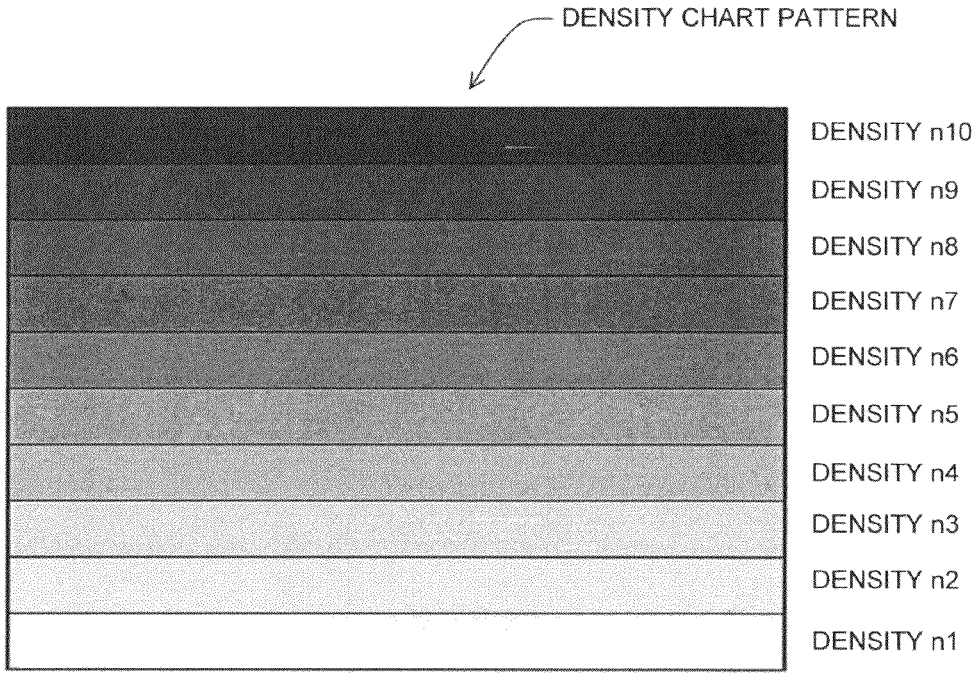
FIG. 12 is a figure for explaining a density chart pattern.
Figure 13:
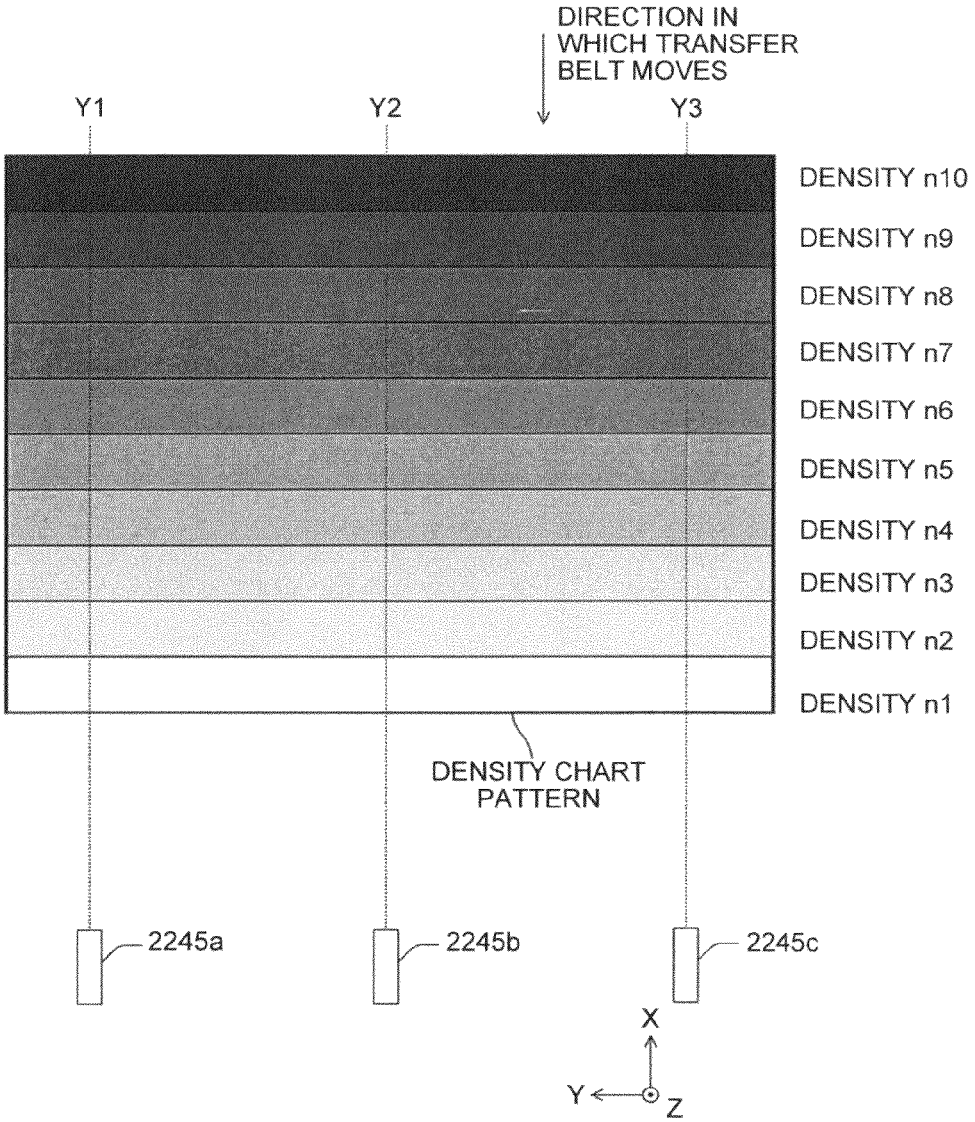
FIG. 13 is a figure for explaining arrangement of the density chart pattern and each optical sensor.
Figure 14:
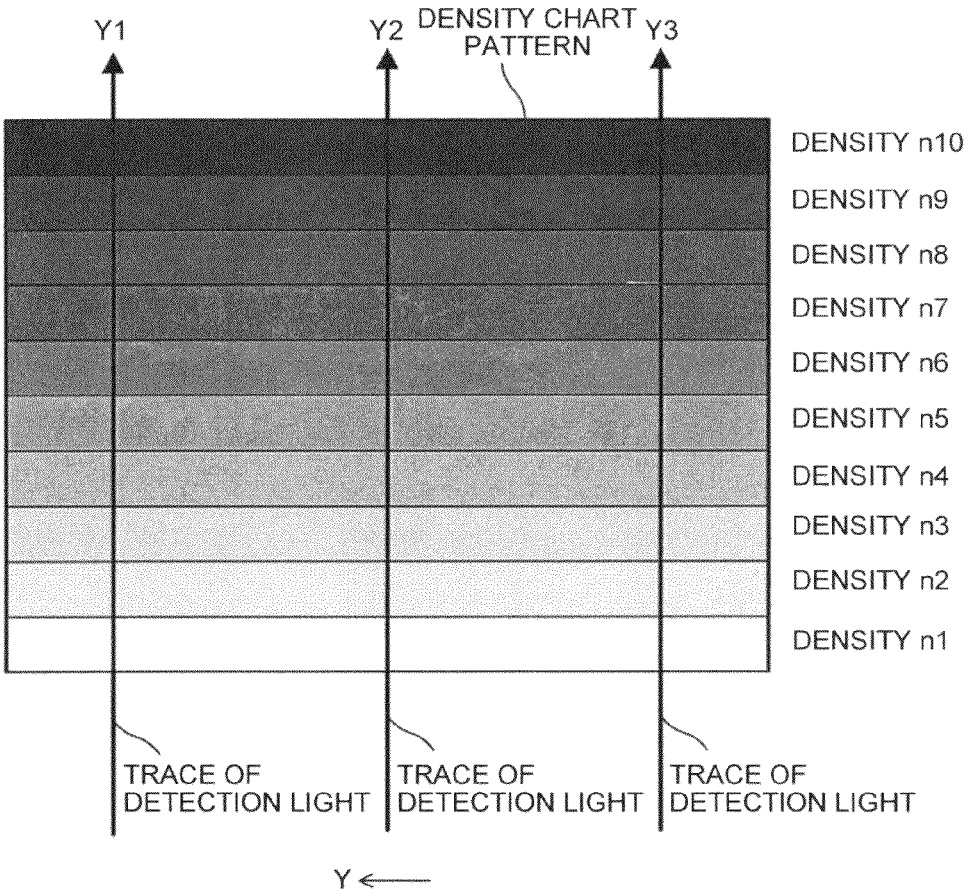
FIG. 14 is a figure for explaining a locus of detection light emitted from each optical sensor in the light quantity correction information obtaining processing.
Figure 15A:
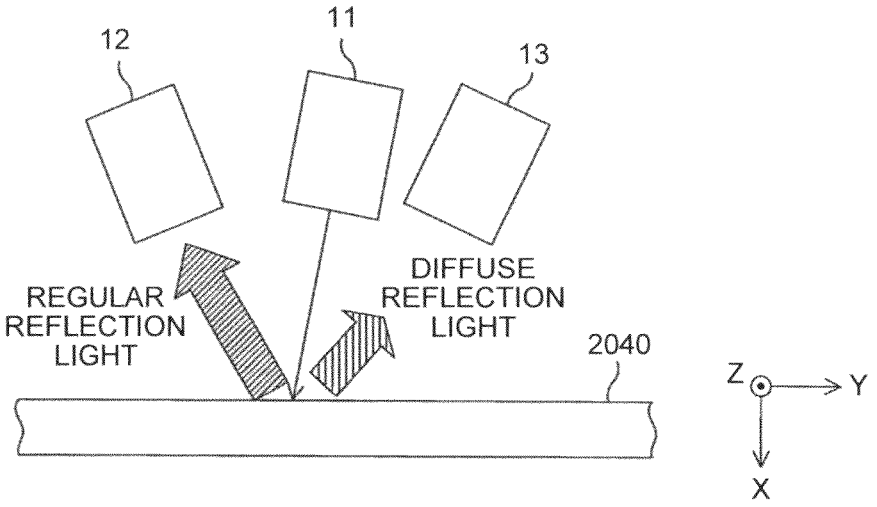
FIG. 15A is a figure for explaining regular reflection light and diffuse reflection light when the illumination target object of the detection light is a transfer belt.
Figure 15B:
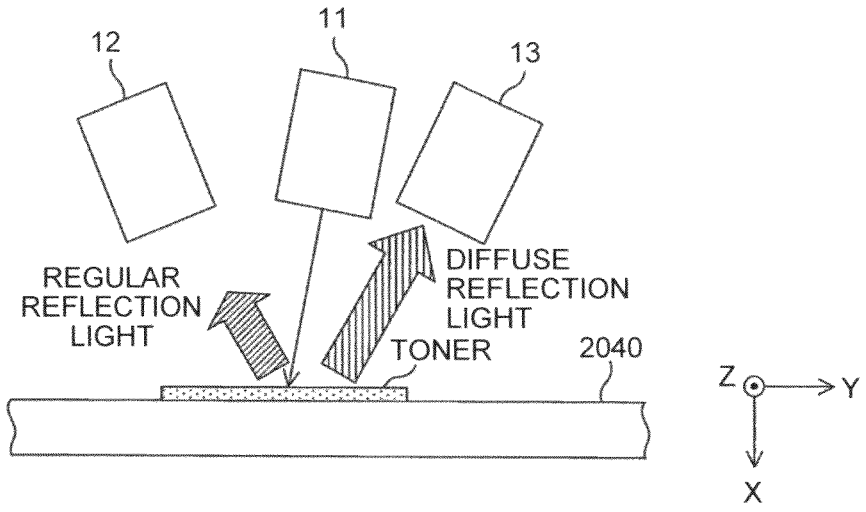
FIG. 15B is a figure for explaining regular reflection light and diffuse reflection light when the illumination target object of the detection light is a toner pattern.

In the first step S11, for example, as illustrated in FIG. 12, a density chart pattern having multiple areas of which toner densities are different from each other with regard to black is formed in such a manner that, for example, as illustrated in FIG. 13, the central position is Y2 with regard to the Y axis direction.

In this case, for example, the density chart pattern includes ten types of density (n1 to n10) areas. The density n1 is the lowest density. The density n10 is the highest density. More specifically, the density gradually increases from the density n1 to the density n10. When the density chart pattern is formed, the ratio of image in each area is constant, and the light emitting unit emits light for the same cycle of time regardless of the density, and only the light emission power is changed so as to change the density. In this case, the light emission power corresponding to the density n1 is p1, the light emission power corresponding to the density n2 is p2, . . . , and the light emission power corresponding to the density n10 is p10.

In the subsequent step S12, the LED 11 of each optical sensor is turned on. The light emitted by the LED 11 (hereinafter referred to as "detection light") successively illuminates the area of the density n1 to the area of the density n10 in the density chart pattern as the transfer belt 2040 rotates, i.e., as the time passes (see FIG. 14).

Then, the output signals of the regular reflection light receiving element 12 and the diffuse reflection light receiving element 13 are obtained.

By the way, when the toner is not attached to the transfer belt 2040, the detection light reflected by the transfer belt 2040 includes more regular reflection light component than diffuse reflection light component. Accordingly, much light is incident upon the regular reflection light receiving element 12, hardly any light is incident upon the diffuse reflection light receiving element 13 (see FIG. 15A).

On the other hand, the regular reflection light component decreases and the diffuse reflection light component increases when the toner is attached to the transfer belt 2040 than when the toner is not attached. Accordingly, the light incident upon the regular reflection light receiving element 12 decreases, and the light incident upon the diffuse reflection light receiving element 13 increases (see FIG. 15B).

More specifically, in accordance with the output levels of the regular reflection light receiving element 12 and the diffuse reflection light receiving element 13, the toner density attached to the transfer belt 2040 can be detected.

In the subsequent step S13, for each density in the density chart pattern, the density of the toner is calculated and obtained from the two sensor signals of the regular reflection light receiving element 12 and the diffuse reflection light receiving element 13.

Figure 16:
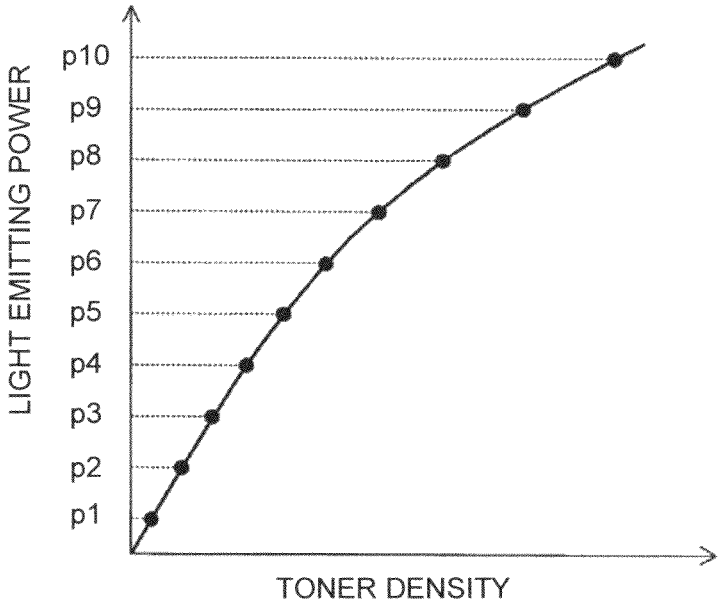
FIG. 16 is a figure for explaining relationship between light emission power and toner density.
Figure 17:
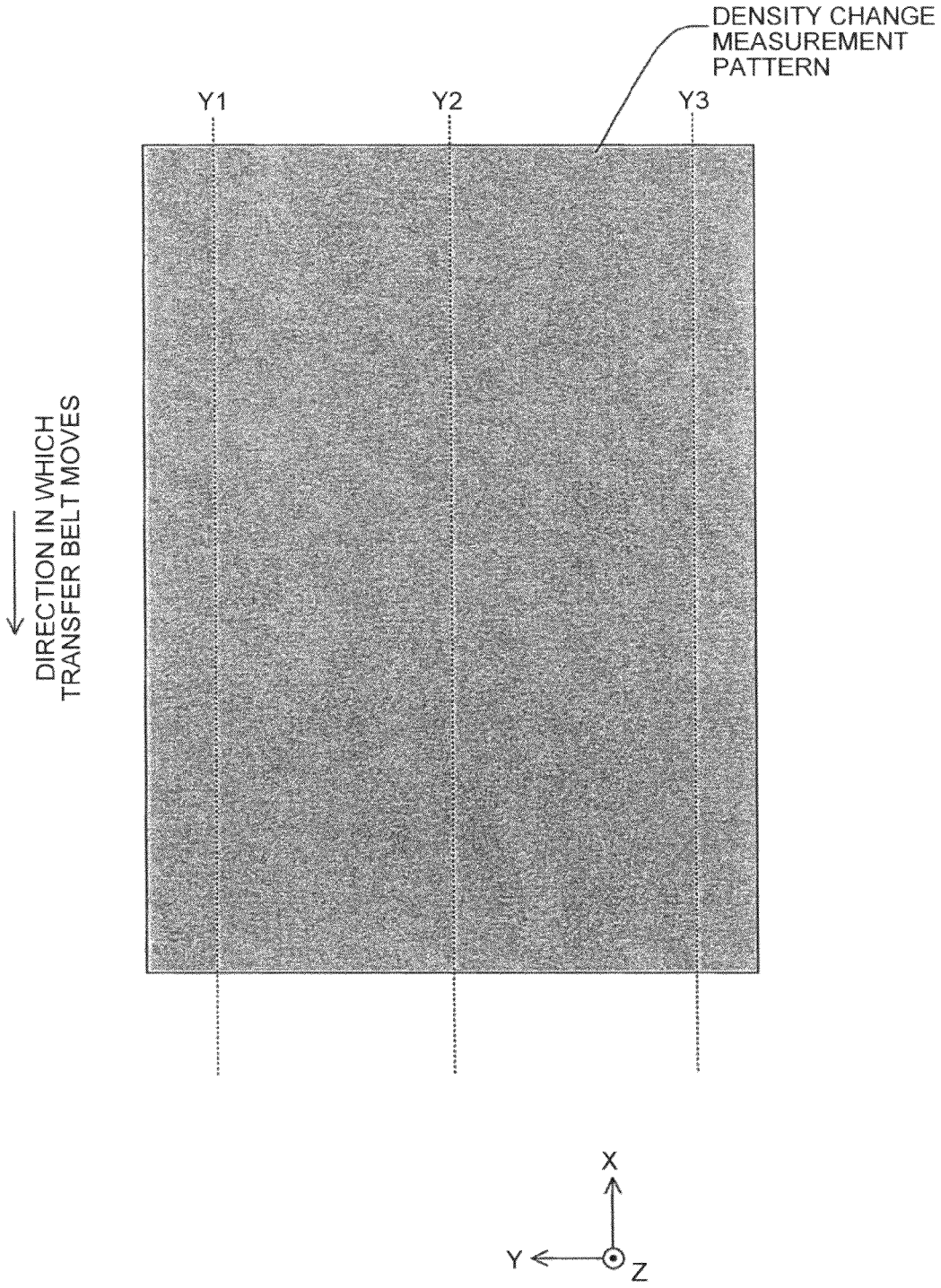
FIG. 17 is a figure for explaining a density change measurement pattern.
Figure 18:
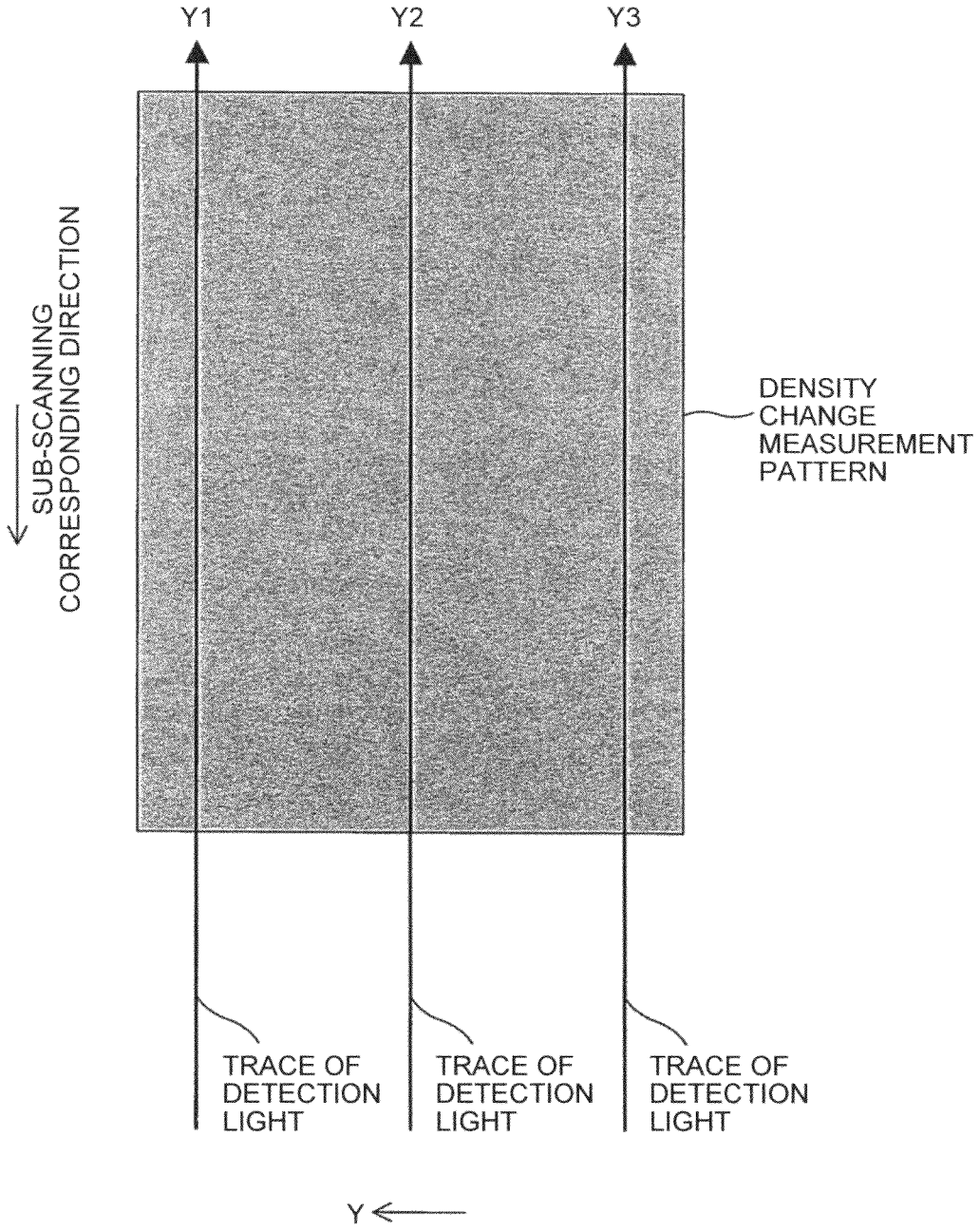
FIG. 18 is a figure for explaining a locus of detection light emitted from each optical sensor for the density change measurement pattern.

Then, correlation between the density of the toner and the light emission power (see FIG. 16). In this case, the correlation is approximated by a polynomial expression, and the polynomial expression is stored to the flash memory 3211.

In the subsequent step S14, the density change measurement pattern is formed on the transfer belt 2040. In this case, an image in black having the same image size ratio as the above density pattern is formed in the "A3" size in the portrait orientation as the density change measurement pattern (see FIG. 17).

In the subsequent step S15, the LED 11 of each optical sensor is turned on. The light from each LED 11 illuminates the density change measurement pattern in the sub-scanning corresponding direction as the transfer belt 2040 rotates, i.e., as the time passes (see FIG. 18).

Figure 19:
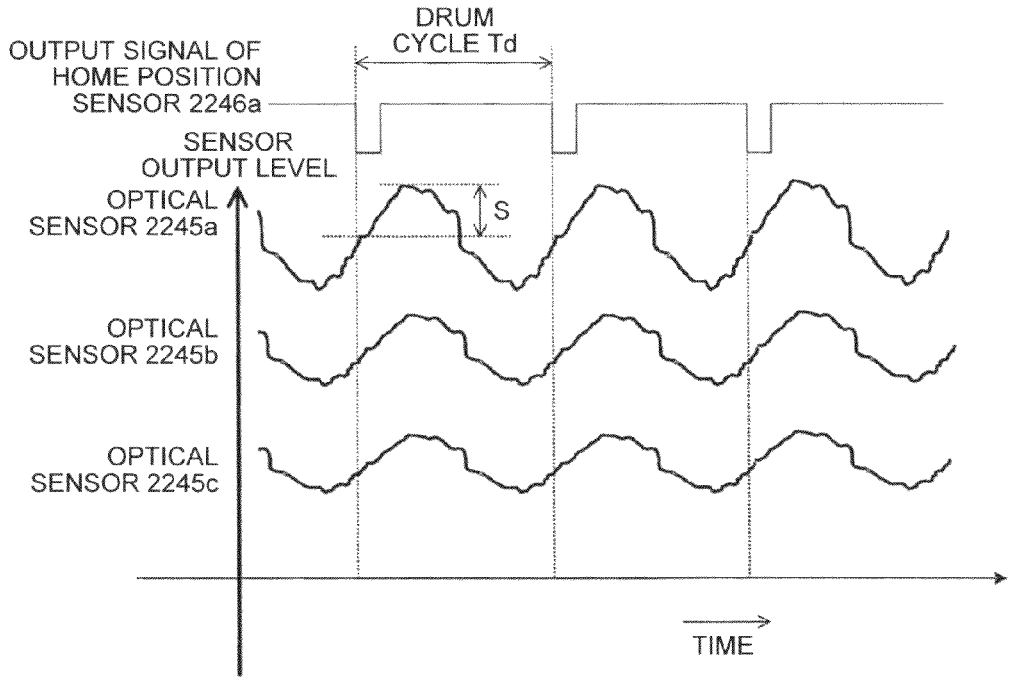
FIG. 19 is a timing chart illustrating an output level of each optical sensor for the density change measurement pattern.

Then, the output signals of the regular reflection light receiving element 12 and the diffuse reflection light receiving element 13 are obtained for each optical sensor with a predetermined time interval, and the toner density is calculated from the sensor output signal (see FIG. 19). FIG. 19 also illustrates the output signal of the home position sensor 2246*a*. The cycle of the photosensitive drum 2030*a* (drum rotation cycle Td) is obtained from the output signal of the home position sensor 2246*a*. As can be understood from FIG. 19, the toner density calculated from the sensor output signal of the each optical sensor periodically changes at substantially the same cycle as the cycle of the output signal of the home position sensor 2246*a* (drum rotation cycle Td).

Figure 20:
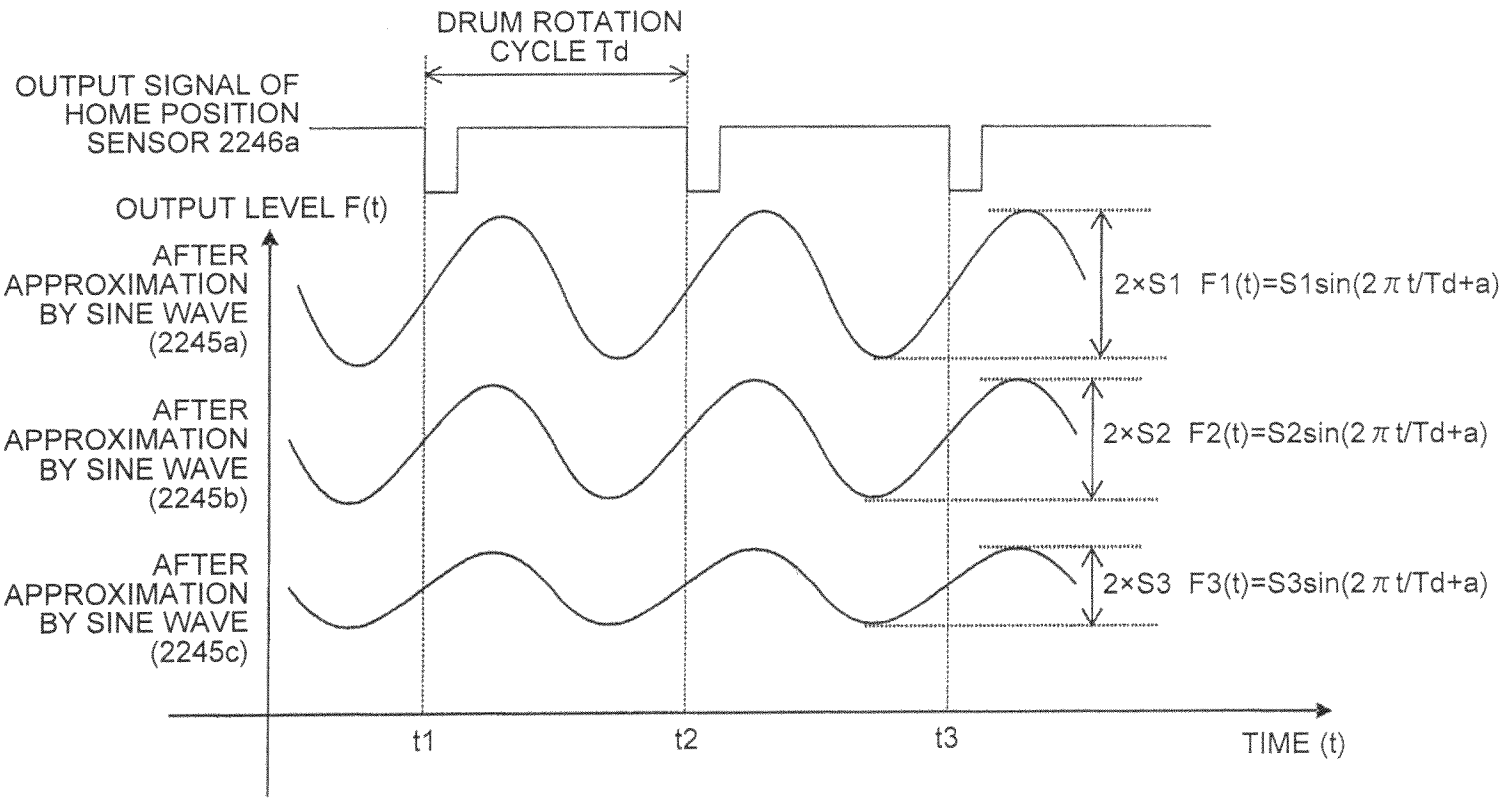
FIG. 20 is a timing chart illustrating a state where periodical density change obtained from an output level of each optical sensor is approximated by a sine wave.

In the subsequent step S16, on the basis of the output signal of the home position sensor 2246*a*, the periodical change of the toner density obtained from each sensor output, i.e., the change of toner density in the sub-scanning direction at three positions Y1, Y2, Y3 in the main-scanning direction (hereinafter referred to as the periodical density change) is extracted as a sine wave having the same cycle as the cycle of the output signal of the home position sensor 2246*a*. More specifically, sine wave approximation is performed (made into periodic function) (see FIG. 20). In this case, the toner densities detected by the optical sensors 2245*a*, 2245*b*, 2245*c* are approximated by the following expressions (1) to (3), respectively, assuming there is no phase difference. FIG. 20 illustrates a case where, for example, S1>S2>S3 holds.

$$F1(t)=S1\sin(2\pi t/Td+a) \quad (1)$$

$$F2(t)=S2\sin(2\pi t/Td+a) \quad (2)$$

$$F3(t)=S3\sin(2\pi t/Td+a) \quad (3)$$

Figure 21:
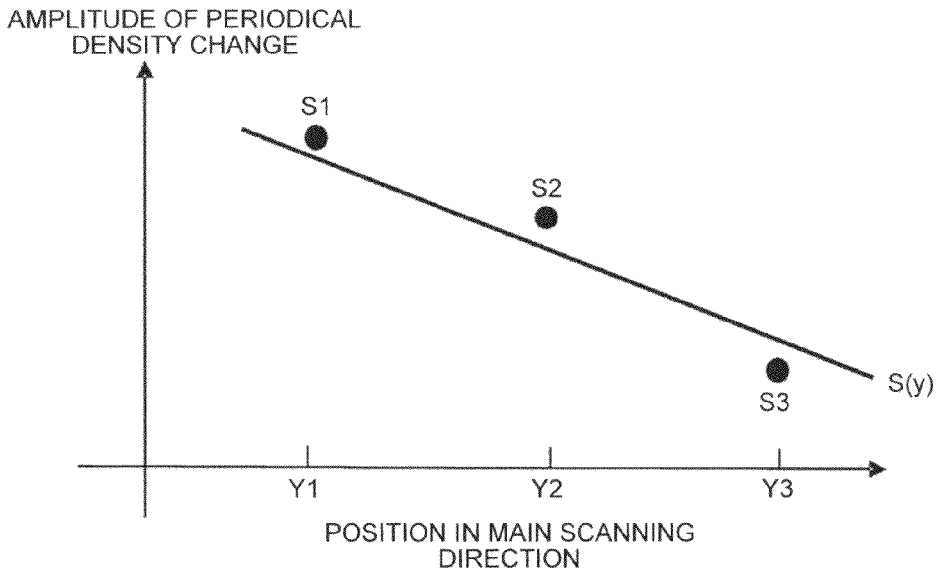
FIG. 21 is a graph illustrating an amplitude of periodical density change of the density change measurement pattern at each position in the main-scanning direction (linear function approximation)

In the subsequent step S17, the amplitude of the periodical density change of each position of the density change measurement pattern which are arranged in the main-scanning direction is obtained on the basis of the output of each optical sensor in the main-scanning direction and the above expressions (1) to (3) which are sine wave approximation expressions of the toner densities. In this case, for example, as illustrated in FIG. 21, the amplitude of the periodical density change of each position of the density change measurement pattern which are arranged in the main-scanning direction is obtained by approximating with a linear function S (y) obtained on the basis of the amplitudes S1, S2, S3 of the periodical density changes at the three positions Y1, Y2, Y3 in the main-scanning direction (linear approximation). It should be noted that y is a position in the main-scanning direction.

In the subsequent step S18, a relational expression of light quantity correction for the density change measurement pattern, as shown in the following expression (4), is derived from the above expressions (1) to (3) and the approximation expression S(y) of the amplitude, and is stored.

$$F(t,y)=S(y)\sin(2\pi t/Td+a) \quad (4)$$

In the subsequent step S19, on the basis of the relationship between the toner density and the light emission power as illustrated in FIG. 16 and the above expression (4), a light quantity correction pattern at each position in the main-scanning direction is generated (see FIGS. 22 and 23), and at least a portion thereof is stored to the flash memory 3211. More specifically, multiple light quantity correction patterns are individually generated in association with multiple positions in the main-scanning direction, and are stored.

Figure 23:
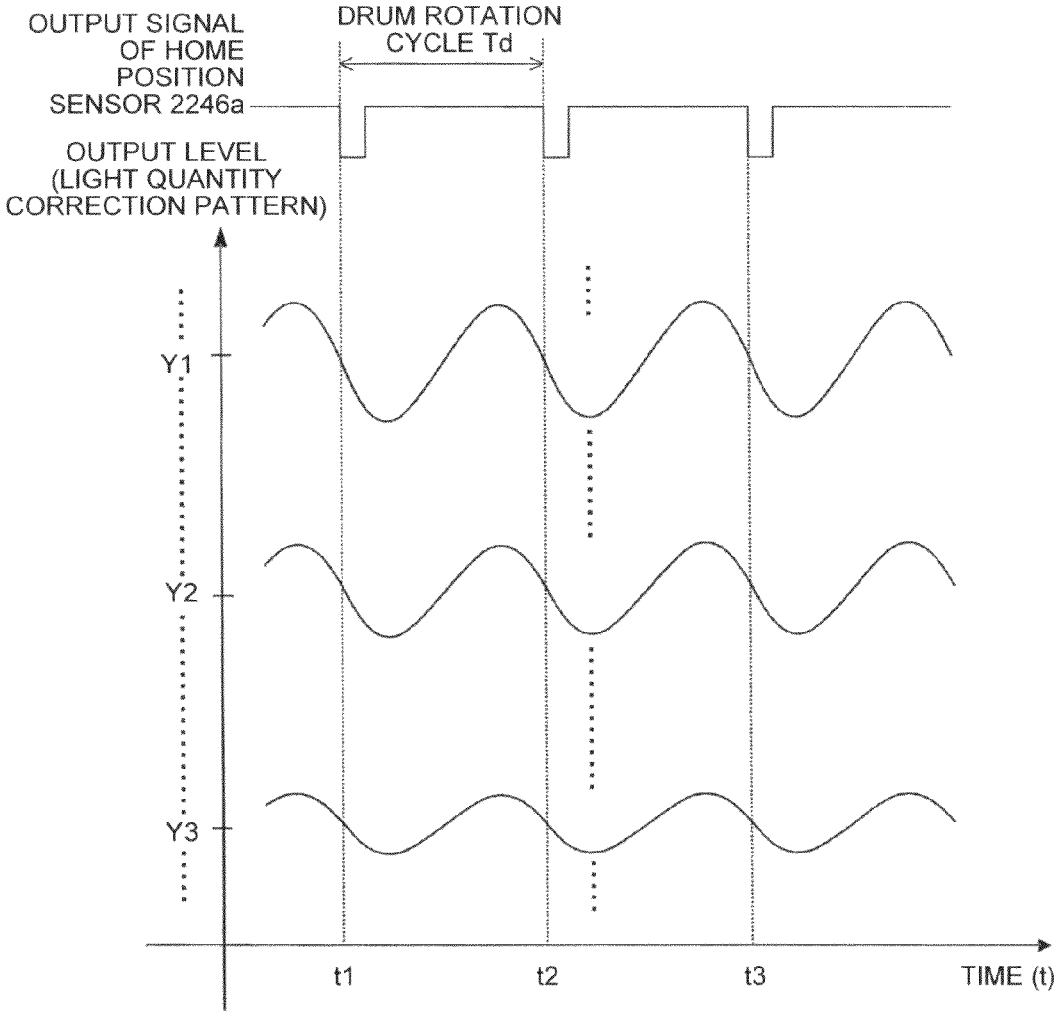
FIG. 23 is a timing chart illustrating the light quantity correction pattern of FIG. 22.

In this case, for example, as illustrated in FIG. 23, the light quantity correction pattern is generated as a sine wave having a phase opposite to (having a phase which is different by n from) the periodical density change which has been approximated as the sine wave in which the drum rotation cycle π is the cycle. More specifically, each light quantity correction pattern is generated such that the light quantity for a portion where the toner density is high is reduced, and the light quantity for a portion where the toner density is low is increased.

For this reason, when only the data for one cycle of light quantity correction pattern at each position in the main-scanning direction (which may be hereinafter referred to as light quantity correction data) are stored when stored to the flash memory 3211, the light quantity correction pattern can be reproduced by combining the data or reading the data in chronological order. As a result, the quantity of stored data can be reduced, and in addition, data write speed and read speed can be improved.

Then, when the CPU 3210 forms an image on the recording sheet with the above process, the drive signal can be corrected by superimposing the light quantity correction pattern corresponding to the position on the drive signal according to the modulated data corresponding to each position in the main-scanning direction. More specifically, the light emission powers of multiple light emitting units of the light sources are adjusted so as to suppress the periodical density change at each position in the main-scanning direction.

Subsequently, the CPU 3210 drives each light emitting unit so as to suppress the density change of the entire output image, i.e., the periodical density change of the output image at each position in the main-scanning direction on the basis of the output signals of the leading end synchronization detection sensor and the home position sensor. The light emitting unit is driven in the same manner in each station. Accordingly, the K station will be hereinafter explained as an example.

The CPU 3210 obtains write operational timing at each position in the main-scanning direction on the basis of the output signal of the leading end synchronization detection sensor 2111A, and drives the light sources using the light quantity correction pattern corresponding to the position with the write operational timing. At this occasion, adjustment is made so that the phase of light quantity correction pattern becomes opposite to the phase of the corresponding periodical density change on the basis of the output signal from the home position sensor 2246*a*.

Figure 24:
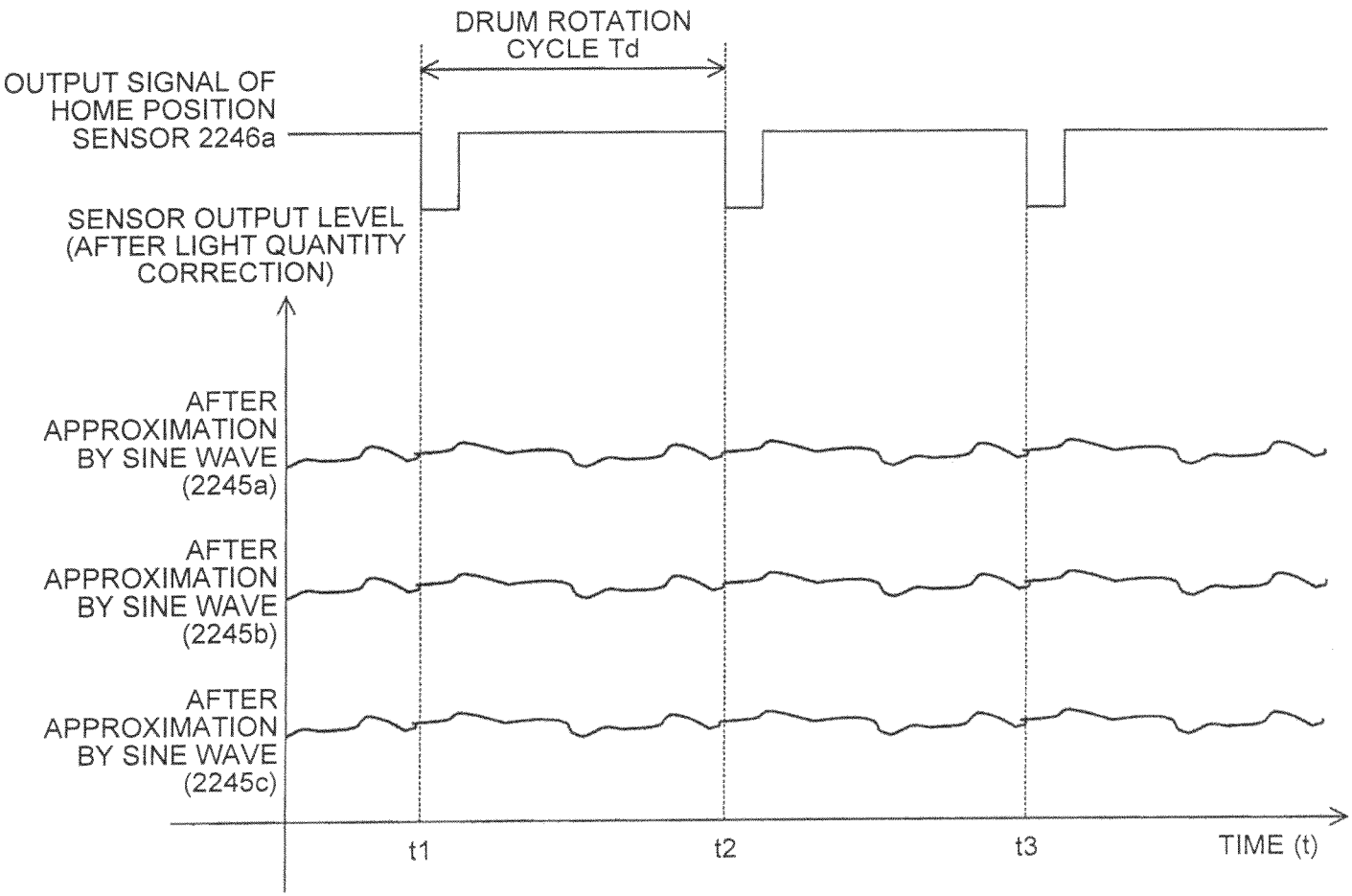
FIG. 24 is a timing chart illustrating the output level of each optical sensor for an output image formed with light from a light source of which light quantity has been corrected using the light quantity correction pattern of FIG. 22.

FIG. 24 illustrates the output level of each optical sensor for an output image formed with light from a light source of which light quantity has been corrected using the light quantity correction pattern. As can be understood from FIG. 24, the periodical density change of the output image at each position in the main-scanning direction is significantly reduced.

The color printer 2000 according to the present embodiment explained above includes a photosensitive drum, an optical scanning device 2010 including a light source, the optical scanning device 2010 scanning a photosensitive drum surface in a main-scanning direction using light from the light source, and forming a latent image on the photosensitive drum surface, a developing unit for developing the latent image, a home position sensor for detecting a rotation cycle of the photosensitive drum, a density detection device 2245 for detecting density changes in a sub-scanning direction which is perpendicular to the main-scanning direction at three positions which are arranged in the main-scanning direction of a density change measurement pattern developed by the developing unit, and a scanning control device 3022 for obtaining an amplitude of a periodical density change of the density change measurement pattern, of which cycle is a rotation cycle of the photosensitive drum, at the three positions in the main-scanning direction on the basis of an output signal of the density detection device 2245, and correcting a drive signal for the light source so as to suppress the periodical density change of the density change measurement pattern at each of the positions in the main-scanning direction on the basis of the rotation cycle of the photosensitive drum and the amplitude.

In this case, an amplitude of the periodical density change of the density change measurement pattern at each position in the main-scanning direction is obtained on the basis of an amplitude of the periodical density change of the density change measurement pattern at three positions which are arranged in the main-scanning direction, whereby a drive signal of the light source can be corrected so as to suppress the periodical density change at each position of the density change measurement pattern which are arranged in the main-scanning direction on the basis of the rotation cycle of the photosensitive drum and the amplitude.

As a result, the density change over the entire output image can be suppressed to a required level.

The scanning control device 3022 obtains the amplitude of the periodical density change at each position of the density change measurement pattern which are arranged in the main-scanning direction through approximation with a linear function obtained on the basis of the amplitude of the periodical density change at three positions of the density change measurement pattern, and generates a light quantity correction pattern for correcting the drive signal for the light source on the basis of the rotation cycle of the photosensitive drum and the amplitude of the periodical density change at each position of the density change measurement pattern which are arranged in the main-scanning direction.

In this case, the light quantity correction pattern can be simplified and can be stored in a smaller capacity as compared with a case where the light quantity correction pattern is generated faithfully to the periodical density change at each position of the density change measurement pattern which is arranged in the main-scanning direction. As a result, the light quantity correction data can be written and read in a shorter time, and in addition, this can reduce the decrease in the throughput (productivity).

The scanning control device 3022 obtains the periodical density change at three positions of the density change measurement pattern in the main-scanning direction by approximating the change with a sine wave.

In this case, the amplitude of the periodical density change at each of the three positions in the main-scanning direction is uniquely determined, and therefore, the amplitude can be obtained easily.

Figure 11:
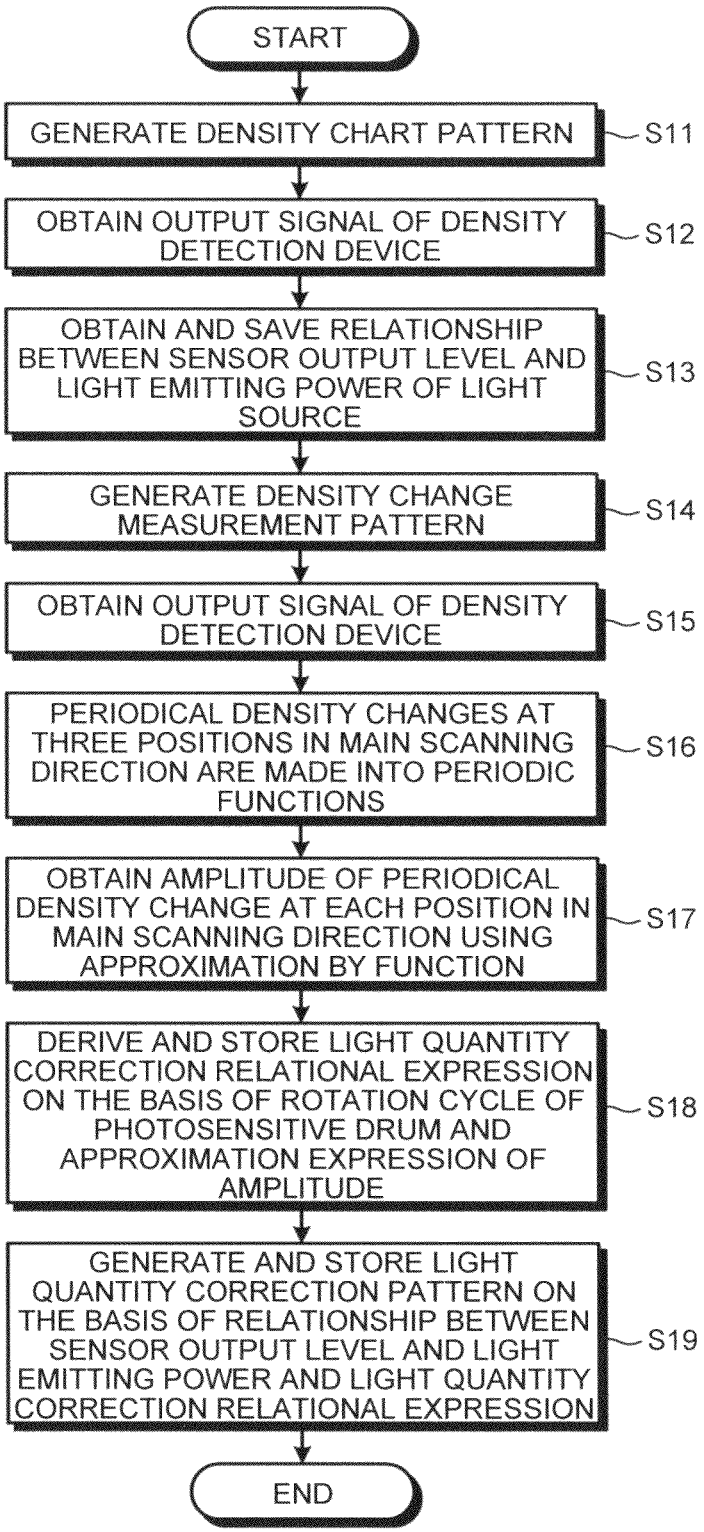
FIG. 11 is a flowchart for explaining light quantity correction information obtaining processing.

In the first embodiment, the relationship between the light emission power of the light source and the sensor output level is obtained by executing step S11, step S12 and step S13 in the flowchart of FIG. 11 in the light quantity correction information obtaining processing, but after the data of the relationship are saved in step S405 of the previous light quantity correction information obtaining processing, the saved data can be used, and therefore, in the subsequent light quantity correction information obtaining processing, it is not necessary to perform step S11, step S12, and step S13 at all times.

In the first embodiment, the periodical density change at the three positions in the main-scanning direction is made into the periodic function (sine wave approximation), but it may not be made into the periodic function. In this case, the height of a point close to any given peak (S in FIG. 19) of the periodical density change at the three positions in the main-scanning direction that can be directly obtained from the output signals of the three optical sensors (see FIG. 19) may be obtained as amplitudes. Then, the amplitude of the periodical density change at each position in the main-scanning direction is obtained by approximating the change with a linear function obtained based on the obtained three amplitudes, and the light quantity correction pattern including the position may be generated on the basis of the rotation cycle of the photosensitive drum and the amplitude of the periodical density change at each position in the main-scanning direction.

In the first embodiment, the periodical density changes are suppressed at all the positions in the main-scanning direction. More specifically, the drive signal of the light source corrected using all the light quantity correction patterns. Alternatively, for example, a determination may be made as to whether to suppress the periodical density change in accordance with the magnitude of the amplitude of the periodical density change at the positions Y1, Y2, Y3 in the main-scanning direction.

In the explanation below, multiple other embodiments will be explained. In each embodiment, elements having the same configurations as those of the first embodiment will be denoted with the same reference numerals and the description thereabout is omitted.

Second Embodiment

In the first embodiment, undesired density change in the sub-scanning direction on the output image caused by the photosensitive drum is suppressed, but as described above, undesired density change in the sub-scanning direction on the output image may also be generated due to eccentricity, error in the shape, and the like of the developing roller (see FIGS. 8A to 10). The density change in the sub-scanning direction changes with substantially the same cycle as the rotation cycle of the developing roller.

Figure 26:
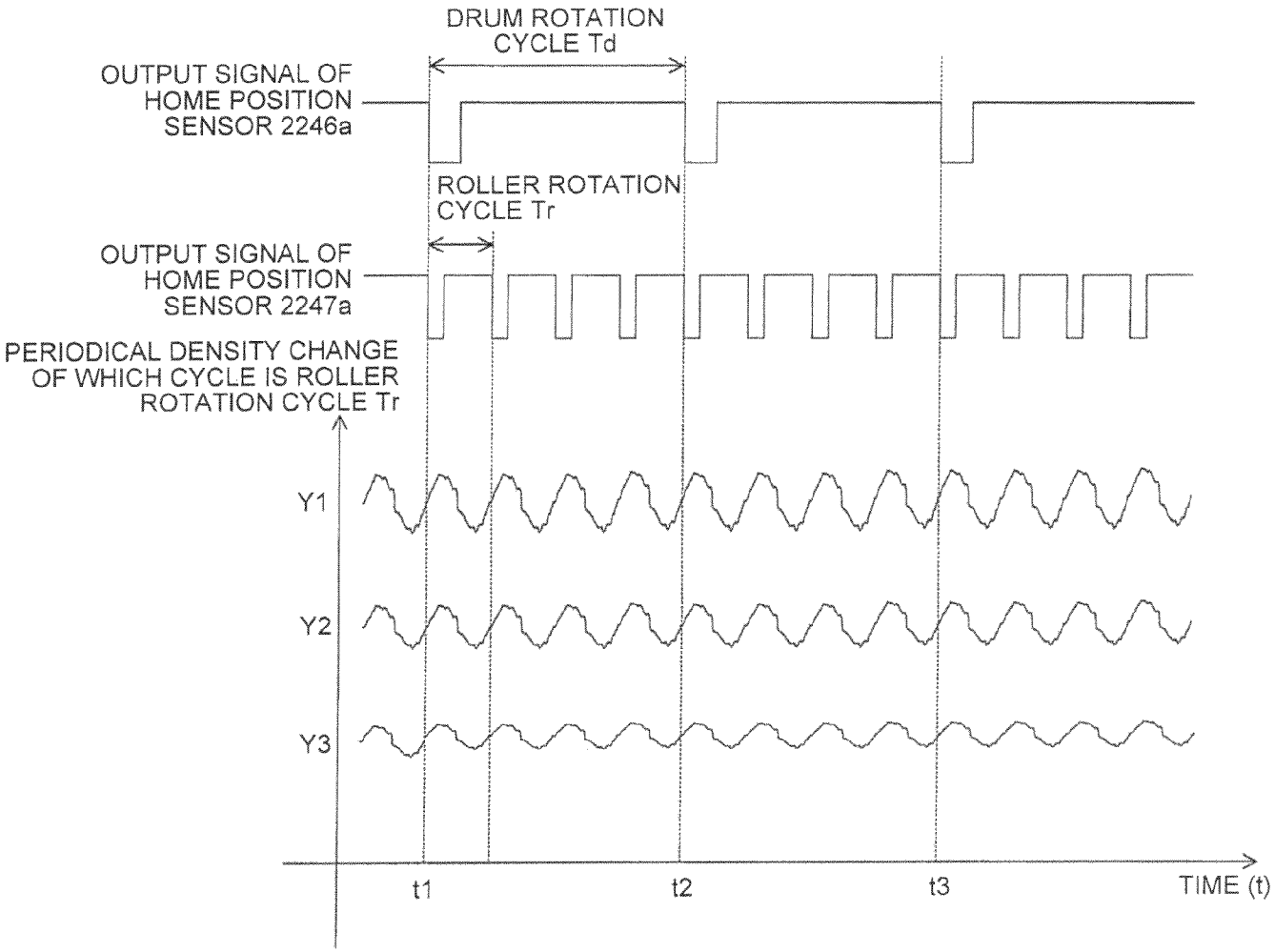
FIG. 26 is a timing chart illustrating a periodical density change, in which a rotation cycle of the developing roller is adopted as a cycle, at three positions of the density change measurement pattern which are arranged in the main-scanning direction.

Accordingly, in a second embodiment, as explained below in a more specific manner, not only the periodical density change of which cycle is the rotation cycle of the photosensitive drum but also density change of which cycle is the rotation cycle of the developing roller (periodical density change) are suppressed. In the explanation below, a periodical density change of which cycle of the rotation cycle of the photosensitive drum may also be referred to as a first periodical density change, and a periodical density change of which cycle is the rotation cycle of the developing roller (roller rotation cycle Tr) may also be referred to as a second periodical density change. As compared with the first periodical density change, the second periodical density change has much shorter cycle (see FIG. 26).

Figure 25:
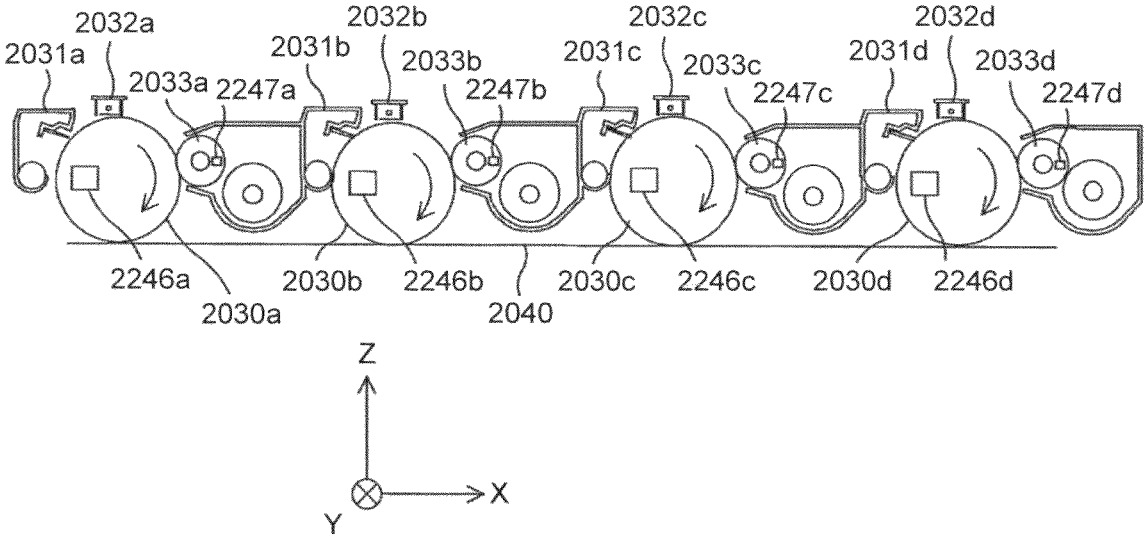
FIG. 25 is a figure for explaining a home position sensor of the developing roller.

In the second embodiment, as illustrated in FIG. 25, home position sensors (2247*a* to 2247*d*) for detecting the home position of each developing roller are provided, and the rotation cycle of the each developing roller is obtained on the basis of the output signals of the home position sensors (2247*a* to 2247*d*).

In the second embodiment, in the light quantity correction information obtaining processing, not only a first light quantity correction pattern for suppressing a first periodical density change (the light quantity correction pattern generated in the first embodiment (see FIG. 23)) but also a second light quantity correction pattern for suppressing a second periodical density change are generated.

More specifically, in the second embodiment, after steps S401 to S409 of the flowchart of FIG. 11 are performed, the first and second light quantity correction patterns are generated. The procedure for generating the first light quantity correction pattern is the same as the first embodiment, and accordingly, the procedure for generating the second light quantity correction pattern will be explained.

Figure 27:
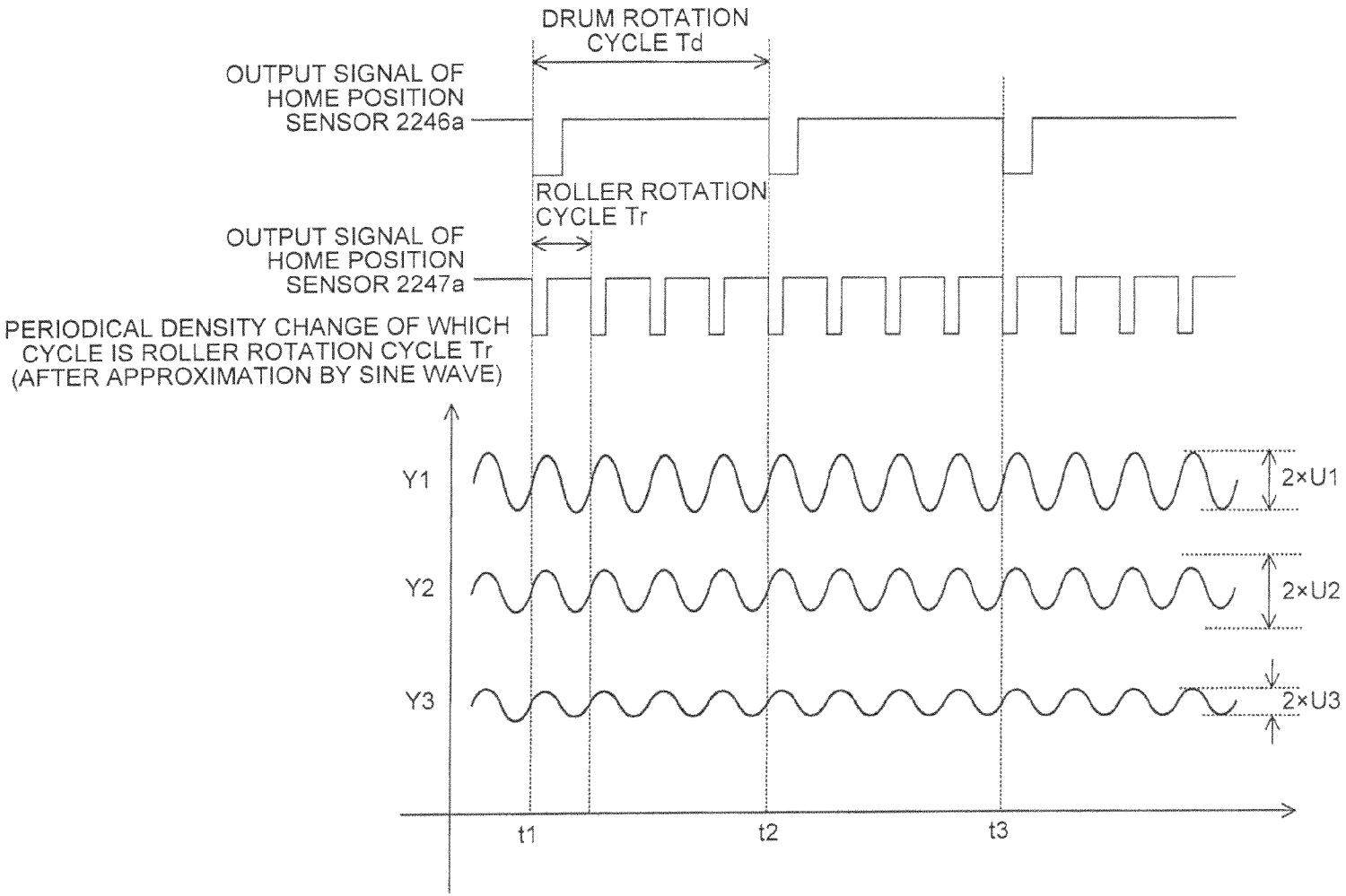
FIG. 27 is a timing chart illustrating a state where the periodical density change of FIG. 26 is approximated by a sine wave.

First, like the first embodiment, the second periodical density change at three positions Y1, Y2, Y3 in the main-scanning direction obtained from the output signals of the three optical sensors for the density change measurement pattern (see FIG. 26) is approximated by a sine wave (see FIG. 27), and the three second amplitudes U1, U2, U3 of the periodical density change after the sine wave approximation are obtained.

Subsequently, like the first embodiment, the amplitude of the second periodical density change at each position of the density change measurement pattern which are arranged in the main-scanning direction is obtained through approximation with a linear function obtained based on the three the amplitudes U1, U2, U3 of the second periodical density change after the sine wave approximation.

Figure 28:
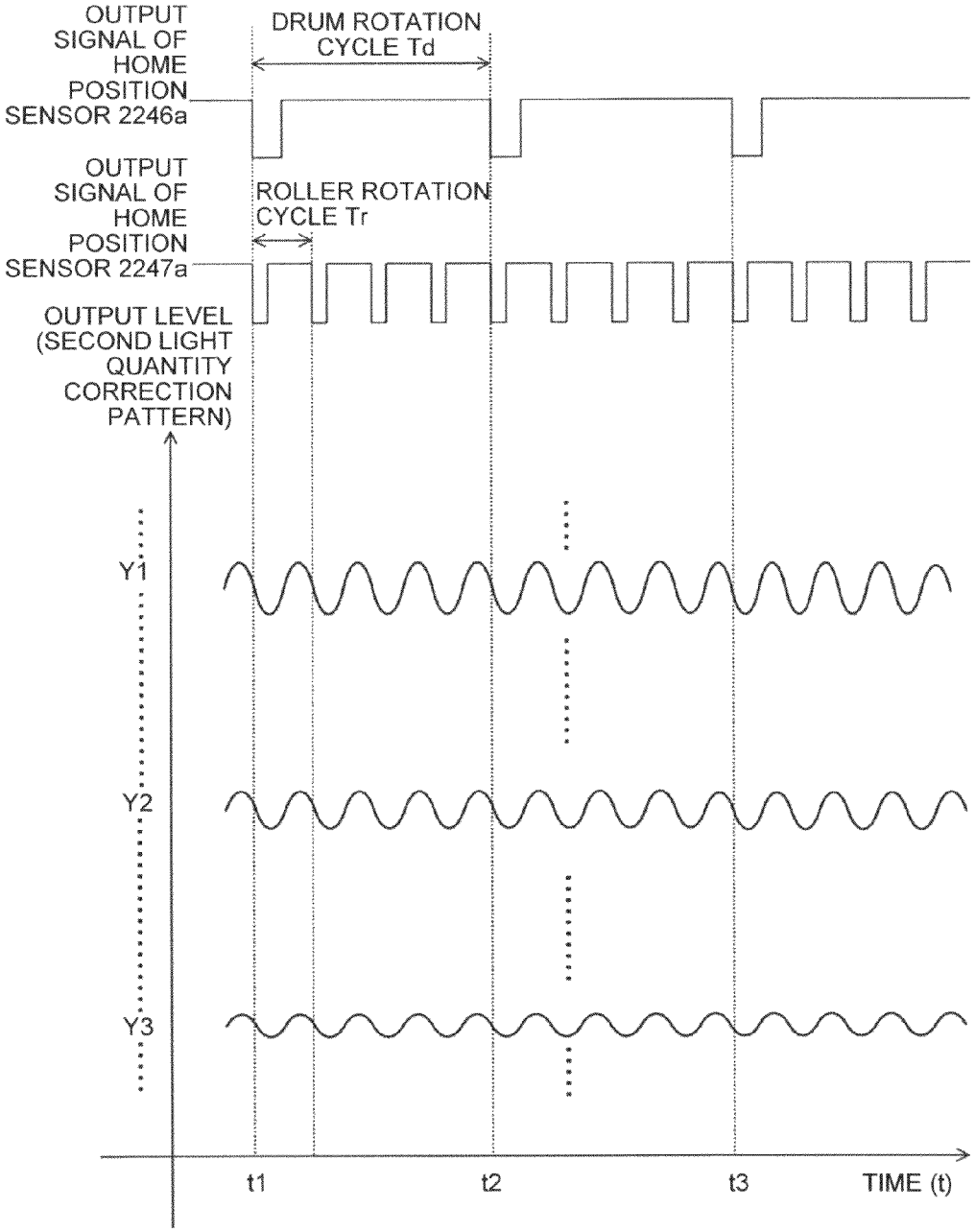
FIG. 28 is a timing chart illustrating a light quantity correction pattern (second light quantity correction pattern) for suppressing the periodical density change of FIG. 26.

Then, like the first embodiment, on the basis of the rotation cycle of the developing roller and the amplitude of the second periodical density change at each position in the main-scanning direction, the second light quantity correction patterns corresponding to the positions are generated (see FIG. 28), and at least some of them (for example, data corresponding to one cycle) is stored to the flash memory 3211.

Subsequently, when an image is formed on a recording sheet, the first and second light quantity correction patterns are overlaid on the drive signal for the light source in accordance with the modulated data, whereby the drive signal is corrected. The drive signal is corrected in the same manner in the four stations. Therefore, only the K station will be explained as an example.

First, write operational timing at each position in the main-scanning direction is obtained on the basis of the output signal of the leading end synchronization detection sensor 2111A, and the light source is driven using the first and second light quantity correction patterns corresponding to the position with the write operational timing. At this occasion, adjustment is made so that the phase of the first light quantity correction pattern becomes opposite to the phase of the corresponding first periodical density change on the basis of the output signal from the home position sensor 2246*a*, and adjustment is made so that the phase of the second light quantity correction pattern becomes opposite to the phase of the corresponding second periodical density change on the basis of the output signal from the home position sensor 2247*a*.

Figure 29:
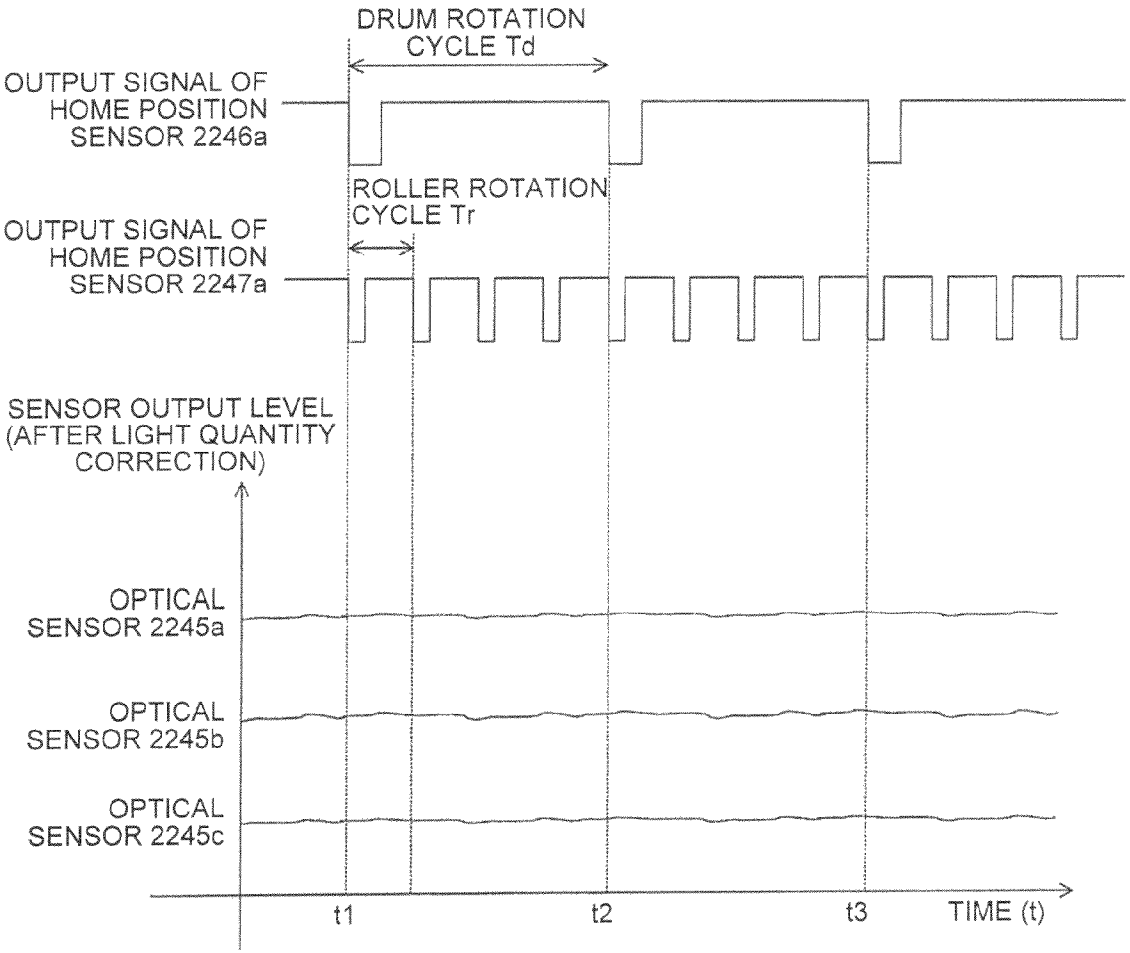
FIG. 29 is a timing chart illustrating the output level of each optical sensor for an output image formed with light from a light source of which light quantity has been corrected using the light quantity correction pattern of FIGS. 23 and 26.

FIG. 29 illustrates the output level of each optical sensor for a density change measurement pattern formed with light from a light source of which light quantity has been corrected using the first and second light quantity correction patterns. As can be understood from FIG. 29, the periodical density change at each position in the main-scanning direction is further reduced as compared with the first embodiment.

According to the second embodiment explained above, at each position of the density change measurement pattern which are arranged in the main-scanning direction, the periodical density change of which cycle is the rotation cycle of the photosensitive drum (first periodical density change) is suppressed, and in addition, the periodical density change of which cycle is the rotation cycle of the developing roller (second periodical density change) is suppressed.

As a result, as compared with the first embodiment, the density change can be suppressed even more greatly in the entire output image.

In the second embodiment, the second light quantity correction pattern corresponding to all the positions in the main-scanning direction is generated. Alternatively, for example, a determination may be made as to whether to generate the second light quantity correction pattern, i.e., as to whether to suppress the second light quantity correction pattern in accordance with the magnitude of the amplitude of the second periodical density change at each position in the main-scanning direction.

More specifically, for example, only when at least one of the amplitudes of the second periodical density changes at the three positions in the main-scanning direction is equal to or more than a predetermined threshold value, the second light quantity correction pattern corresponding to all the positions in the main-scanning direction may be generated. For example, only when the magnitude of inclination of a linear function obtained based on the three positions in the main-scanning direction is equal to or more than a predetermined threshold value, the second light quantity correction pattern corresponding to all the positions in the main-scanning direction may be generated.

In the second embodiment, the second periodical density change is made into a periodic function, but it may not be made into a periodic function.

In the second embodiment, after the processing corresponding to steps S11, S12 and S13 of FIG. 11 is executed in the light quantity correction information obtaining processing, it may not be necessarily performed in the subsequent light quantity correction information obtaining processing.

In the second embodiment, the rotation cycle of the developing roller is obtained by providing the home position sensors for detecting the home position of the developing roller. Alternatively, for example, the photosensitive drum and the developing roller may be connected mechanically using a gear, and the rotation cycle of the developing roller may be obtained on the basis of the gear ratio and the output signal of the home position sensor for the photosensitive drum.

Figure 30:
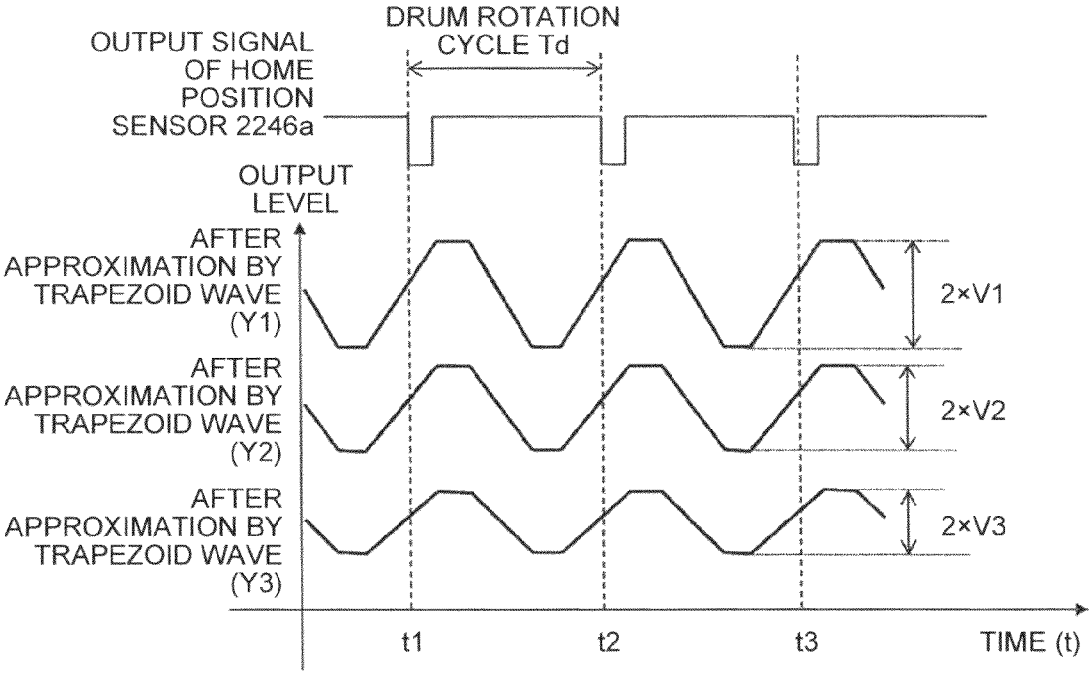
FIG. 30 is a timing chart illustrating a state where the periodical density change is approximated by a trapezoidal wave.

As illustrated in FIG. 30, the first periodical density change at the three positions Y1, Y2, Y3 of the density change measurement pattern may be approximated by a trapezoidal wave or a high-order harmonic. When approximated by a trapezoidal wave, the amount of data can be reduced as compared with a case where it is approximated by a sine wave, and when approximated by a high-order harmonic, light quantity correction data which are more closer to the periodical density change can be generated as compared with a case where it is approximated by a sine wave. Likewise, the second periodical density change at the three positions Y1, Y2, Y3 of the density change measurement pattern may be approximated by a trapezoidal wave or a high-order harmonic.

Figure 31:
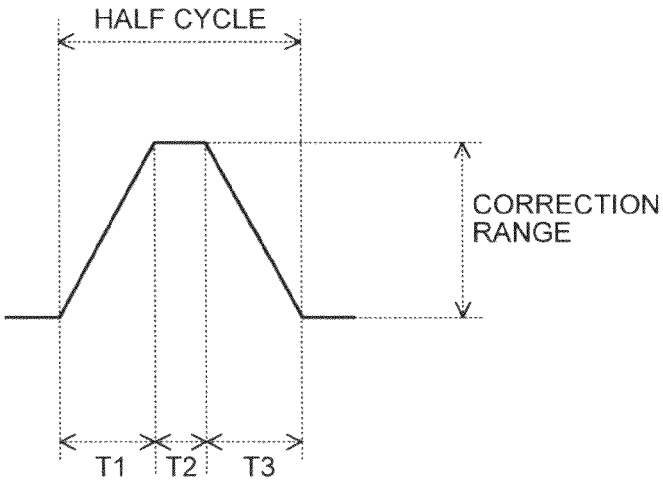
FIG. 31 is a figure for explaining trapezoidal wave approximation of FIG. 30.
Figure 32:
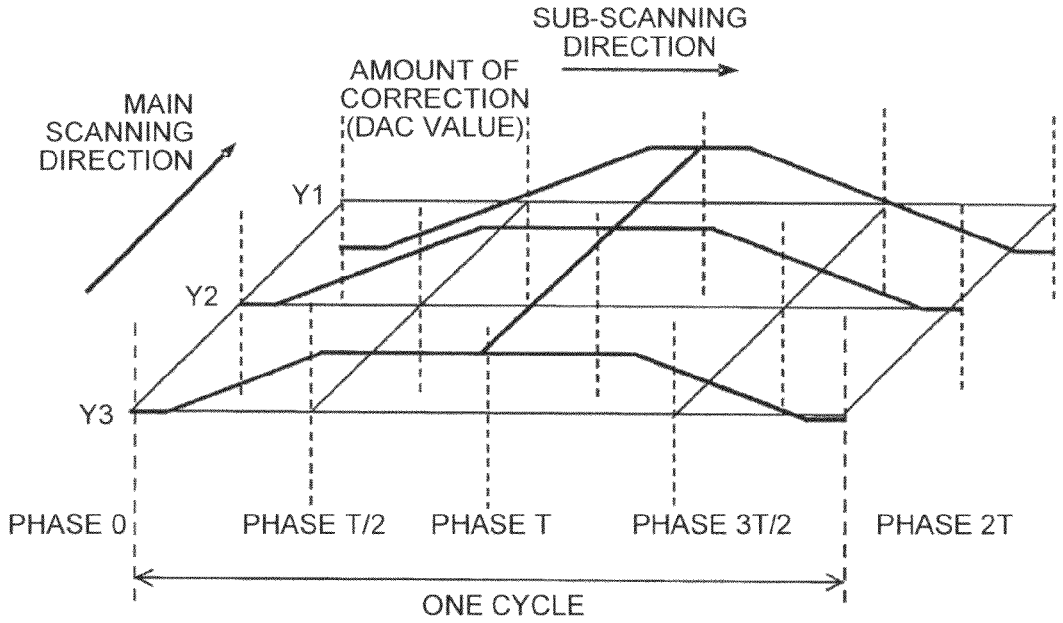
FIG. 32 is a graph illustrating a light quantity correction pattern corresponding to periodical density change of the density change measurement pattern at each position in the main-scanning direction (after trapezoidal wave approximation)

When the periodical density change is approximated by a trapezoidal wave, the light quantity correction pattern is also a trapezoidal wave. The light quantity correction pattern can be generated, for example, as illustrated in FIG. 31, if the following values are known: an increment time T1, a peak time T2, a decrement time T3, a correction range quantity, and a phase shift time (T4) for a drum rotation cycle Td (or roller rotation cycle Tr). FIG. 32 illustrates a light quantity correction pattern corresponding to each position in the main-scanning direction generated on the basis of three amplitudes V1, V2, V3 of the periodical density change after the trapezoidal wave approximation and the cycle of the periodical density change (the drum rotation cycle Td or the roller rotation cycle Tr).

Figure 33:
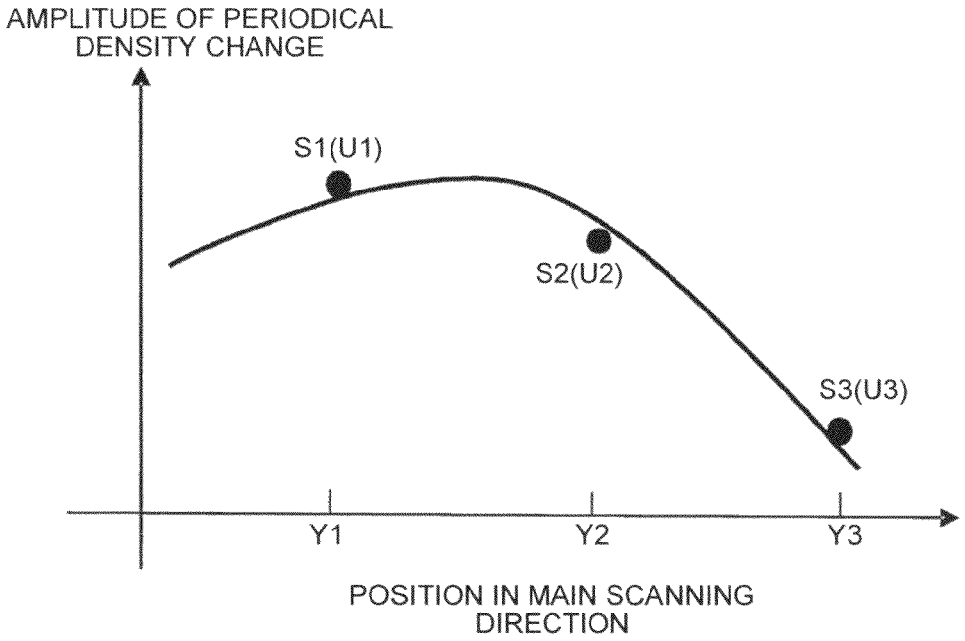
FIG. 33 is a graph illustrating an amplitude of periodical density change of the density change measurement pattern at each position in the main-scanning direction (after high-order function approximation)

As illustrated in FIG. 33, the amplitude of the periodical density change at each position of the density change measurement pattern which are arranged in the main-scanning direction may be obtained through approximation with a high-order function (for example, n-th order function (n is an integer equal to or more than two), sine function, and the like) obtained on the basis of the amplitudes of the periodical density change S1 (U1), S2 (U2), S3 (U3) at the three positions Y1, Y2, Y3 of the density change measurement pattern in the main-scanning direction.

In this case, highly accurate fitting can be achieved (obtained) with a high-order function approximating the amplitude of the periodical density change at each position of the density change measurement pattern which are arranged in the main-scanning direction, and therefore, more accurate light quantity correction can be performed.

Figure 34:
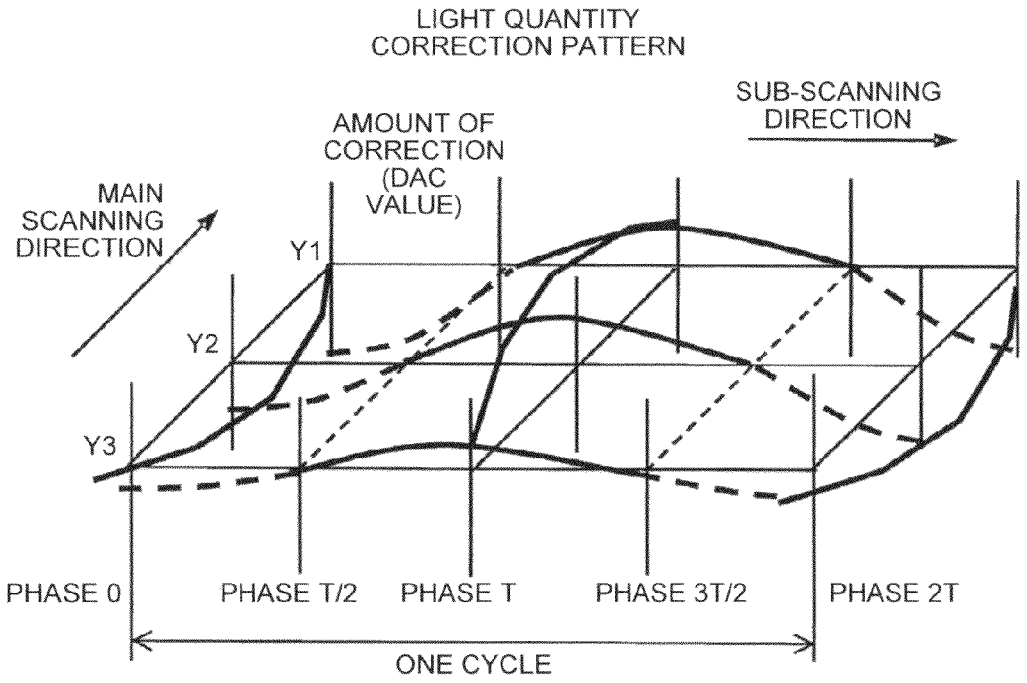
FIG. 34 is a figure illustrating a light quantity correction pattern corresponding to periodical density change of the density change measurement pattern at each position in the main-scanning direction (approximated by sine wave, and amplitude is approximated by high-order function)

In this case, S(y) in the expression (4) is replaced with the expression of the high-order function (see FIG. 33) which is an approximation expression of the amplitude of the periodical density change at each position of the density change measurement pattern which are arranged in the main-scanning direction, whereby a light quantity correction pattern corresponding to each position in the main-scanning direction is generated (see FIG. 34).

Figure 35:
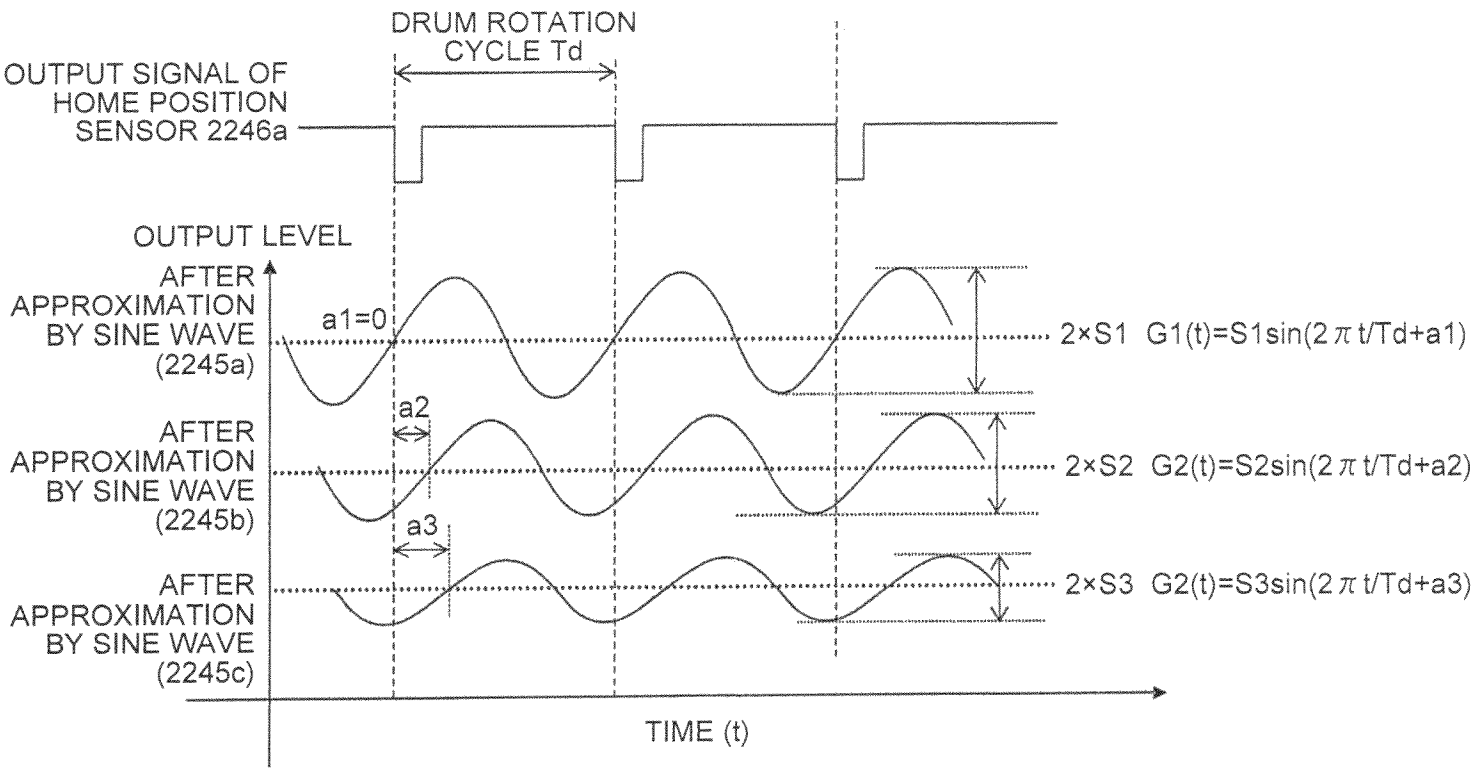
FIG. 35 is a timing chart illustrating periodical density change after the sine wave approximation of FIG. 20 in view of phase difference.

In addition to the first amplitude of the periodical density change, the phase of the first periodical density change may be taken into consideration. More specifically, as illustrated in FIG. 35, the first periodical density change at three positions of the density change measurement pattern in the main-scanning direction obtained from the output signals of the three optical sensors may be extracted as a sine wave of the same cycle as the cycle (drum rotation cycle Td) of the output signal of the home position sensor 2246*a* while maintaining the same phase. More specifically, the toner densities calculated from the sensor output signals of the optical sensors 2245*a*, 2245*b*, 2245*c* are represented by the following expressions (5) to (7).

$$G1(t)=S1\sin(2\pi t/Td+a1) \quad (5)$$

$$G2(t)=S2\sin(2\pi t/Td+a2) \quad (6)$$

$$G3(t)=S3\sin(2\pi t/Td+a3) \quad (7)$$

Figure 36:
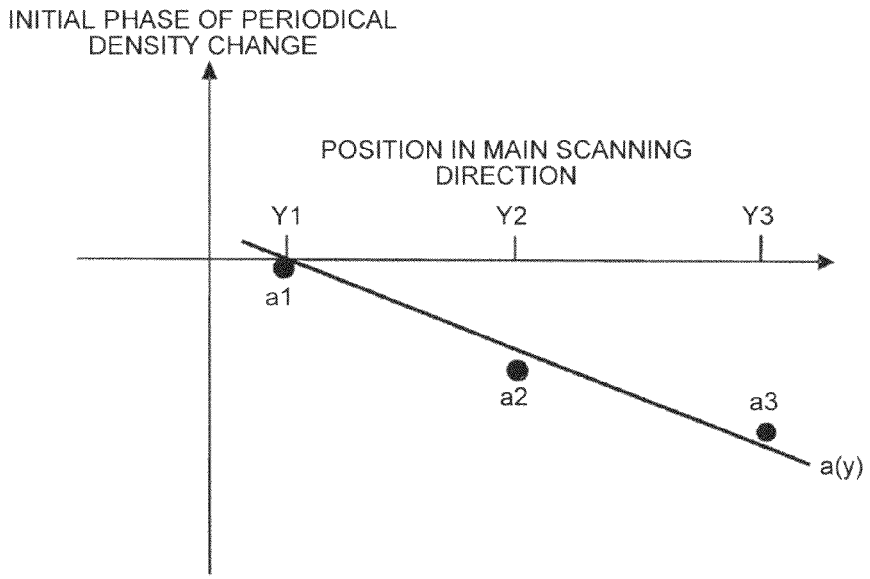
FIG. 36 is a graph illustrating an initial phase of periodical density change of the density change measurement pattern at each position in the main-scanning direction (linear function approximation)

Then, the amplitude of the periodical density change at each position of the density change measurement pattern which is arranged in the main-scanning direction is obtained through approximation with the linear function S(y) (see FIG. 21). An initial phase of periodical density change at each position of the density change measurement pattern in the main-scanning direction is obtained through approximation with a linear function a(y) obtained on the basis of initial phases a1, a2, a3 at the three positions Y1, Y2, Y3 of the density change measurement pattern in the main-scanning direction (see FIG. 36). As a result, the relational expression of the light quantity correction for the entire density change measurement pattern expressed by the following expression (8) can be obtained.

$$G(t,y)=S(y)\sin(2\pi t/Td+a(y)) \quad (8)$$

The light quantity correction pattern is generated using the light quantity correction relational expression as illustrated by the expression (8), and therefore, the light quantity correction can be performed with as high fidelity as possible for the density change actually occurring on the density change measurement pattern.

Figure 37:
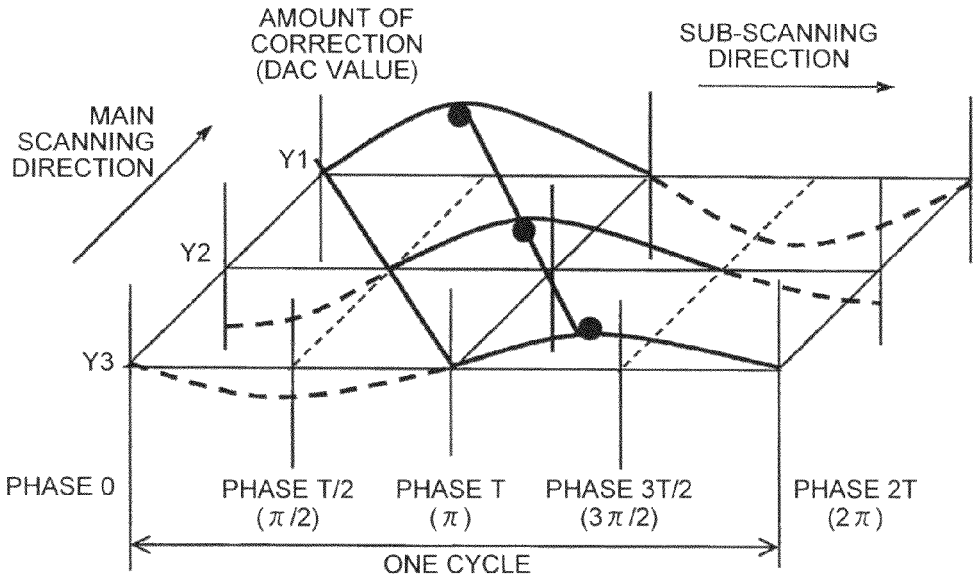
FIG. 37 is a graph illustrating periodical density change of the density change measurement pattern at each position in the main-scanning direction (approximated by a sine wave, and the amplitude and the initial phase are approximated by linear function)

In FIG. 37, the light quantity correction pattern generated using the expression (8) is made into a figure. In this case, for example, in the expression (5), a1 is zero. In the expression (6), a2 is $-\pi/2$. In the expression (7), a3 is $-\pi$.

Like the above, in addition to the second amplitude of the periodical density change, the phase of the second periodical density change may be taken into consideration when the relational expression of the light quantity correction is obtained.

In each of the embodiments, the amplitude of the periodical density change at each position in the main-scanning direction is obtained through approximation with a function obtained based on the amplitude of the periodical density change at the three positions in the main-scanning direction, but the embodiments are not limited thereto. For example, the amplitude of the periodical density change at each position in the main-scanning direction may be obtained as an average value of the amplitudes of the periodical density changes at the three positions in the main-scanning direction.

In the explanation about each of the above embodiments, the density detecting device 2245 has the three optical sensors arranged in the Y axis direction (main-scanning direction). However, the embodiments are not limited thereto. The density detecting device 2245 may have two or four or more optical sensors arranged in the Y axis direction. When the density detecting device has two optical sensors, the number of components can be reduced, and the control can be simplified as compared with the each of the above embodiments. When the density detecting device has four or more optical sensors, the density change can be corrected with a still higher degree of accuracy as compared with each of the above embodiments. For example, the density detecting device may be one line sensor having multiple optical sensor units arranged in the Y axis direction.

Third Embodiment

Subsequently, a third embodiment which is different in the image forming apparatus 2000 of FIG. 1 from the above embodiments will be explained. The same constituent portions as those of the above embodiments are denoted with the same reference numerals. Accordingly, hereinafter, repeated explanation will be omitted as long as there is no problem.

Figure 38:
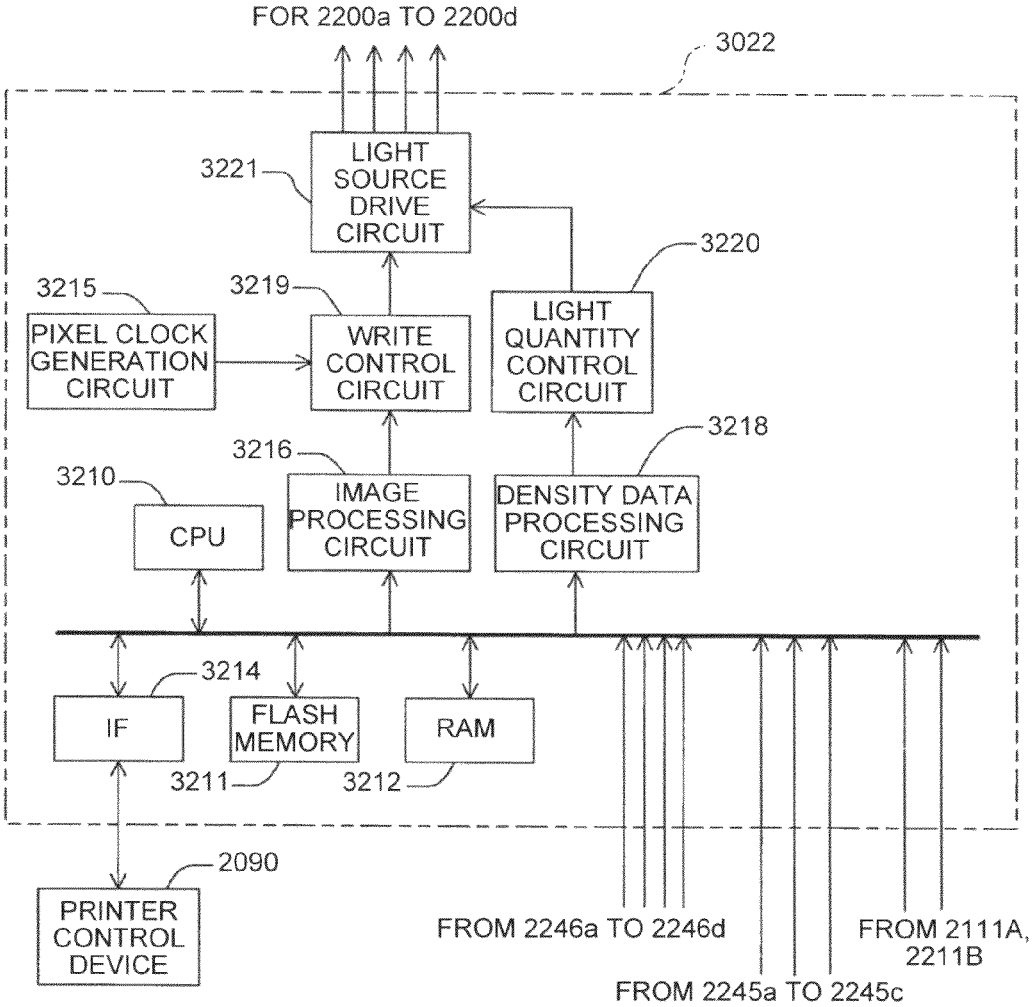
FIG. 38 is a block diagram illustrating a configuration of a scanning control device according to a third embodiment.

The scanning control device 3022 according to the third embodiment will be illustrated in FIG. 38, for example. This configuration is made by adding a density data processing circuit 3218 and a light quantity control circuit 3220 to the configuration of FIG. 7 as explained above.

The density data processing circuit 3218 calculates the density of a toner image transferred onto a transfer belt 2040 (toner density) on the basis of an output signal of each optical sensor.

The light quantity control circuit 3220 generates a correction signal of the quantity of emitted light (light emission power) of each light emitting unit of the light source on the basis of the output signal from the density data processing circuit 3218 (toner density).

The light source drive circuit 3221 generates the drive signal of the each light source on the basis of each piece of the modulated data from the write control circuit 3219, and superimposes the correction signal from the light quantity control circuit 3220 onto the drive signal, thus correcting the drive signal and outputting the corrected drive signal to the light source.

By the way, there is a problem in that undesired density change may occur in a page or between pages of the image that is output from the color printer 2000 (which may be hereinafter referred to as an output image).

One of the reasons of this density change includes a gap change between the photosensitive drum and the developing roller. This gap change includes a gap change in the main-scanning direction (in the longitudinal direction of the photosensitive drum) and a gap change in the sub-scanning direction (rotation direction of the photosensitive drum).

Therefore, first, the density change in the main-scanning direction will be considered. One of the reasons for the density change includes the degree of parallelism of the arrangement of the cylindrical photosensitive drum and developing roller. When the photosensitive drum and the developing roller are not arranged in parallel in a relative manner, the gap is different in the main-scanning direction. In this case, the developing performance is different in the main-scanning direction, and therefore, density change occurs in the main-scanning direction. At this occasion, the toner density changes in a linear manner in the main-scanning direction.

Another reason for this includes inclination of the rotating shaft of the photosensitive drum with respect to the axial line of the photosensitive drum. In this case, the phase of the gap change is different in the main-scanning direction. As a result, complicated density changes having different phases in the main-scanning direction occur in the output image.

Figure 8A:
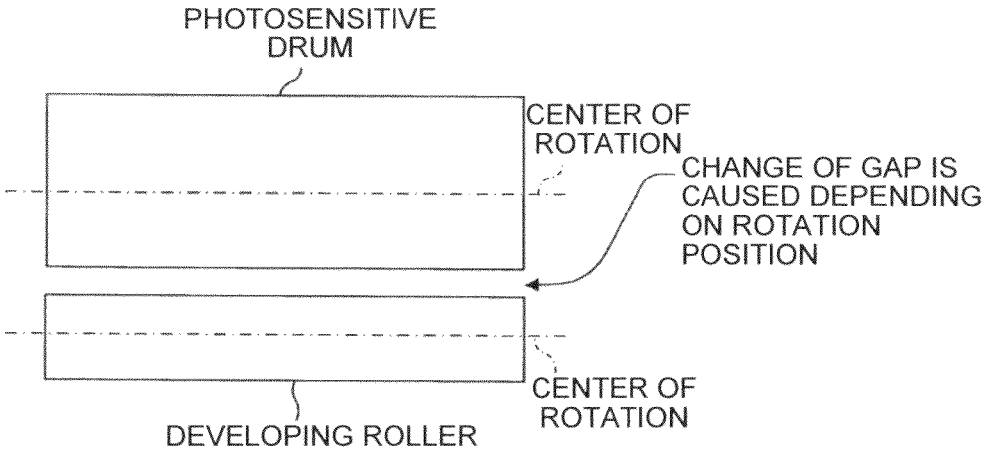
FIG. 8A is a figure for explaining eccentricity of the photosensitive drum.

Subsequently, the density change in the sub-scanning direction will be considered. One of the reasons for the density change includes eccentricity of the photosensitive drum as illustrated in FIG. 8A described above. More specifically, if the rotating shaft of the photosensitive drum (the center of rotation) is out of the axial line of the photosensitive drum, the distance from the rotating shaft to the photosensitive drum surface is different in each period in the sub-scanning direction. In this case, the gap changes periodically in the sub-scanning direction. This gap change results in variation of the development, and therefore, density change occurs in the output image in the sub-scanning direction.

Figure 8B:
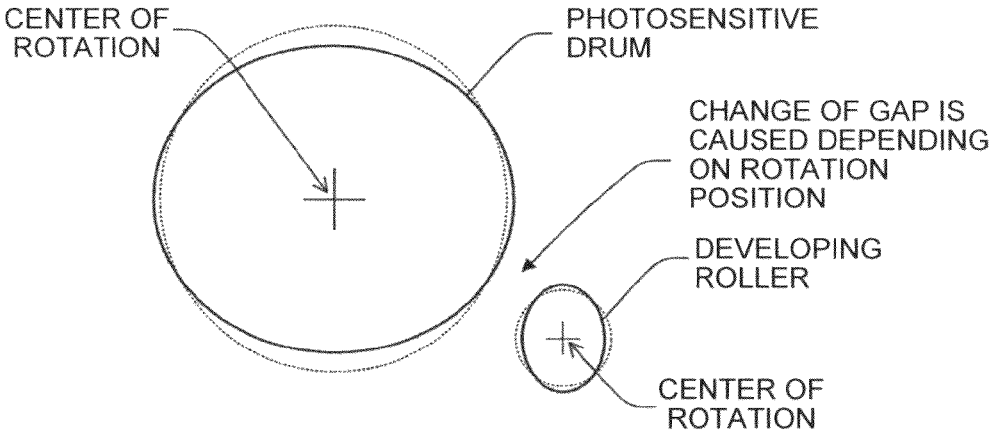
FIG. 8B is a figure for explaining errors in the shapes of the photosensitive drum and developing roller.
Figure 9:
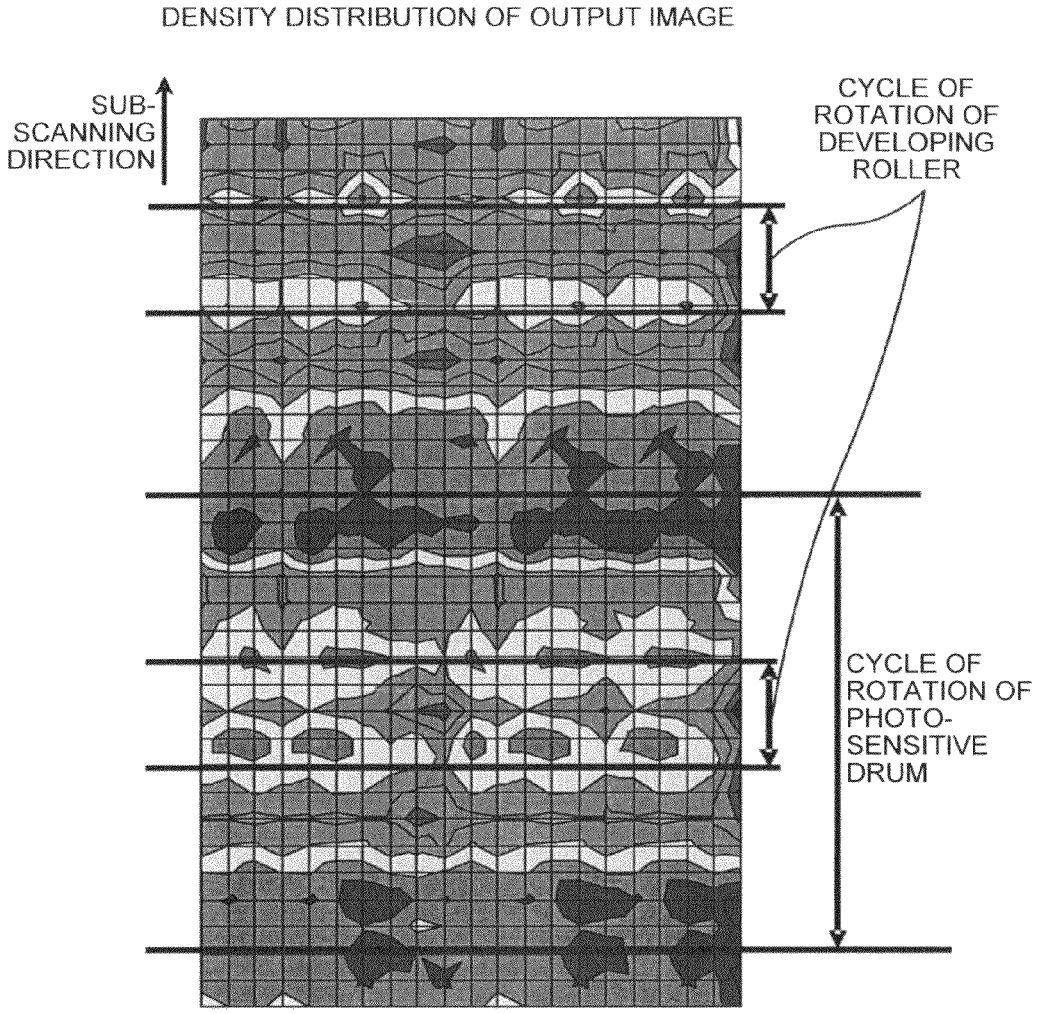
FIG. 9 is a figure illustrating density distribution of an output image.
Figure 10:
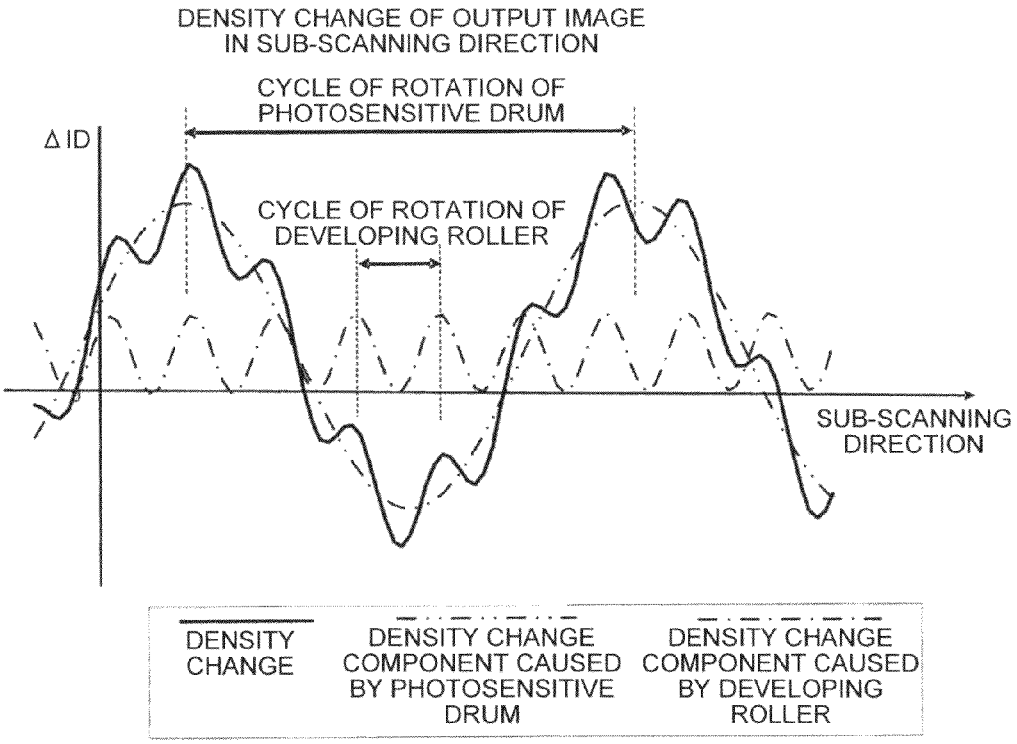
FIG. 10 is a figure illustrating a density change of the output image in the sub-scanning direction.

Another reason for this includes circularity of the photosensitive drum as illustrated in FIG. 8B described above. Suppose that the cross section perpendicular to the axial line of the photosensitive drum is in the shape of an ellipse. In this case, the gap changes periodically in the rotational direction of the photosensitive drum (sub-scanning direction). For this reason, the development performance changes in the sub-scanning direction, and density change occurs in the output image in the sub-scanning direction.

Accordingly, just like what has been explained above, the scanning control device 3022 performs "light quantity correction information obtaining processing" for suppressing undesired density change with predetermined operational timing.

Hereinafter, the light quantity correction information obtaining processing will be explained with reference to FIG. 39. The flowchart of FIG. 39 corresponds to a series of processing algorithm executed by the scanning control device 3022 during the light quantity correction information obtaining processing. The light quantity correction information obtaining processing is executed by every station, and each station executes it in the same manner. Therefore, the light quantity correction information obtaining processing executed in the K station will be explained as an example.

Figure 40:
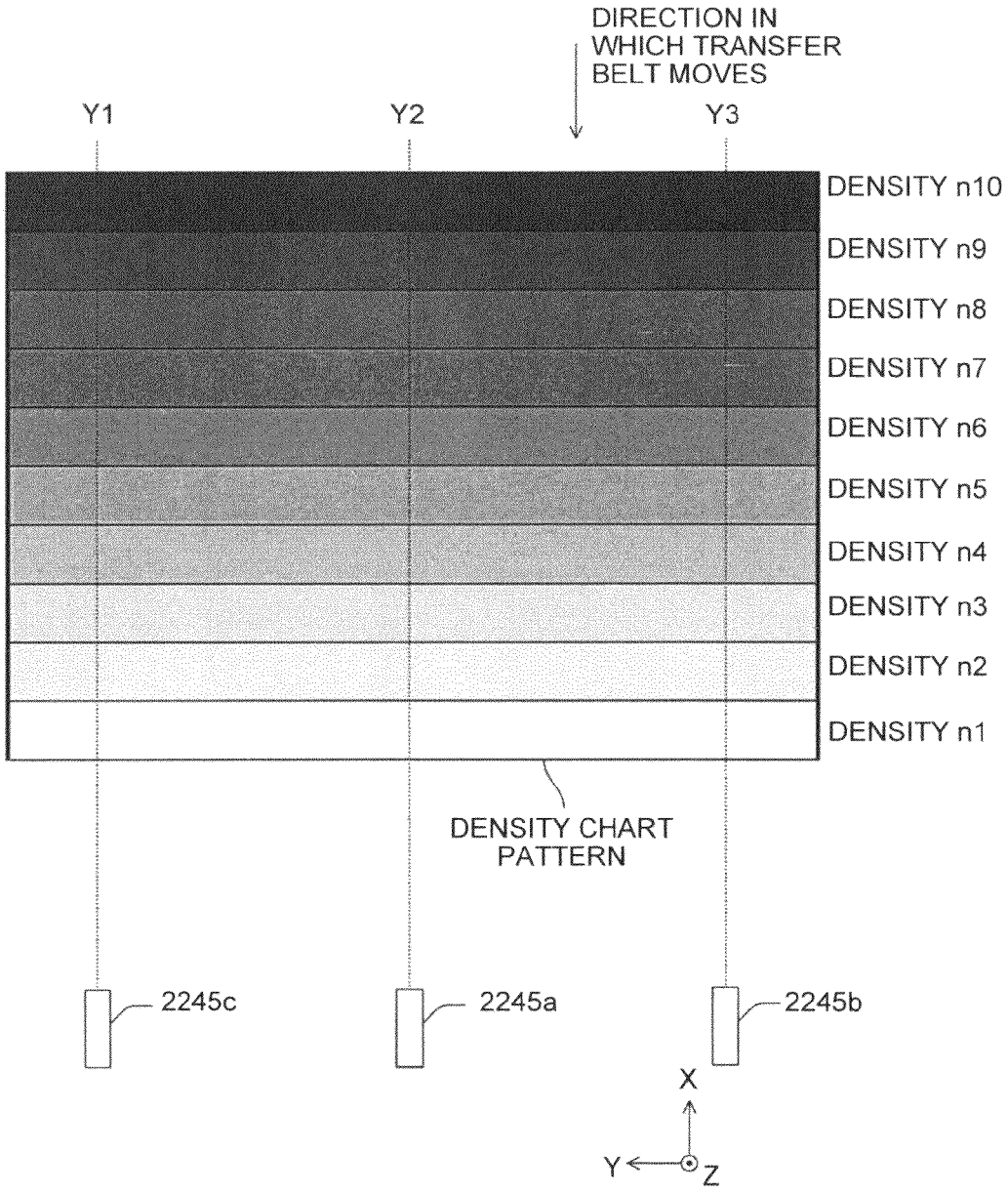
FIG. 40 is a figure for explaining arrangement of the density chart pattern and each optical sensor.

In the first step S21, for example, as illustrated in FIG. 12, a density chart pattern having multiple areas of which toner densities are different from each other with regard to black is formed in such a manner that, for example, as illustrated in FIG. 40, the central position is Y1 with regard to the Y axis direction.

In this case, for example, the density chart pattern includes ten types of density (n1 to n10) areas. The density n1 is the lowest density. The density n10 is the highest density. More specifically, the density gradually increases from the density n1 to the density n10. When the density chart pattern is formed, the ratio of image in each area is constant, and the light emitting unit emits light for the same cycle of time regardless of the density, and only the light emission power is changed so as to change the density. In this case, the light emission power corresponding to the density n1 is p1, the light emission power corresponding to the density n2 is p2, . . . , and the light emission power corresponding to the density n10 is p10.

Figure 41:
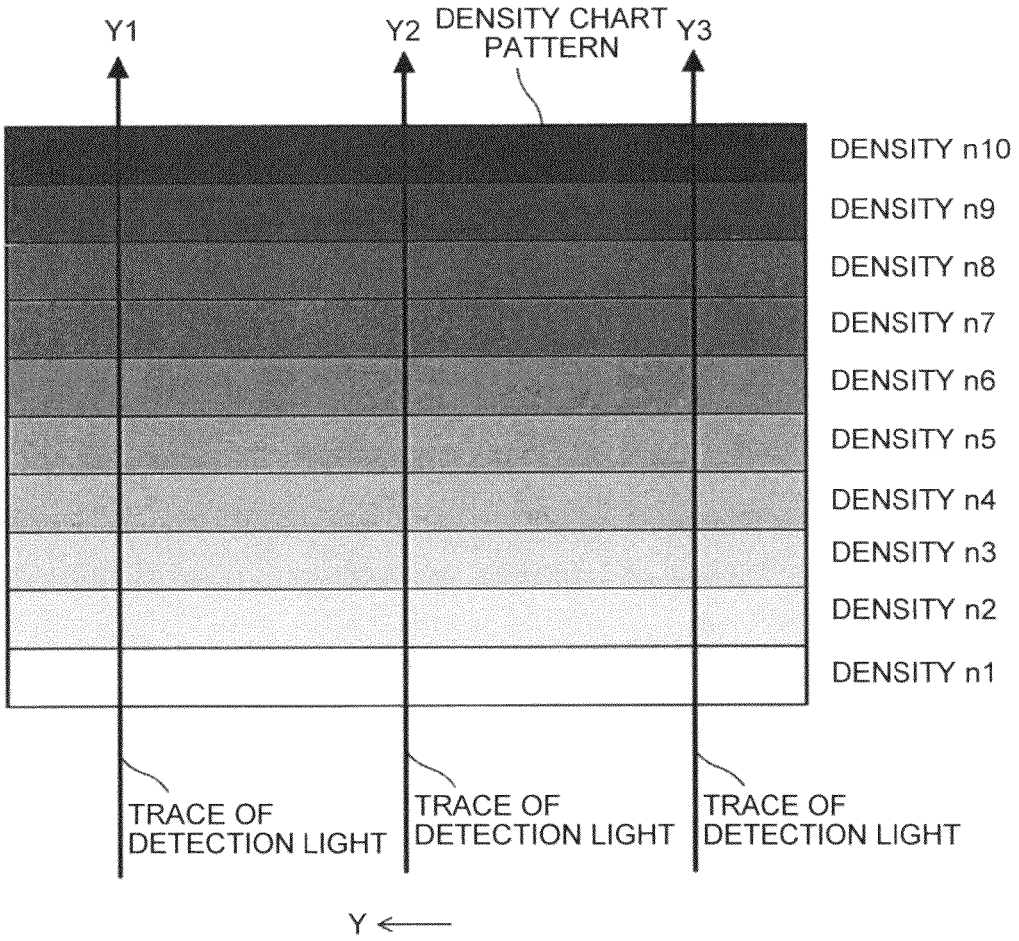
FIG. 41 is a figure for explaining a locus of detection light emitted from each optical sensor in the light quantity correction information obtaining processing.

In the subsequent step S22, the LED 11 of each optical sensor is turned on. The light emitted by the LED 11 (hereinafter referred to as "detection light") successively illuminates the area of the density n1 to the area of the density n10 in the density chart pattern as the transfer belt 2040 rotates, i.e., as the time passes (see FIG. 41).

Then, the output signals of the regular reflection light receiving element 12 and the diffuse reflection light receiving element 13 are obtained.

By the way, when the toner is not attached to the transfer belt 2040, the detection light reflected by the transfer belt 2040 includes more regular reflection light component than diffuse reflection light component. Accordingly, much light is incident upon the regular reflection light receiving element 12, hardly any light is incident upon the diffuse reflection light receiving element 13 (see FIG. 15A).

On the other hand, the regular reflection light component decreases and the diffuse reflection light component increases when the toner is attached to the transfer belt 2040 than when the toner is not attached. Accordingly, the light incident upon the regular reflection light receiving element 12 decreases, and the light incident upon the diffuse reflection light receiving element 13 increases (see FIG. 15B).

More specifically, in accordance with the output levels of the regular reflection light receiving element 12 and the diffuse reflection light receiving element 13 (the ratio of them both), the toner density attached to the transfer belt 2040 can be detected.

In the subsequent step S23, correlation between the sensor output level (toner density) and the emission power is obtained (see FIG. 16). In this case, the correlation is approximated by a polynomial expression, and the polynomial expression is stored to the flash memory 3211.

Figure 42:
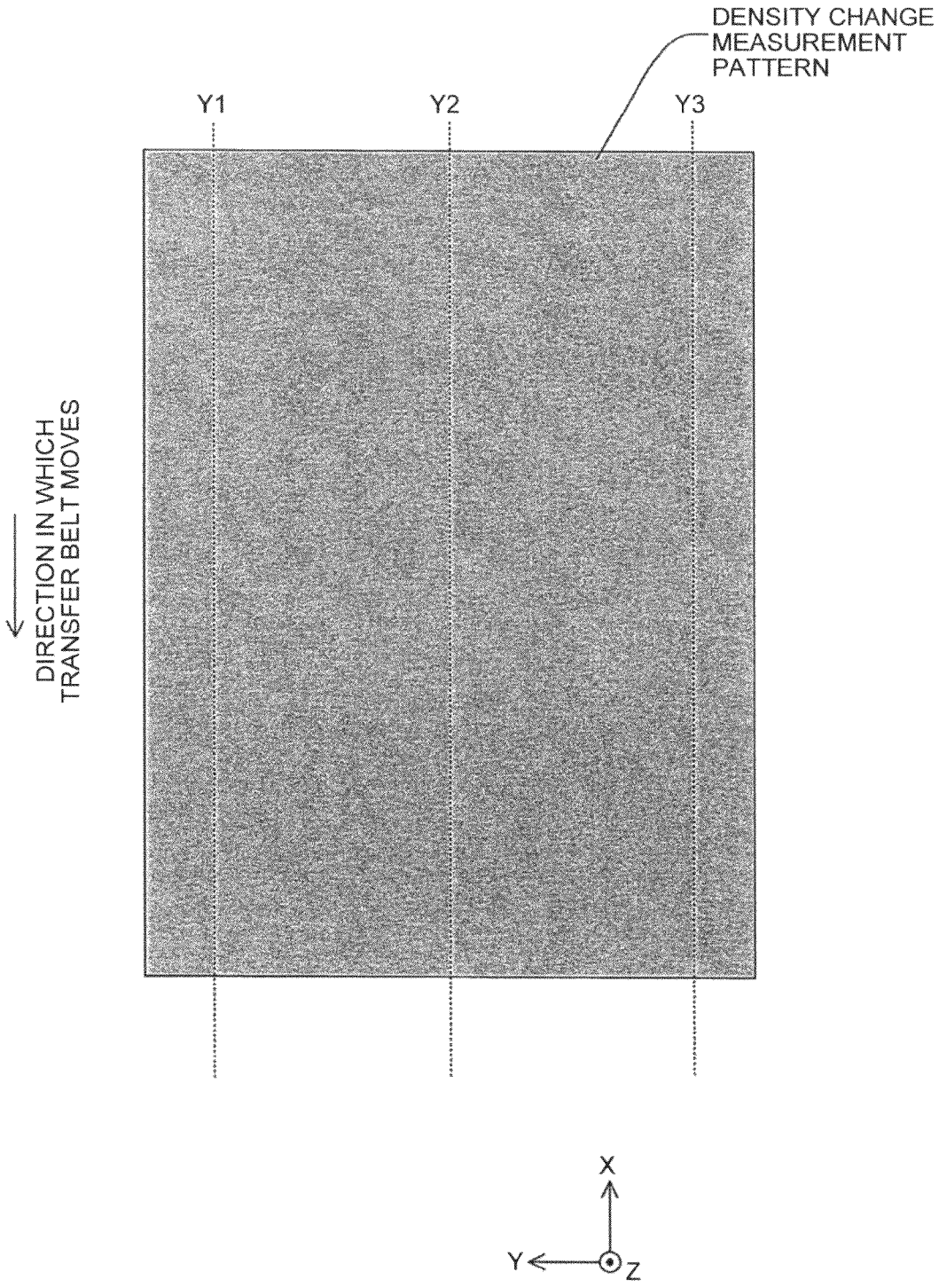
FIG. 42 is a figure for explaining density change measurement pattern.

In the subsequent step S24, the density change measurement pattern is formed on the transfer belt 2040. In this case, a halftone image using black toner having the same image size ratio as the above density pattern is formed in the "A3" size as the density change measurement pattern (see FIG. 42). In this case, the density of the halftone image is, for example, about 70%. In this case, the density change due to the change of the light quantity is greater, and this is preferable for the density correction. It should be noted that the image data of the density change measurement pattern are stored to the flash memory 3211 in advance.

Figure 43:
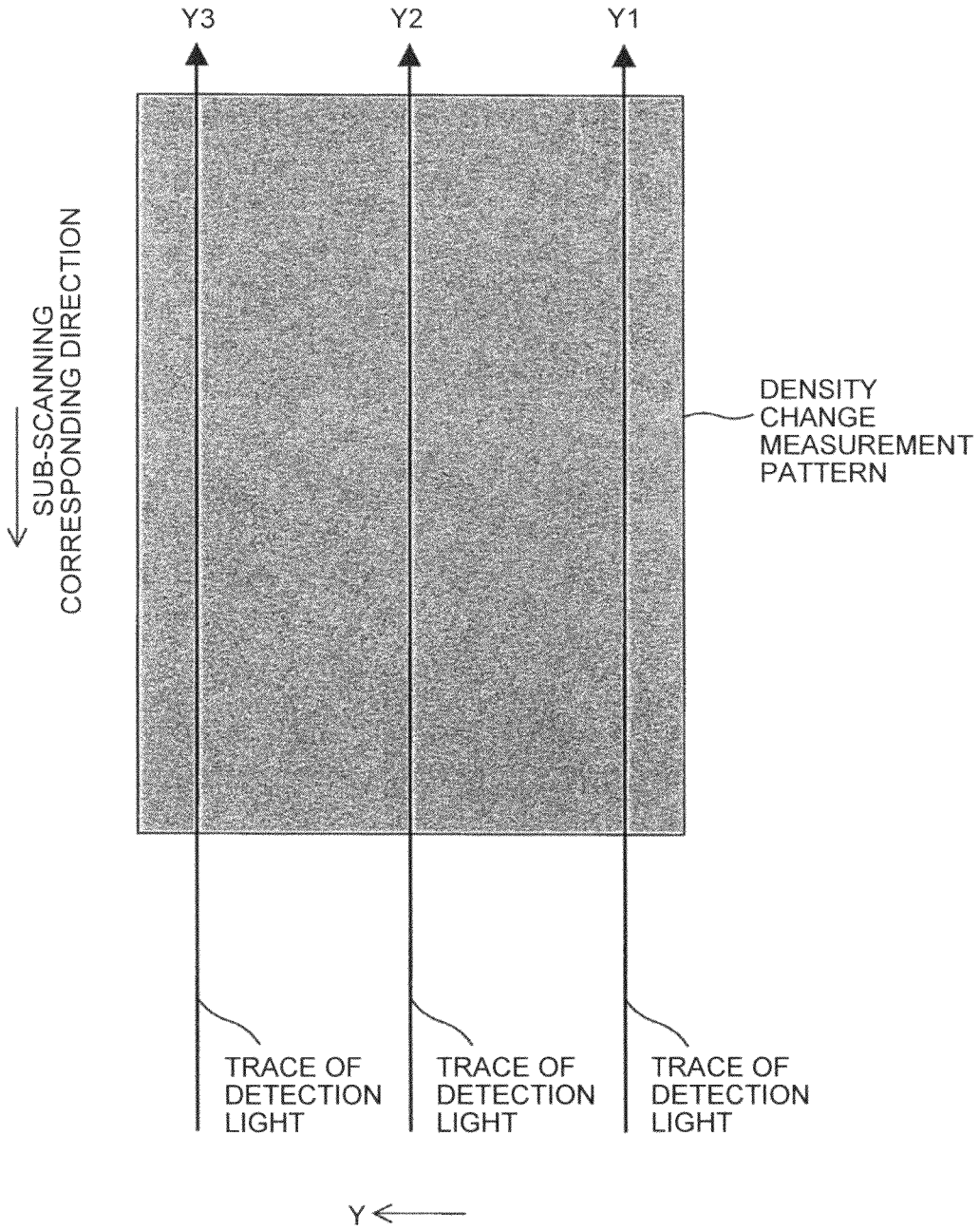
FIG. 43 is a figure for explaining a locus of detection light emitted from each optical sensor for the density change measurement pattern.

After the density change measurement pattern is formed, the LED 11 of each optical sensor is turned on in order to detect the density of the density change measurement pattern. The light from each LED 11 illuminates the density change measurement pattern in the sub-scanning corresponding direction as the transfer belt 2040 rotates, i.e., as the time passes (see FIG. 43).

In the subsequent step S25, the output signals of the regular reflection light receiving element 12 and the diffuse reflection light receiving element 13 are obtained with predetermined time interval for each optical sensor. Then, the obtained output signals are sent to the density data processing circuit 3218, and the toner density is calculated.

On the other hand, the home position sensor 2246*a* detects the rotation cycle of the photosensitive drum 2030*a* (hereinafter referred to as drum rotation cycle T), and the detection signal is sent to the density data processing circuit 3218. The toner density calculated from the output signal of each optical sensor periodically changes with substantially the same amplitude and substantially the same cycle as the cycle of the output signal of the home position sensor 2246*a* (drum rotation cycle T) (see FIG. 44).

In the subsequent step S26, the density data processing circuit 3218 makes periodical change of the toner density calculated from the output signal of each optical sensor (hereinafter referred to as periodical density change) into a periodic function on the basis of the output signals of each optical sensor and the home position sensor 2246*a*.

Figure 44:
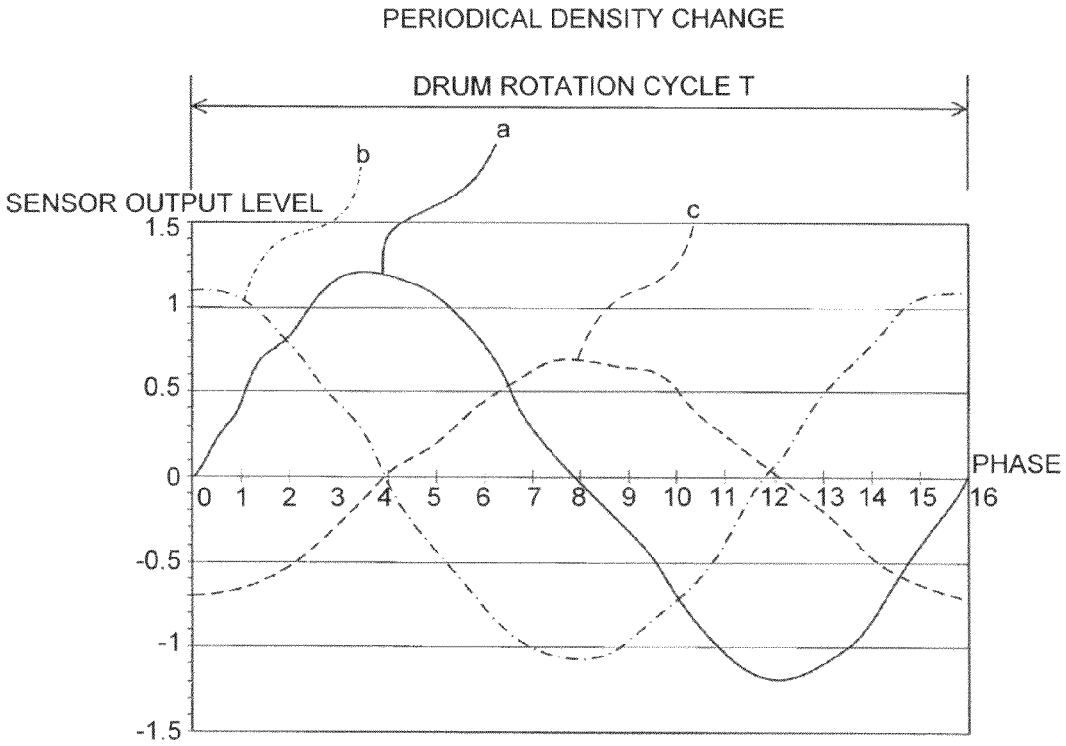
FIG. 44 is a timing chart illustrating three periodical density changes obtained from the sensor output levels of three optical sensors with respect to the density change measurement pattern.

In this case, for example, the density data processing circuit 3218 extracts a periodical density change a (solid lines in FIG. 44), a periodical density change b (dashed line in FIG. 44), and a periodical density change c (broken line FIG. 44)

obtained from each of the output signals of the three optical sensors 2245*a*, 2245*b*, 2245*c*, as sine waves of which cycle and amplitude are the same, i.e., sine waves of which initial phases are different from each other. It should be noted that the three periodical density changes a, b, c are periodical density changes at the positions Y1, Y2, Y3.

Figure 45:
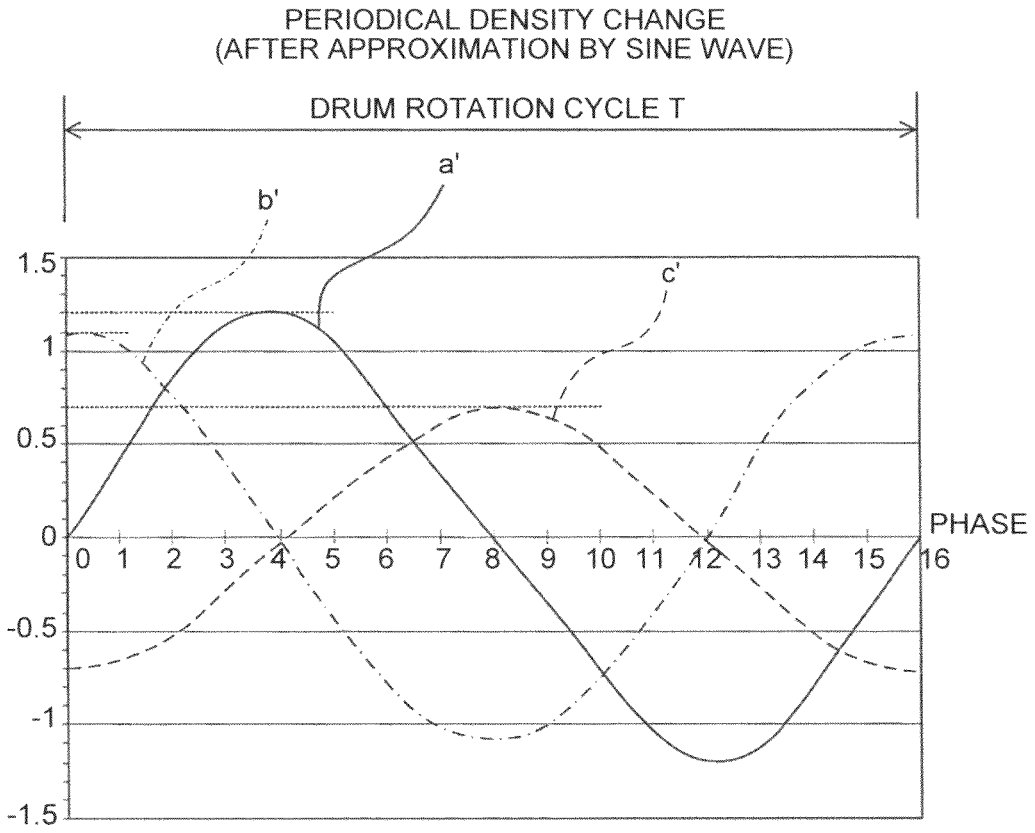
FIG. 45 is a timing chart illustrating a state where the three periodical density changes of FIG. 44 are approximated by a sine wave.

More specifically, the three periodical density changes a, b, c are approximated by sine waves having the same cycle as the rotation cycle T of the photosensitive drum 2030*a* (see FIG. 45), and thereafter an average value S of the amplitudes of the three sine waves is calculated. The sine wave a', b', c' in FIG. 45 correspond to the periodical density changes a, b, c, respectively. As can be understood from FIG. 45, for example, the amplitudes of the sine wave a', b', c' are (1.2), (1.1), (0.7), respectively, and in this case, average value S is one.

Figure 46:
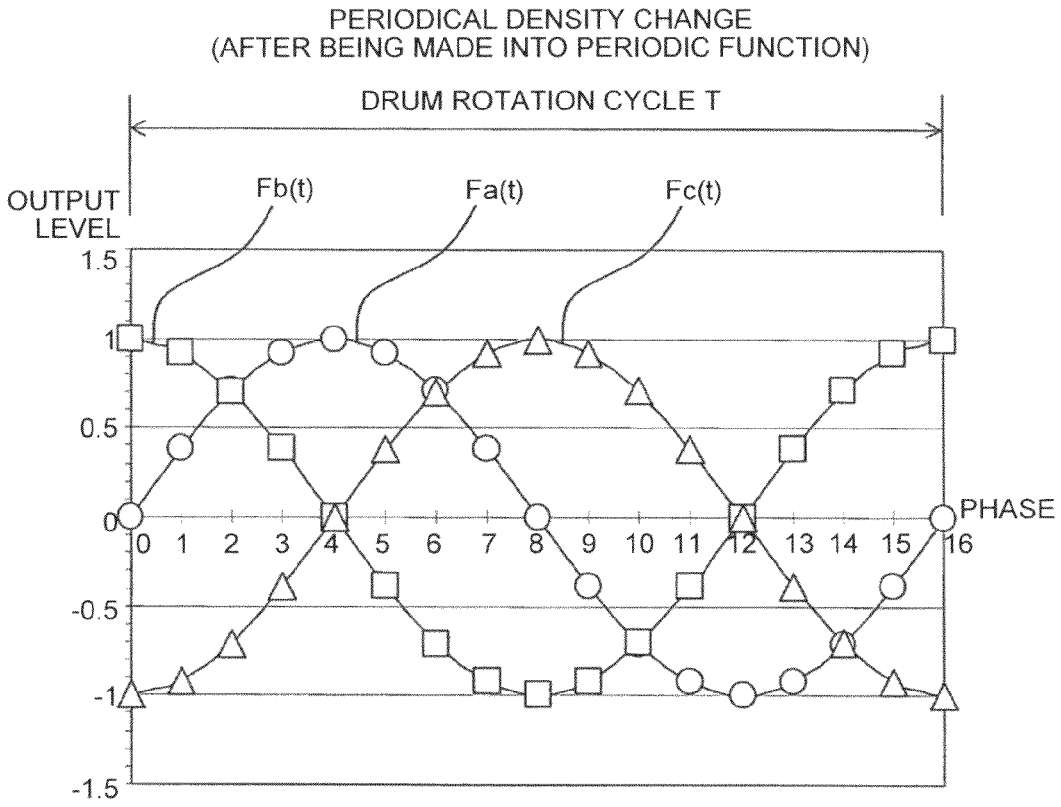
FIG. 46 is a timing chart illustrating a state where the three periodical density changes of FIG. 44 are made into a periodic function.

Then, the three periodical density changes a, b, c are extracted as sine waves Fa(t), Fb(t), Fc(t) having the same cycle T, amplitude S (for example, one) as the drum rotation cycle T represented by the following expressions (9) to (11) (see FIG. 46).

$$Fa(t)=S\sin(2\pi t/T+\phi 1) \quad (9)$$

$$Fb(t)=S\sin(2\pi t/T+\phi 2) \quad (10)$$

$$Fc(t)=S\sin(2\pi t/T+\phi 3) \quad (11)$$

It should be noted that t denotes a time. The variables $\phi$1, $\phi$2, $\phi$3 are initial phases (phase where t is zero) of the sine waves Fa(t), Fb(t), Fc(t), respectively (in FIG. 46, they are 0, −4, +4, respectively).

In the subsequent step S27, the initial phase of periodical density change at each position in the main-scanning direction is obtained through approximation with a function based on the initial phases $\phi$1, $\phi$2, $\phi$3 of the sine waves Fa(t), Fb(t), Fc(t).

Figure 47:
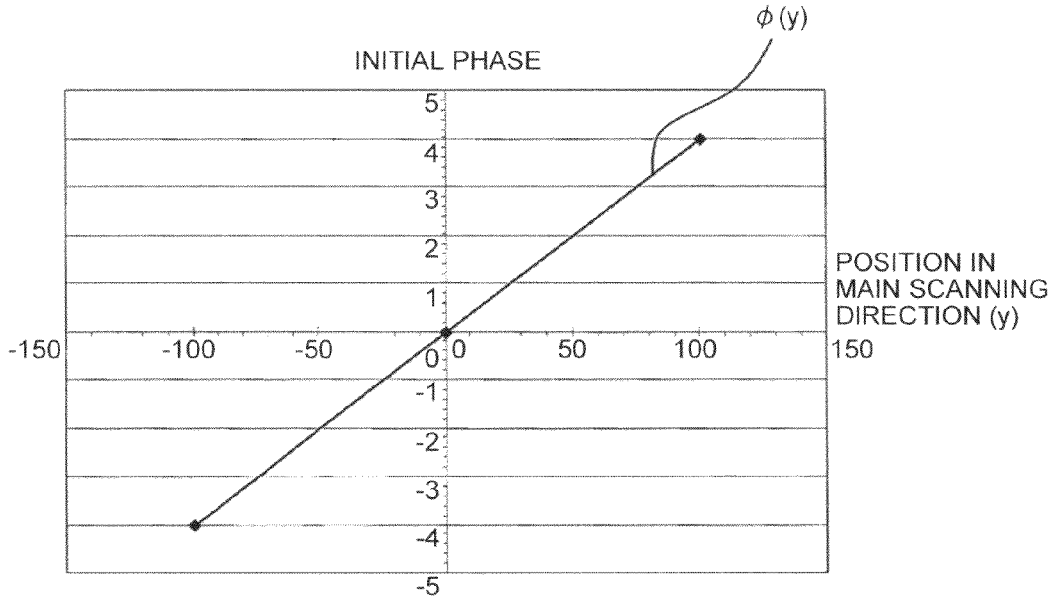
FIG. 47 is a graph illustrating an initial phase of periodical density change of the density change measurement pattern at each position in the main-scanning direction (linear function approximation)

More specifically, in FIG. 46, the three initial phases $\phi$1, $\phi$2, $\phi$3 are 0, −4, +4, respectively. When the three positions Y1, Y2, Y3 are 0, −100, +100, respectively, the relationship between the three initial phases $\phi$1, $\phi$2, $\phi$3 and the three positions Y1, Y2, Y3 is as illustrated in FIG. 47.

Figure 22:
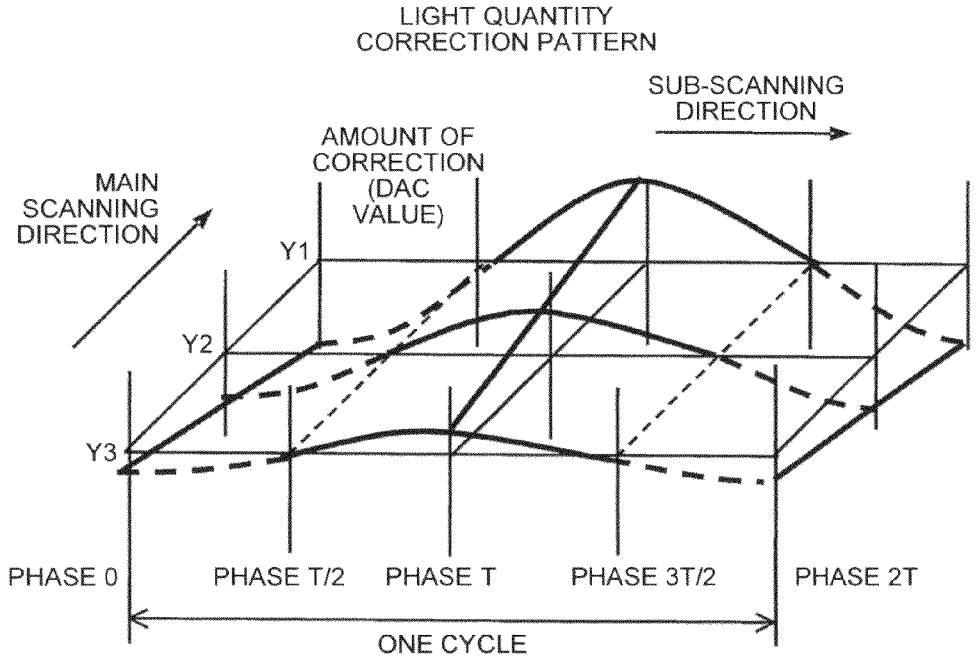
FIG. 22 is a graph illustrating a light quantity correction pattern (first light quantity correction pattern) corresponding to periodical density change at each position of the output image in the main-scanning direction (after sine wave approximation)

In this case, the three initial phases $\phi$1, $\phi$2, $\phi$3 are values suitable for approximation with a linear function, and therefore, more specifically, the three coordinates (0, 0), (−100, −4), (100, 4) are on a line in FIG. 22, and therefore, the initial phase of periodical density change at each position in the main-scanning direction is obtained through approximation with a linear function $\phi(y)=1/25y$. More specifically, the initial phase of periodical density change at each position in the main-scanning direction other than the three positions Y1, Y2, Y3 is obtained by interpolation with a linear function $\phi(y)$. It should be noted that y is a position in the main-scanning direction.

In the subsequent step S28, on the basis of the approximation expression $\phi(y)$ of the initial phase and the expressions (9) to (11), the density data processing circuit 3218 derives the relational expression of the light quantity correction with respect to the density change measurement pattern as illustrated by the following expression (12), and stores the expression to the flash memory 3211.

$$F(t,y)=S\sin(2\pi t/T+\phi(y)) \quad (12)$$

In the subsequent step S29, on the basis of relationship of the light emission power and the sensor output (toner density) as illustrated in FIG. 16 and the expression (12), the light quantity control circuit 3220 generates the light quantity correction pattern corresponding to the periodical density change of the output image in each position in the main-scanning direction (see FIGS. 48 and 49), and stores some of them to the flash memory 3211. More specifically, multiple light quantity correction patterns are individually generated in association with multiple positions in the main-scanning direction, and at least some of them are stored. For example, FIG. 48 illustrates only the light quantity correction patterns A, B, C corresponding to the three periodical density changes a, b, c, respectively.

Figure 48:
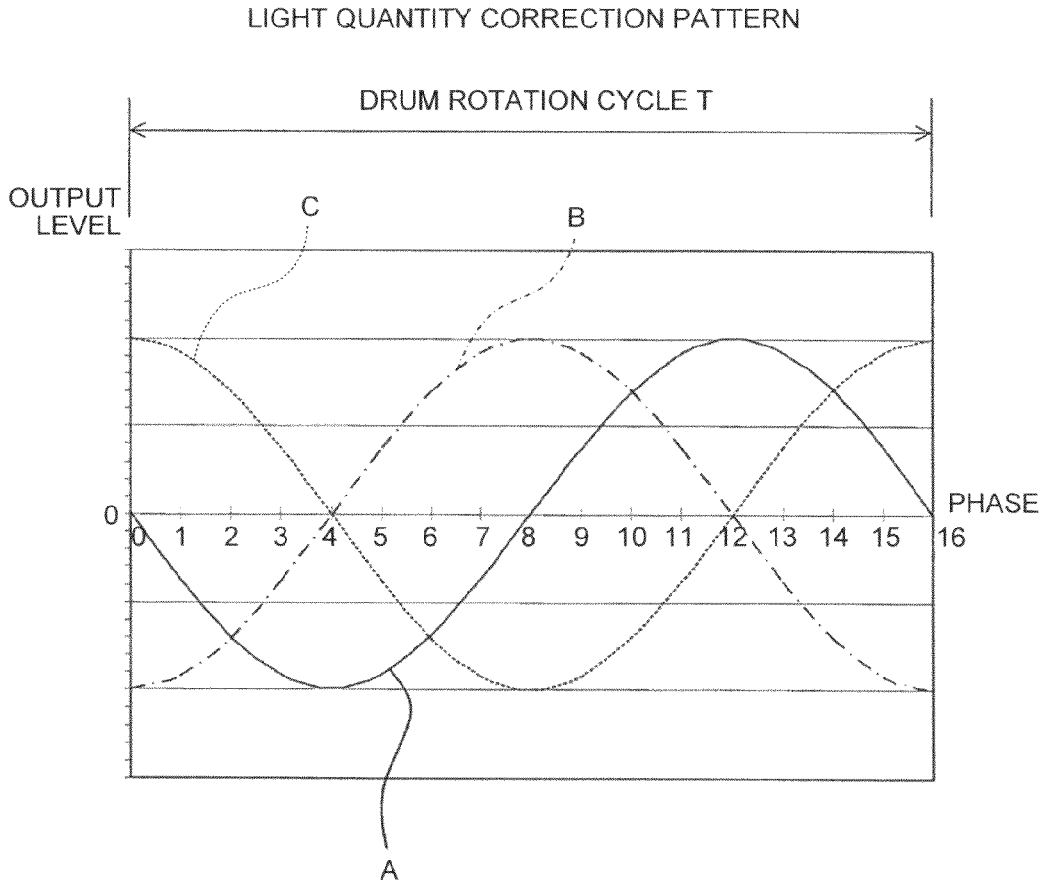
FIG. 48 is a timing chart illustrating a light quantity correction pattern corresponding to each periodical density change.
Figure 49:
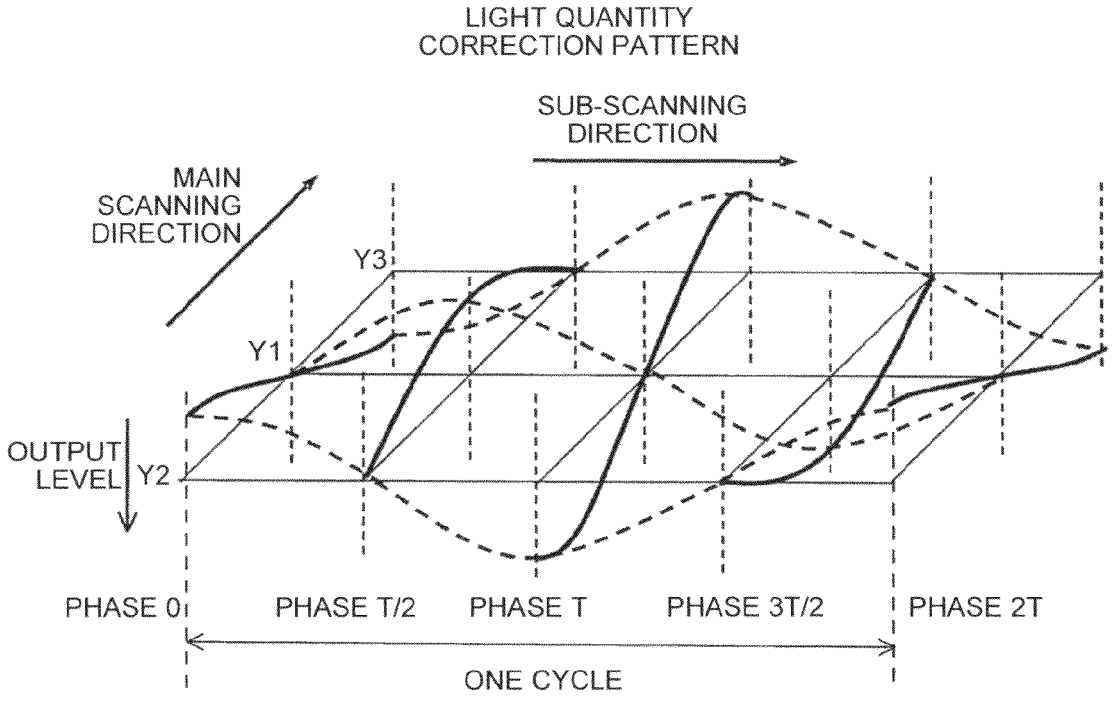
FIG. 49 is a graph illustrating a light quantity correction pattern corresponding to each periodical density change.

In this case, for example, as illustrated in FIG. 23, each light quantity correction pattern is generated as a sine wave having the same cycle as and having a phase opposite to (having a phase which is different by $\pi$ from) the periodical density change which is made into corresponding to periodic function has been approximated as the sine wave in which the drum rotation cycle Td is the cycle as illustrated in FIGS. 48 and 49. More specifically, each light quantity correction pattern is generated such that the light quantity for a portion where the toner density is high is reduced, and the light quantity for a portion where the toner density is low is increased.

For this reason, when only the data for one cycle of light quantity correction pattern at each position in the main-scanning direction are stored when stored to the flash memory 3211, the light quantity correction pattern can be reproduced by combining the data or reading the data in chronological order. As a result, the quantity of stored data can be reduced, and in addition, data write speed and read speed can be improved.

Then, when the light source drive circuit 3221 forms an image on the recording sheet with the above process, the drive signal can be corrected by superimposing the light quantity correction pattern corresponding to the position on the drive signal according to the modulated data corresponding to each position in the main-scanning direction. More specifically, the light emission powers of multiple light emitting units of the light sources are adjusted so as to suppress the periodical density change at each position in the main-scanning direction.

Subsequently, the light source drive circuit 3221 drives each light emitting unit so as to suppress the density change of the entire output image, i.e., the periodical density change of the image (output image) formed on the recording sheet at each position in the main-scanning direction on the basis of the output signals of the leading end synchronization detection sensor and the home position sensor. The light emitting unit is driven in the same manner in each station. Accordingly, the K station will be hereinafter explained as an example.

The light source drive circuit 3221 obtains write operational timing at each position in the main-scanning direction on the basis of the output signal of the leading end synchronization detection sensor 2111A, and drives the light sources using the light quantity correction pattern corresponding to the position with the write operational timing. At this occasion, adjustment is made so that the phase of light quantity correction pattern becomes opposite to the phase of the corresponding periodical density change on the basis of the output signal from the home position sensor 2246*a*.

As a result, the periodical density change at all the positions of the output image in the main-scanning direction is suppressed.

The color printer 2000 according to the present embodiment explained above includes a photosensitive drum, an optical scanning device 2010 including a light source emitting light modulated based on image information, the optical scanning device 2010 scanning a photosensitive drum surface in a main-scanning direction using light from the light source, and forming a latent image on the photosensitive drum surface, a developing roller for developing the latent image, a home position sensor for detecting a rotation cycle of the photosensitive drum, a density detection device 2245 for detecting densities at three positions Y1, Y2, Y3 of the density change measurement pattern in the main-scanning direction developed by the developing roller, and a scanning control device 3022 for obtaining initial phases $\phi$1, $\phi$2, $\phi$3 of periodical density change, of which cycle is a rotation cycle of the photosensitive drum, at the three positions Y1, Y2, Y3 on the basis of an output signal of the density detection device, and correcting a drive signal for the light source so as to suppress the periodical density change of the density change measurement pattern at each of the positions in the main-scanning direction on the basis of the rotation cycle of the initial phase and photosensitive drum.

In this case, an initial phase of periodical density change each position of the density change measurement pattern which are arranged in the main-scanning direction is obtained on the basis of the initial phases $\phi$1, $\phi$2, $\phi$3 of the periodical density changes a, b, c at the three positions Y1, Y2, Y3 of the density change measurement pattern in the main-scanning direction, whereby a drive signal of the light source can be corrected so as to suppress the periodical density change at each position of the density change measurement pattern which are arranged in the main-scanning direction on the basis of the rotation cycle of the rotation cycle of the photosensitive drum and the initial phase.

As a result, the density change over the entire output image can be suppressed to a required level.

The scanning control device 3022 obtains the initial phase of periodical density change at each position of the density change measurement pattern which are arranged in the main-scanning direction through approximation with a linear function $\phi(y)$ obtained on the basis of the initial phases $\phi$1, $\phi$2, $\phi$3 of periodical density change made into the periodic function at the three positions Y1, Y2, Y3, and generates a light quantity correction pattern for correcting the drive signal for the light source on the basis of the rotation cycle of the photosensitive drum and the initial phase of periodical density change at each position of the density change measurement pattern which are arranged in the main-scanning direction.

In this case, the light quantity correction pattern can be simplified and can be stored in a smaller data capacity as compared with a case where the light quantity correction pattern is generated faithfully to the periodical density change at each position of the density change measurement pattern which is arranged in the main-scanning direction. As a result, the data can be written and read in a shorter time, and in addition, this can reduce the decrease in the throughput (productivity). The initial phase of periodical density change at each position in the main-scanning direction is interpolated with a linear function $\phi(y)$ on the basis of the three initial phases $\phi$1, $\phi$2, $\phi$3, whereby it can be obtained accurately, and the light quantity correction pattern can be generated with a small amount of data. As a result, a large capacity memory is not necessary, and in addition, the response speed can be improved and the cost can be reduced.

The scanning control device 3022 approximates the three periodical density changes a, b, c with sine waves, and calculates the average value S of the amplitudes of the three sine waves a', b', c'. Then, the three periodical density changes a, b, c are extracted as sine waves Fa(t), Fb(t), Fc(t) having the cycle T and the amplitude S, whereby they are made into periodic functions.

In this case, even when the amplitudes of the three periodical density changes a', b', c' after the sine wave approximation vary due to, e.g., noise in the measurement, the influence caused by the variation can be reduced.

The light quantity correction pattern corresponding to the periodical density change at each position of the density change measurement pattern which is arranged in the main-scanning direction is generated as a sine wave having a phase opposite to the periodical density change.

In this case, the light quantity correction pattern can be generated with a higher degree of accuracy in a wave form close to actual periodical density change. Moreover, it is sufficient to store the light quantity correction pattern for only one rotation cycle T of the photosensitive drum, and therefore, a large scale memory is not required. In addition, the light quantity correction pattern is generated as a periodic function (sine wave), and therefore, this has resistivity against local disturbance.

In addition, the light quantity correction pattern is generated in view of the initial phase of periodical density change at each position in the main-scanning direction, and therefore, when the shaft of the photosensitive drum is inclined, or in a case of a special photosensitive drum having a different phase of periodical change in the sub-scanning direction of interval with the developing roller depending on the position in the main-scanning direction, the periodical density change occurring in the output image can be suppressed.

In the above embodiment, the three periodical density changes a, b, c are made into periodic functions, but they may not be made into periodic functions. In this case, the average value of the amplitudes and the initial phase may be directly obtained from the three periodical density changes a, b, c (see FIG. 44). At this occasion, the initial phase may be obtained while a point close to the inflection point of each periodical density change is adopted as a reference. The height of a point close to any given peak of the waveform at each periodical density change may be adopted as the amplitude of the periodical density change, and the average value of the three amplitudes may be obtained.

In the above embodiment, the periodical density changes are suppressed at all the positions in the main-scanning direction. More specifically, the drive signal of the light source corrected using all the light quantity correction patterns. Alternatively, for example, a determination may be made as to whether to suppress the periodical density change in accordance with the magnitude of the amplitude of the periodical density changes a, b, c at the positions Y1, Y2, Y3.

Figure 39:
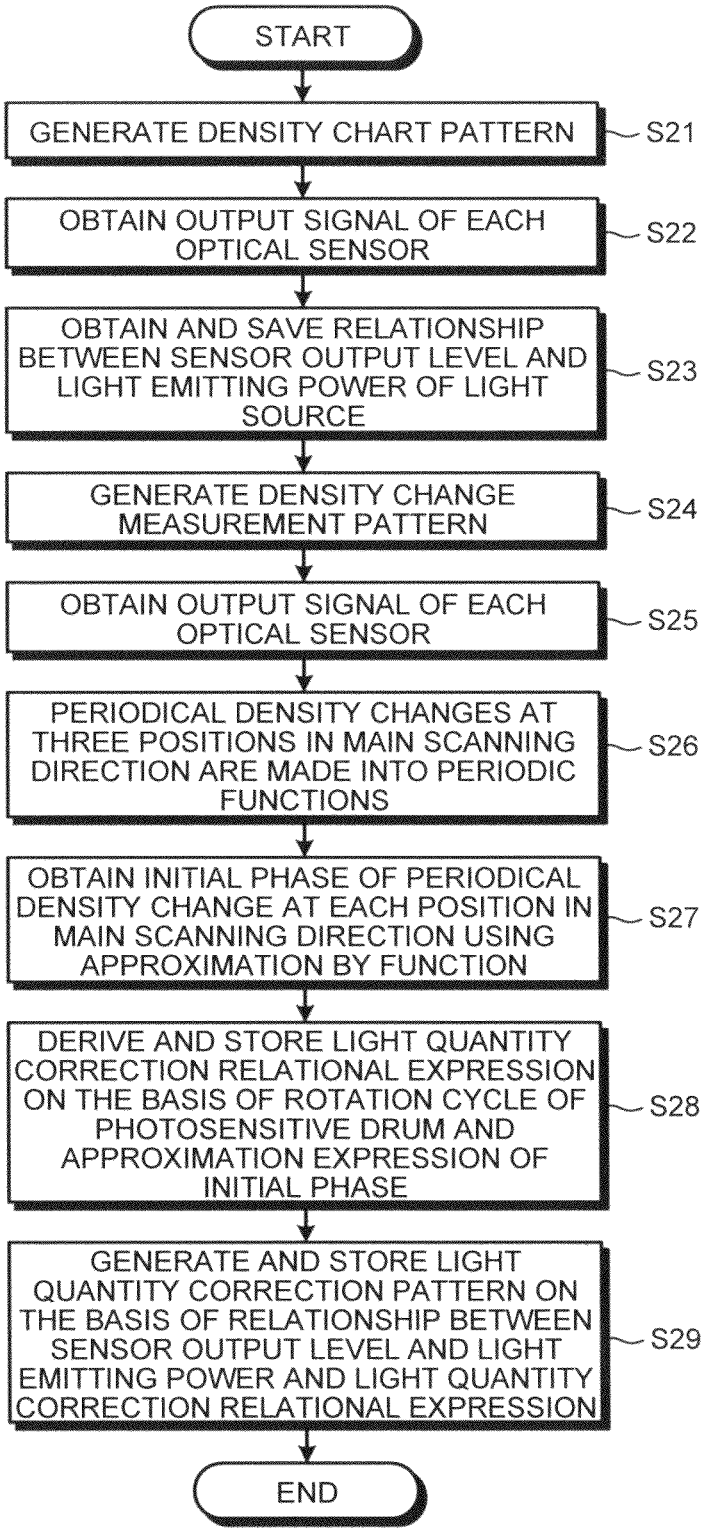
FIG. 39 is a flowchart for explaining light quantity correction information obtaining processing according to the third embodiment.

In the above embodiment, the relationship between the light emission power of the light source and the sensor output level is obtained by executing step S21, step S22 and step S23 in the flowchart of FIG. 39 in the light quantity correction information obtaining processing, but after the data of the relationship are saved in step S23 of the previous light quantity correction information obtaining processing, the saved data can be used, and therefore, in the subsequent light quantity correction information obtaining processing, it is not necessary to perform step S21, step S22 and step S23 at all times.

For example, if a time when print density becomes uneven during printing process is known in advance, the light quantity correction information obtaining processing may be performed in accordance with the known time. For example, when the density at the write start position tends to increase after printing of about N pages of recording sheets (N is an integer equal to or more than two), the light quantity correction information obtaining processing may be performed after (N+1) pages of recording sheets were printed.

Figure 50:
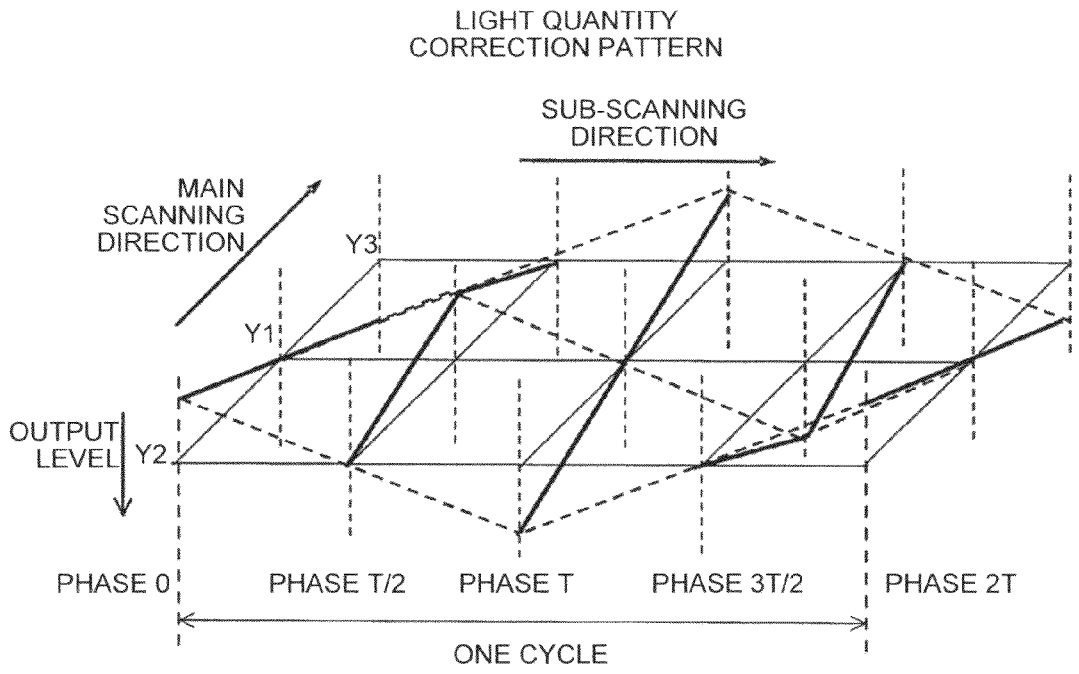
FIG. 50 is a graph illustrating a light quantity correction pattern corresponding to each periodical density change (triangular wave approximation)

As illustrated in FIG. 50, the light quantity correction pattern corresponding to each periodical density change may be generated as a triangular wave. In this case, as compared with the above, embodiment, this makes it easy for the density data processing circuit 3218 and the light quantity control circuit 3220 to perform calculation, and accordingly, the light quantity correction pattern can be generated at a lower cost, with a smaller amount of data, and in a shorter time.

Figure 51:
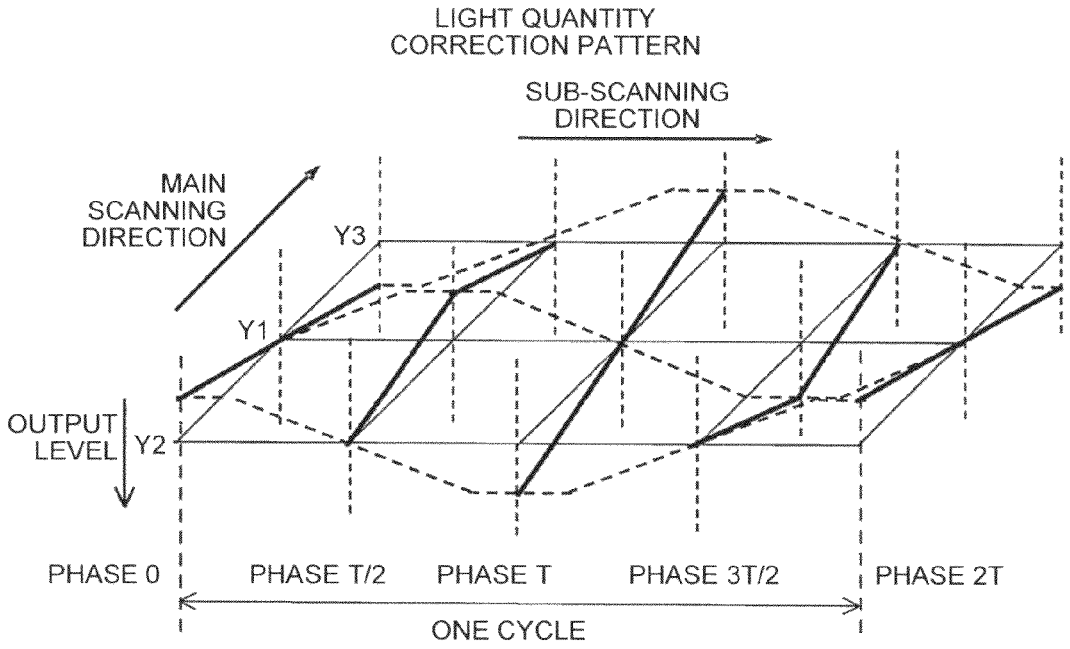
FIG. 51 is a graph illustrating a light quantity correction pattern corresponding to each periodical density change (trapezoidal wave approximation)

As illustrated in FIG. 51, the light quantity correction pattern corresponding to each periodical density change may be generated as a triangular wave. In this case, the trapezoidal wave has a feature in-between the sine wave and the triangular wave, and therefore, good balance can be maintained between the ease of calculation and the correction accuracy, and the scale of the memory can be made relatively smaller.

Figure 52:
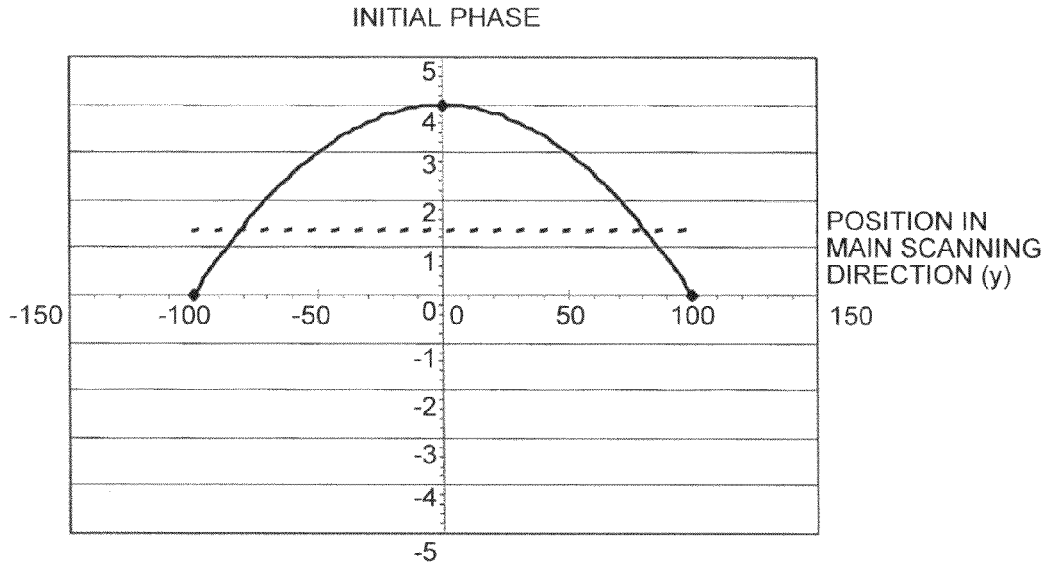
FIG. 52 is a figure for explaining difference in the interpolation accuracy between a case where an initial phase of periodical density change of the density change measurement pattern at each position in the main-scanning direction is approximated by a linear function and obtained and a case where it is approximated by a quadratic function and obtained.

By the way, it may be difficult to approximate the initial phase of periodical density change at each position of the density change measurement pattern which is arranged in the main-scanning direction using a linear function on the basis of the three initial phases $\phi 1$, $\phi 2$, $\phi 3$. More specifically, as illustrated in FIG. 52, for example, the initial phases $\phi 1$, $\phi 2$, $\phi 3$ at three positions Y1 (0 mm), Y2 (−100 mm), Y3 (+100 mm) in the main-scanning direction are 4, 0, 0, respectively, a result of approximation by linear function is what is illustrated by a broken line in FIG. 52. In this case, the initial phase at each position in the main-scanning direction (however, the three positions Y1, Y2, Y3 are excluded) cannot be obtained accurately through interpolation.

Therefore, in this case, when the initial phase of periodical density change at each position in the main-scanning direction is approximated by a curve that passes three coordinates (0, 4), (−100, 0) (100, 0) in FIG. 52 (for example, a high-order (quadratic or higher) function such as a quadratic function), it can be obtained accurately through interpolation. As a result, it is possible to cope with special phase displacement between periodical density changes at multiple positions in the main-scanning direction. The scale of the memory for the light quantity correction pattern can be made relatively small.

Figure 53:
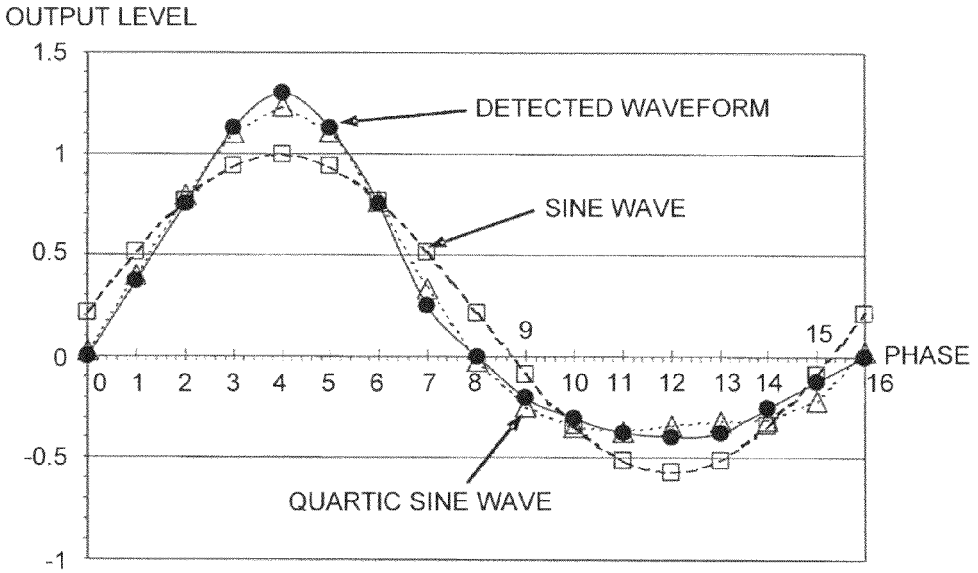
FIG. 53 is a figure for explaining difference of interpolation accuracy between a case where periodical density change obtained from the sensor output level of the optical sensor is approximated by a sine wave and a case where the periodical density change is approximated by a high-order sine wave.

As illustrated in FIG. 53, the periodical density change may be made into a periodic function through approximation by a high-order harmonic of a sine wave (sine wave). The "detection waveform" (locus of multiple circle marks) in FIG. 53 is a waveform detected by the optical sensor, and includes a certain level of distortion. More specifically, the detection waveform is a waveform that changes periodically, but, for example, because of density change and the like caused by the developing roller, the waveform may not be exactly a sine wave. When the detection waveform is approximated by a sine wave, a locus of multiple square marks in FIG. 53 is obtained, which is somewhat displaced from the detection waveform.

Accordingly, when the detection waveform is approximated by a high-order harmonic, a locus of multiple triangle marks in FIG. 53 is obtained, which is a waveform closer to the detection waveform. As a result, as compared with the above embodiment, the periodical density change can be accurately corrected.

In this case, the fourth-order harmonic is used as an example of a high-order harmonic. For example, the fourth-order harmonic is generated by combining a sine wave having a cycle T, a sine wave having a cycle ½T, and a sine wave having a cycle ¼T. It should be noted that T denotes a drum rotation cycle.

For example, using four or more optical sensors, periodical density changes at four or more positions in the main-scanning direction may be detected, and a light quantity correction pattern may be generated on the basis of the detected periodical density change. In this case, even when a special photosensitive drum is used in which the phase of change of the gap with the developing roller is changed in a complicated manner depending on the positions in the main-scanning direction, the density change in the entire output image can be suppressed.

Hereinafter, a case where five optical sensors are used will be explained as a specific example with reference to FIG. 54. The positions of the five optical sensors in the main-scanning direction will be denoted as −100 mm, −50 mm, 0, 50 mm, 100 mm, respectively. Suppose that the initial phases of periodical density changes obtained from the output signals of the five optical sensors are as follows: the initial phase is 1 at the position of −100 mm, the initial phase is 4 at the position of −50 mm, the initial phase is 2 at the position of 0, the initial phase is 4 at the position of 50 mm, and the initial phase is 3 at the position of 100 mm.

Figure 54:
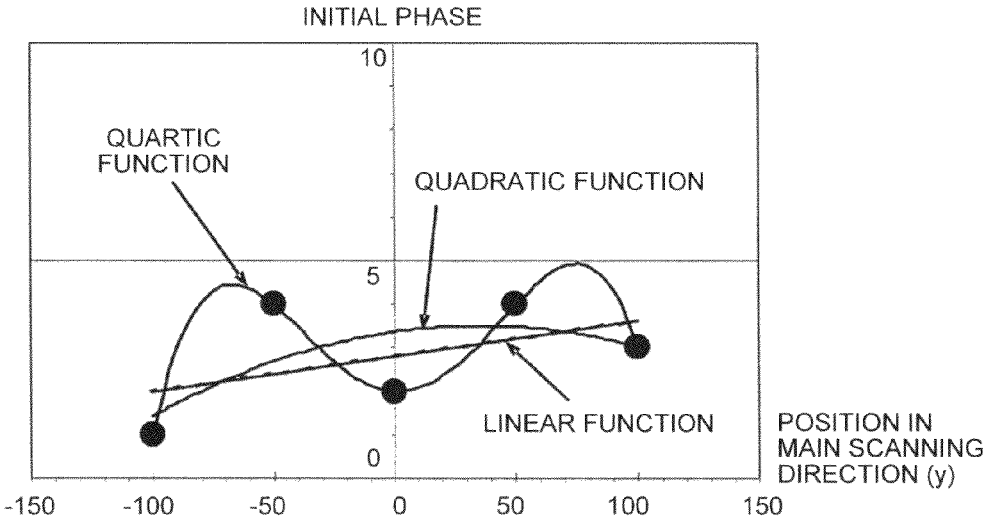
FIG. 54 is a figure for explaining difference in the interpolation accuracy between a case where an initial phase of periodical density change of the density change measurement pattern at each position in the main-scanning direction is approximated by a linear function and obtained, a case where it is approximated by a quadratic function and obtained, and a case where it is approximated by a quartic function and obtained.

In this case, when the initial phase of periodical density change at each position in the main-scanning direction is approximated by a linear function on the basis of the initial phases at the five positions, the accuracy of approximation and the accuracy of interpolation are significantly reduced as can be understood from FIG. 54.

Even if it is approximated by a quadratic function, the accuracy of approximation and the accuracy of interpolation are not sufficient.

Accordingly, when approximated by a quartic function, all the five coordinates (−100, 1), (−50, 4), (0, 2), (50, 4), (100, 3) can be traced as can be understood from FIG. 54, a light quantity correction pattern can be generated which is more close to the actual variation of the initial phase at multiple positions in the main-scanning direction, and the periodical density change at each position in the main-scanning direction can be corrected with a higher degree of accuracy.

Even when the number of optical sensors is four or six or more, a light quantity correction pattern can be generated using the same method as the case based on the five optical sensors explained above. Alternatively, two optical sensors may be used to detect two positions of the output image in the main-scanning direction. In this case, as compared with the above embodiments, the number of components can be reduced, and the control can be simplified as compared with the each of the above embodiments.

The initial phase of periodical density change of the output image at each position in the main-scanning direction is preferably obtained by approximating k initial phases of periodical density changes obtained from the output signals of the k optical sensors (k is equal to or more than two) using a function of an order equal to or more than (k−1).

For example, the density detecting device may be one line sensor having multiple optical sensor units arranged in the Y axis direction.

In the above embodiment, the density change measurement pattern is formed in the "A3" size in the portrait orientation, but the embodiment is not limited thereto. For example, a density change measurement pattern having multiple long and narrow belt-like patterns in which the width in the main-scanning direction is equal to or more than the width of each optical sensor in the main-scanning direction, and the length in the sub-scanning direction is equal to or more than one drum rotation cycle T may be generated. In this case, the consumption of the toner can be reduced as much as possible.

In the above embodiment, at least some of the processing of the scanning control device 3022 may be performed by the printer control device 2090. At least some of the processing of the printer control device 2090 may be performed by the scanning control device 3022.

At least one of the density data processing circuit 3218 and the light quantity control circuit 3220 may not be provided, and the processing performed by one or both of them may be performed by the CPU 3210, for example.

Some of the processing performed by the density data processing circuit 3218 (for example, deriving and storing of the light quantity correction relational expression) may be performed by the light quantity control circuit 3220, and some of the processing performed by the light quantity control circuit 3220 (for example, generation and storage of the light quantity correction data) may be performed by the density data processing circuit 3218.

In the explanation about the above embodiment, the density detection device 2245 detects the toner pattern on the transfer belt 2040, but the embodiment is not limited thereto. A toner pattern on the photosensitive drum surface may also be detected. The surface of the photosensitive drum is almost regular reflection body, just like the transfer belt 2040.

In the above embodiment, the toner pattern may be transferred onto a recording sheet, and the toner pattern on the recording sheet may be detected by the density detection device 2245.

In the explanation about the above embodiment, the optical scanning device is integrally configured, but the embodiment is not limited thereto. For example, an optical scanning device may be provided for each image forming station, or an optical scanning device may be provided for every two image forming stations.

In the explanation about the above embodiment, the four photosensitive drums are provided, but the embodiment is not limited thereto. For example, five or six photosensitive drums may be provided.

In the explanation about the above embodiment, the color printer 2000 is explained as the image forming apparatus, but the embodiment is not limited thereto.

For example, an image forming apparatus for emitting laser light directly onto a medium (such as a sheet) that generates color with the laser light may be employed.

An image forming apparatus using a silver halide film as an image carrier may also be employed. In this case, a latent image is formed on a silver halide film by optical scanning, and the latent image can be made visible using the same processing as the development processing of ordinary silver halide photography process. Using the same processing as the photo printing processing of the ordinary silver halide photography process, it can be transferred onto printing paper. Such image forming apparatus can be carried out as a light drawing device for drawing a CT scan image and the like and a light plate-making device.

The image forming apparatus may be an image forming apparatus other than a printer such as, e.g., a copier, a facsimile machine, or a multi-function peripheral having them integrally.

As explained above, according to the image forming apparatus of the present embodiment, it is suitable for forming a high quality image.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a photosensitive drum;

an optical scanning device that includes a light source, the optical scanning device scanning a surface of the photosensitive drum in a main-scanning direction using light from the light source, and that forms a latent image on the surface of the photosensitive drum;

a developing unit that develops the latent image;

a drum cycle detection sensor that detects a rotation cycle of the photosensitive drum;

a density detection unit that detects densities of an image developed by the developing unit at a plurality of positions in the main-scanning direction;

a processing unit that obtains at least one of an amplitude and a phase of a first periodical density change of the image, of which cycle is a rotation cycle of the photosensitive drum, at the plurality of positions in the main-scanning direction on the basis of an output signal of the density detection unit, and that corrects a drive signal for the light source so as to suppress the first periodical density change of the image at each position in the main-scanning direction on the basis of the rotation cycle of the photosensitive drum and at least one of the amplitude and the phase.

2. The image forming apparatus according to claim 1, wherein the developing unit includes a developing roller facing the photosensitive drum, the image forming apparatus further comprises a roller cycle detection sensor that detects a rotation cycle of the developing roller, and the processing unit further obtains an amplitude of a second periodical density change of which cycle is a rotation cycle of the developing roller at the plurality of positions of the image on the basis of the output signal of the density detection unit, and corrects the drive signal of the light source so as to further suppress the second periodical density change of the image at each position in the main-scanning direction on the basis of the rotation cycle of the developing roller and the amplitude of the second periodical density change.

3. The image forming apparatus according to claim 1, wherein the processing unit obtains the amplitude of the first periodical density change of the image at each of the positions in the main-scanning direction through approximation by a function obtained on the basis of the amplitude of the first periodical density change of the image at the plurality of positions, and generates a correction pattern for correcting the drive signal on the basis of the amplitude of the first periodical density change and the rotation cycle at each position in the main-scanning direction of the image.

4. The image forming apparatus according to claim 3, wherein the function obtained based on the amplitude is a linear function.

5. The image forming apparatus according to claim 3, wherein the function obtained based on the amplitude is a high-order function.

6. The image forming apparatus according to claim 3, wherein the plurality of positions include three or more positions.

7. The image forming apparatus according to claim 1, wherein the processing unit obtains an initial phase of the first periodical density change of the image at each position in the main-scanning direction through approximation by a function obtained on the basis of the initial phase of the first periodical density change of the image at the plurality of positions, and generates a correction pattern for correcting the drive signal on the basis of the initial phase of the first periodical density change and the rotation cycle at each position in the main-scanning direction of the image.

8. The image forming apparatus according to claim 7, wherein the function is a linear function.

9. The image forming apparatus according to claim 7, wherein the function is a high-order function.

10. The image forming apparatus according to claim 7, wherein the plurality of positions include three or more positions.

11. The image forming apparatus according to claim 2, wherein the processing unit obtains an initial phase of the second periodical density change of the image at each of the positions in the main-scanning direction through approximation by a function obtained on the basis of the initial phase of the second periodical density change of the image at the plurality of positions, and generates a correction pattern on the basis of the initial phase of the second periodical density change of the image at each position in the main-scanning direction.

12. The image forming apparatus according to claim 11, wherein the function obtained based on the initial phase is a linear function.

13. The image forming apparatus according to claim 11, wherein the function obtained based on the initial phase is a high-order function.

14. The image forming apparatus according to claim 1, wherein the processing unit approximates the first periodical density change at the plurality of positions using a sine wave, and generates the correction pattern on the basis of the sine wave.

15. The image forming apparatus according to claim 1, wherein the processing unit approximates the first periodical density change at the plurality of positions using a high-order harmonic, and generates the correction pattern on the basis of the harmonic.

16. The image forming apparatus according to claim 1, wherein the processing device approximates the periodical density change at the plurality of positions using a trapezoidal wave, and generates the correction pattern on the basis of the trapezoidal wave.

17. A density change suppressing method for suppressing density change of an image formed on the basis of image information, the method comprising:

scanning a photosensitive drum surface using light from a light source in a main-scanning direction, and forming a latent image on the photosensitive drum surface;

developing the latent image;

detecting density change in a sub-scanning direction which is perpendicular to the main-scanning direction at a plurality of positions in the main-scanning direction of the developed image;

obtaining at least one of an amplitude and a phase of a first periodical density change of which cycle is a rotation cycle of the photosensitive drum at the plurality of positions of the image on the basis of the detected density change; and generating a first correction pattern for a drive signal of the light source so as to suppress the first periodical density change of the image at each position in the main-scanning direction on the basis of the rotation cycle of the photosensitive drum and at least one of the amplitude and the phase.

18. The density change suppressing method according to claim 17 further comprising:

obtaining an amplitude of a second periodical density change of which cycle is a rotation cycle of the developing roller at the plurality of positions of the image on the basis of the detected density change; and generating a second correction pattern for a drive signal of the light source so as to suppress the second periodical density change of the image at each position in the main-scanning direction on the basis of the rotation cycle of the developing roller and the amplitude of the second periodical density change.

19. The density change suppressing method according to claim 17, wherein in the generating the correction pattern, the amplitude of the first periodical density change of the image at each position in the main-scanning direction is obtained through approximation by a function obtained on the basis of the amplitude of the first periodical density change of the image at the plurality of positions, and the correction pattern is generated on the basis of the amplitude of the first periodical density change and the rotation cycle at each position in the main-scanning direction of the image.

20. The density change suppressing method according to claim 17, further comprising obtaining a initial phase of the first periodical density change of the image at the plurality of positions on the basis of the detected density change, wherein in generating the correction pattern, the drive signal is corrected on the basis of the initial phase, the amplitude of the first periodical density change of the image at the plurality of positions, and the rotation cycle.

* * * * *